US010371394B2

(12) United States Patent
Wernimont et al.

(10) Patent No.: US 10,371,394 B2
(45) Date of Patent: Aug. 6, 2019

(54) MOBILE, MODULAR CLEANROOM FACILITY

(75) Inventors: Chris Wernimont, New Palestine, IN (US); Mark Nordemeyer, Indianapolis, IN (US); Michael Lawrence, Lawrenceburg, IN (US); Clark Byrum, Jr., Carmel, IN (US)

(73) Assignee: Biologics Modular LLC, Brownsburg, IN (US)

( * ) Notice: Subject to any disclaimer, the term of this patent is extended or adjusted under 35 U.S.C. 154(b) by 1830 days.

(21) Appl. No.: 13/237,115

(22) Filed: Sep. 20, 2011

(65) Prior Publication Data

US 2012/0077429 A1 Mar. 29, 2012

Related U.S. Application Data

(60) Provisional application No. 61/414,584, filed on Nov. 17, 2010, provisional application No. 61/384,442, filed on Sep. 20, 2010.

(51) Int. Cl.

| | |
|---|---|
| ***B01L 1/04*** | (2006.01) |
| ***F24F 3/16*** | (2006.01) |
| *E04H 1/12* | (2006.01) |

(52) U.S. Cl.

CPC ..... *F24F 3/161* (2013.01); *B01L 1/04* (2013.01); *E04H 2001/1283* (2013.01); *F24F 2221/12* (2013.01); *F24F 2221/36* (2013.01)

(58) Field of Classification Search

CPC .... E04H 2001/1283; B01L 1/04; F24F 3/161; F24F 2221/12; F24F 2221/36

USPC ..... 52/79.9; 454/187

See application file for complete search history.

(56) References Cited

U.S. PATENT DOCUMENTS

| | | | | |
|---|---|---|---|---|
| 3,925,679 | A * | 12/1975 | Berman | E04B 1/3483 290/1 R |
| 4,667,580 | A * | 5/1987 | Wetzel | 454/187 |
| 4,854,094 | A * | 8/1989 | Clark | E04B 1/3483 52/234 |

(Continued)

OTHER PUBLICATIONS

Milstead, "Travis Clean Air's Modular Acrylic Cleanroom", Pharmacy Purchasing & Products, vol. 5 #5, 2008, 7 pages.

(Continued)

*Primary Examiner* — Steven B McAllister
*Assistant Examiner* — Ko-Wei Lin
(74) *Attorney, Agent, or Firm* — Woodard, Emhardt, Henry, Reeves & Wagner, LLP

(57) ABSTRACT

A mobile, modular, cleanroom facility is made from one or more pre-assembled modules, transportable in their pre-assembled form. Each pre-assembled module includes an air filtration system including a ceiling plenum for providing clean air to the interior of the module. The air filtration system provides air cleaned to at least an ISO 8 classification. When the mobile, modular cleanroom facility is made of two or more modules, each of the modules is pre-assembled, and is transportable in its pre-assembled form. Each of the modules also includes an air filtrations system having a ceiling plenum for providing clean air to the interior of the module. Most preferably, the modules are connected by a connection assembly effective for providing a seamless transition from one module to the other while maintaining the appropriate clean air classification in the transition space.

19 Claims, 57 Drawing Sheets

(56) References Cited

U.S. PATENT DOCUMENTS 5,247,901 A * 9/1993 Landon et al. ..... 119/419
5,285,604 A * 2/1994 Carlin ..... 52/79.1
5,562,539 A * 10/1996 Hashimoto ..... F24F 3/161 454/140
5,620,369 A * 4/1997 Spransy ..... F24F 3/161 454/187
5,950,373 A * 9/1999 von Hoff ..... E02D 27/01 206/321
6,176,046 B1 * 1/2001 Quine et al. ..... 52/79.1
6,351,920 B1 * 3/2002 Hopkins ..... F24F 3/1603 454/187
6,358,139 B1 * 3/2002 Renz ..... 454/187
6,393,775 B1 * 5/2002 Staschik ..... 52/79.1
6,471,582 B1 * 10/2002 Tucker ..... F24F 3/161 454/187
6,973,758 B2 * 12/2005 Zeik ..... E04B 1/3483 52/169.6
7,513,822 B2 * 4/2009 Flitsch ..... 454/187
8,291,647 B2 * 10/2012 Esposito ..... 52/66
8,919,049 B2 * 12/2014 Meserini ..... E03C 1/01 52/143
2002/0068524 A1 * 6/2002 Nakagawa ..... F24F 3/161 454/187
2003/0138344 A1 * 7/2003 Mielnik ..... A61L 2/206 422/2
2005/0193643 A1 * 9/2005 Pettus ..... 52/79.1
2007/0132262 A1 * 6/2007 Chui Peng Sun et al. ..... 296/24.38
2007/0238166 A1 10/2007 McNelly
2008/0053992 A1 * 3/2008 DeBord ..... E04H 1/1205 220/1.6
2008/0134589 A1 * 6/2008 Abrams ..... E04B 1/003 52/79.1
2009/0049795 A1 * 2/2009 Platts ..... E04G 23/02 52/748.11
2009/0223143 A1 * 9/2009 Esposito ..... 52/79.1
2009/0282749 A1 * 11/2009 Warminsky ..... E04H 9/10 52/79.1
2009/0305626 A1 12/2009 Hope
2010/0022179 A1 * 1/2010 Uematsu ..... H01L 21/67115 454/187
2010/0105309 A1 * 4/2010 Ishibashi ..... B01D 46/0028 454/187
2011/0000146 A1 * 1/2011 Takeda ..... A47C 29/003 52/79.1
2011/0005144 A1 * 1/2011 McDougall ..... E04B 1/34321 52/79.1
2013/0109291 A1 * 5/2013 Holtz et al. ..... 454/187

OTHER PUBLICATIONS

Portafab Modular Building Systems, PharmaSystem Aseptic Cleanrooms, Miscellaneous material from website: http://www.portafab.com/pharmasystem.html, Jan. 12, 2012, 2 pp.
Porta-Fab Modular Wall Systems for Cleanroom Environments, 1993 Porta-Fab Corporation, Chesterfield, Missouri, 8 pages.
Sea Box Intermodal Concepts, Miscellaneous Materials from website from http://www.seabox.com/v3/engineering, Jan. 8, 2010, 9 pp.

* cited by examiner

YXZ Standards Certification LLC

Phone: (123) 456-7890
Fax: (123) 456-7810 www.YXZcertifications.std
Cell (123) 456-7811

Cleanroom Certificate of Performance

WE HAVE TESTED THIS MANUFACTURING OR RESEARCH SPACE USING METHODS PRESCRIBED BY ISO 14644

Date: 12 Aug. 2010
Technician: S C D
ISO Classification: 7
Retest Due: 12 Aug. 2011
Performance Certification # 3

R. S. Clean
NSF Certification # LD37-2ar

*Fig. 22*

MOBILE, MODULAR CLEANROOM FACILITY

CROSS REFERENCE TO RELATED APPLICATIONS

This application claims the benefit of the filing date of U.S. Provisional Application No. 61/384,442, filed Sep. 20, 2010, and the benefit of the filing date of U.S. Provisional Application No. 61/414,584, filed Nov. 10, 2010. Both of the above-referenced applications are hereby incorporated herein by reference.

FIELD OF THE INVENTION

The present invention relates generally to cleanrooms for use in developing or manufacturing products such as pharmaceuticals, biopharmaceuticals, imaging agents, bioagricultural products, and the like, and more particularly to cleanroom space that can be efficiently provided and moved between various research, development and production locations.

BACKGROUND

Cleanroom space is a necessary component for the development and manufacture of biotech products. For example, 21 CFR 210-211 describes the current Good Manufacturing Practices (cGMP) regulations that must be followed in the manufacturing, processing, packaging or holding of a drug product. These regulations require that equipment for adequate control over air pressure, micro-organisms, dust, humidity, and temperature must be provided, and that air filtration systems must be used on air supplies to production areas. If air is recirculated, the regulations require that measures must be taken to control recirculation of dust from production, and in areas where air contamination occurs during production, there must be adequate exhaust systems or other systems adequate to control contaminants.

Entities in the business of developing and manufacturing biotech products typically have permanent cleanrooms and/or other appropriate facilities devoted to product development and manufacturing. These facilities are designed to provide appropriate levels of cleanroom technology, and are validated to ensure compliance with all applicable standards.

Entities that doe not routinely develop or manufacture biotech products may not have appropriate dedicated facilities. When such entities need cleanroom space, the problems associated with designing, building and validating the space may be prohibitive in both time and cost.

A need therefore exists for a mobile, modular cleanroom facility that can be pre-designed, pre-constructed, and pre-validated, and can then be transported to a selected location to provide cGMP-compliant workspace for developing and/or manufacturing cleanroom-sensitive products. The present invention addresses that need.

SUMMARY OF THE INVENTION

Briefly describing one aspect of the present invention, a mobile, modular, cleanroom facility is provided. In one embodiment the mobile, modular cleanroom facility includes a pre-assembled module, transportable in its pre-assembled form. The pre-assembled module includes an air filtration system including a ceiling plenum for providing clean air to the interior of the module. The air filtration system provides air cleaned to at least an ISO 8 classification.

In other preferred embodiments the mobile, modular cleanroom facility comprises two or more modules. Each of the modules is pre-assembled, and is transportable in its pre-assembled form. Each of the modules also includes an air filtrations system having a ceiling plenum for providing clean air to the interior of the module. Air cleaned to at least an ISO 8 classification is provided to at least one of the modules. Most preferably, the modules are connected by a connection assembly effective for providing a seamless transition from one module to the other while maintaining the ISO 8 or better classification in the transition space.

In the most preferred embodiments the modules used to make single- or multi-module facilities are made from intermodal shipping containers. Such shipping containers are generally made of metal and have a container bottom, a container roof, a pair of container sidewalls, a closed container endwall, and an openable container endwall. To convert the container to a cleanroom facility, the containers are built-out so that a flooring material covers substantially all of the container bottom, an interior ceiling is provided below and spaced apart from the container roof, and interior sidewalls and endwalls are provided over, but preferably spaced slightly apart from, the container sidewalls and endwalls. The ceiling, floor, interior sidewalls and interior end walls combine to define an interior clean space having controlled air flow therethrough. The interior clean space may be subdivided into workspaces with differing cleanroom classifications. For example, the facility may be subdivided to include an outer space having an ISO 8 cleanroom classification, and an inner space having an ISO 7 cleanroom classification. Another inner workspace having an ISO 5 cleanroom classification may also be provided.

The ceiling may extend across all of the finished interior workspace, with the space between the container roof and the interior ceiling defining a ceiling plenum for providing cleanroom air to said first mobile module. One or more air filters may be included in the ceiling. The filters may be effective for filtering air to at least an ISO 8 cleanroom standard.

The module roof may include an opening, and a blower may be mounted above the roof and ducted to blow air through the roof opening and into the ceiling plenum. The roof may be coated on the outside with a durable water-resistant coating. For example, a durable water-resistant resin-based spray liner material may be used to cover the roof.

The space between at least one interior sidewall and the corresponding container sidewall may house one or more air returns for routing air from the interior workspace to the blower. A damper may be included in each air return for controlling air flow through the air return.

When the container has an openable endwall, the space between one interior end wall and the openable container endwall may be a service compartment housing an electrical service panel.

When multiple modules are used, each of the modules may have an opening in at least one sidewall, with said sidewall openings being aligned to facilitate connection between the modules when the modules are placed side-to-side. A connection assembly may be provided to bridge the space between adjacent modules. The connection assembly may include a first connector frame fixedly attached to one module, and a second connector frame fixedly attached to a second mobile cleanroom module. The two connector frames may be connected by a plurality of bolts. As previously indicated, the connection assembly provides a seamless transition from one module to the other while maintaining the clean air (e.g., ISO 8 or better classification) requirements in the transition space.

The most preferred cleanroom modules have a length of about forty feet, a width of about eight feet, and a height of about 9.5 feet, although other module sizes may be used.

DESCRIPTION OF THE DRAWINGS

FIG. 22 shows a cleanroom certificate of performance for a mobile, modular cleanroom facility according to one embodiment of the present invention.

DESCRIPTION OF PREFERRED EMBODIMENTS

Figure 1:
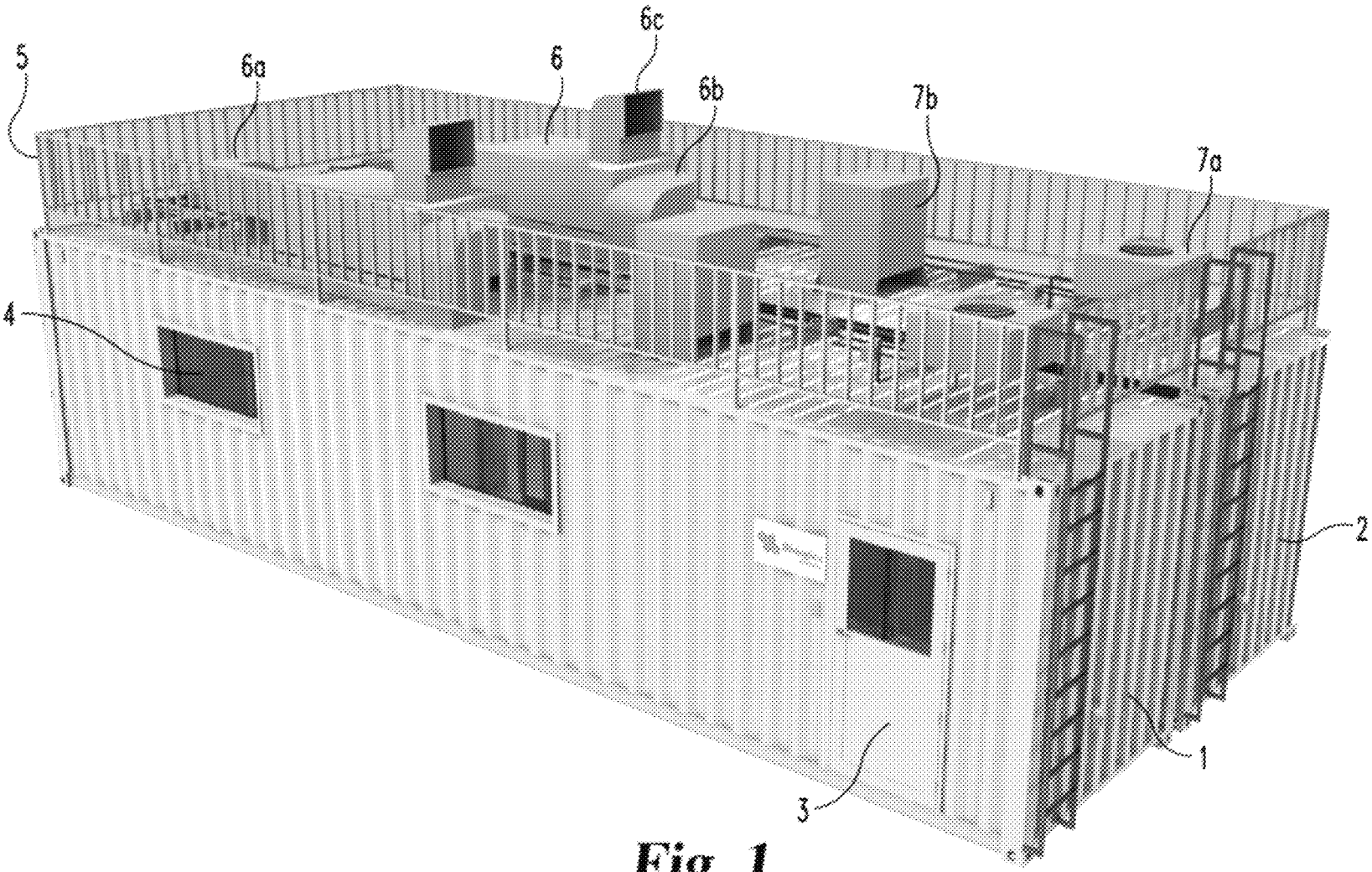
FIG. 1 is a perspective view of one multi-module embodiment of the mobile, modular cleanroom facility of the present invention.

While the present invention may be embodied in many different forms, for the purpose of promoting an understanding of the principles of the present invention, reference will now be made to certain preferred embodiments, and specific language will be used to describe the same. It will nevertheless be understood that no limitation of the scope of the invention is thereby intended. Any alterations and further modifications in the described embodiments and any further applications of the principles of the present invention as described herein are contemplated as would normally occur to one skilled in the art to which the invention relates.

As briefly described above, one aspect of the invention provides a mobile, modular, cleanroom facility. The facility includes at least one pre-assembled module that is transportable in its pre-assembled form. The pre-assembled module includes an air filtration system that includes a ceiling plenum for providing clean air to the interior of the module. The air filtration system provides air cleaned to at least an ISO 8 classification.

The mobile, modular, cleanroom facility may be made from one or more intermodal shipping containers. Such shipping containers generally have a container bottom, a container roof, a first container sidewall, a second container sidewall, a closed container endwall, and an openable container endwall. When converted to a cleanroom facility, the containers are finished to include a cleanroom floor over substantially all of the container bottom, a ceiling below and spaced apart from the container roof, a first interior cleanroom sidewall over (e.g., substantially parallel to and spaced slightly apart from) the first container sidewall, a second interior cleanroom sidewall over (e.g., substantially parallel to and spaced slightly apart from) the second container sidewall, a first interior end wall over (e.g., substantially parallel to and spaced slightly apart from) the closed container end wall, and a second interior end wall over (e.g., substantially parallel to and spaced a short distance from) said openable container endwall. The ceiling, floor, interior sidewalls and interior end walls combine to define an interior clean space having controlled air flow therethrough.

The interior clean room space is substantially airtight and watertight to maintain its cleanroom capability. All connections between ceilings, walls, floors and modules, and all spaces around vents, door openings, fixtures, etc., are cleaned and caulked to provide a seamless, airtight and watertight space, The interior clean space may be subdivided to provide multiple workspaces having differing cleanroom properties. For example, the interior space may be subdivided to include an outer room having an ISO 8 cleanroom classification, an inner room having an ISO 7 cleanroom classification, and an inner workspace having an ISO 5 cleanroom classification.

An air filtration system is provided to clean the air in the interior workspace. The air filtration system recirculates air to the interior workspace through a ceiling plenum that directs the air through one or more ceiling filters. The ceiling plenum is preferably formed by providing an interior ceiling below the container roof, with the interior ceiling preferably extending substantially from the first container sidewall to the second container sidewall, and from the closed container endwall to the openable container endwall. One or more air filters may be included in the ceiling so that the air is filtered to at least an ISO 8 cleanroom standard.

Air is directed into the ceiling plenum from blowers that are preferably mounted on the module roof. The blowers receive air from return air ducts in the interior walls, and make-up air vents in the blowers. Dampers may be included in each air return for controlling air flow through the air return, thus allowing the air pressures in the various workspaces to be controlled.

In one preferred embodiment the mobile, modular, cleanroom facility may include multiple modules. In these multiple-module facilities each module preferably has an opening in at least one sidewall, with the sidewall openings being aligned to facilitate connection between the modules when the modules are placed side-to-side. A connection assembly may be provided to bridge the space between adjacent modules. The connection assembly may include a first connector frame fixedly attached to one module, and a second connector frame fixedly attached to a second mobile cleanroom module. The two connector frames may be connected by a plurality of bolts. The connection assembly provides a seamless transition from one module to the other while maintaining the clean air (e.g., ISO 8 or better classification) requirements in the transition space.

In one embodiment each mobile cleanroom module has a length of about forty feet, a width of about eight feet, and a height of about 9.5 feet.

1. The Module Construction

The mobile, modular cleanroom facilities of the present invention may be made of essentially any construction material that may be assembled into modules that are transportable in their pre-assembled form. In the most preferred embodiments however, intermodal shipping containers are used to provide the module shell. Such intermodal shipping containers are well known, and typically comprise a metal top, a metal bottom, and four metal walls in a rectangular block shape. Structural support rails are preferably provided along each of the edges of the container to provide structural support to the module. One of the walls is typically an end wall comprising a pair of large doors that open outward to allow access to the contained interior. The other end wall and the two sidewalls are typically closed. All of the walls are typically made of heavy-duty steel, with at least some of the walls being corrugated. A "twistlock" corner casting is preferably provided on the lower corners of the containers to facilitate attachment of one container to another, or attachment to a truck bed, freight train, or ship. The containers are commonly used for intermodal transport, including transport by sea, train, and/or truck, and may be referred to as a shipping container, a cargo container, a storage container, an intermodal container, an ISO container, etc.

In one embodiment the intermodal container has a length of about forty feet, a width of about eight feet, and a height of about 9.5 feet. In other embodiments the intermodal container may have a length of about 10 feet, or about 20 feet, or about 30 feet, or about 48 feet, or more. The container may have a width of about eight feet, and a height of either about 8.5 or about 9.5 feet, although other lengths, widths, and/or heights may be used.

As indicated above, the modules may be made of a material that is not an intermodal shipping container. For example, other pre-fabricated construction materials may be used. The materials may be new, or they may have previously been used.

Regardless of what material is used as the "shell" of the module, the module is finished in the inside to provide a work environment suitable for product development and/or manufacturing requiring cleanroom space. When an intermodal container is used, an interior floor is provided over the bottom of the container shell. The floor is finished to a clean appearance, and is preferably provided as a generally smooth, hard surface to facilitate cleaning. While generally smooth, the floor may be textured for safety.

Before installing the flooring it may be necessary to plane or otherwise level the inside of the container bottom to remove any irregularities that may be present. This step may be particularly advantageous when a subflooring will not be used.

To mitigate the effects of an uneven container bottom, a subflooring may be used to provide a smooth, even foundation for the interior floor. For example, a ¾" subflooring may be applied over the container bottom before the finished flooring material is applied.

Regardless of whether a subflooring is used, a finished flooring material is ultimately applied. In one embodiment the finished flooring material is a durable water-resistant coating that is sprayed over the entire subflooring or container bottom. For example, as a durable water-resistant resin-based spray liner material may be used, with single or multiple coats of material being applied to provide the appropriate thickness and durability.

In one preferred embodiment the floor coating material is a Vortex™ spray liner material such as the Granitex HD-8000 baked-on floor system. The Granitex HD-8000 floor system may have a polyphatic glaze, which is a hybrid combination of extremely durable polyurea base resin with UV & a chemical resistant aliphatic urethane. The Granitex polyphatic glaze may be applied in either a solid high gloss color of a faux granite finish.

In the most preferred embodiments the floor and wall seam is coved to eliminate corners that may hold dust or other contaminants. Additionally, the flooring material is splayed to some height up the wall to protect the wall from exposure to cleaning solutions that are frequently applied to cleanroom floors.

If desired, the interior floor may be raised slightly from the container bottom to facilitate passing wires, pipes, ducts, conduits, etc., beneath the floor.

As with the container floor, when an intermodal shipping container is used the container roof is preferably covered on the inside to provide a work environment suitable for biotech product development and/or manufacturing. In addition, the ceiling will form the bottom of a "ceiling plenum" that provides clean air to the interior workspace.

To prepare the ceiling area for finishing, the roof and upper portions of the container are scraped clean and sprayed with a primer material to provide a clean, even surface. All rust, dirt and other debris is removed from the ceiling area.

In one embodiment the ceiling is positioned at a depth of about six to twelve inches, preferably about seven inches, below the roof of the container. Metal ceiling joists may be used to establish the ceiling location, with gypsum board or a comparable material being installed with a normal drywall process (i.e., seams taped, mud applied and sanded smooth) to provide the finished ceiling.

In one embodiment the ceiling is provided with a ceiling plenum divider—a medium gage steel plate that is welded to the roof that drops down approximately 7" and bends so that the ceiling joists are welded to them. This is done to better separate the plenum supply area from the area above the ceiling that has the return air ducts.

When an intermodal shipping container is used as the basis of the module, the plenum divider may be attached to the container along one of the top rails that connect the top to the two sidewalls. A plenum side wall may be attached to the opposite top rail. Plenum end walls may be similarly provided at each end of the container. The plenum divider and the plenum side and end walls thus cooperate with the container top to form five walls of the ceiling plenum. The sixth wall of the ceiling plenum may be provided by the ceiling joists and/or the ceiling drywall that is supported by the ceiling joists. In one preferred embodiment a second sidewall, similar to the plenum sidewall, is provided at the wall nearest the plenum divider. This second sidewall is preferably outside the plenum space, although if a plenum divider is not used the second sidewall may cooperate with the first plenum sidewall and the two plenum end walls to define the upper faces of the plenum space. The sixth/lower face of the plenum space is defined by the ceiling joists/ceiling drywall as described below.

One or more lighting fixtures may be provided in the ceiling. The light fixtures may be sealed to prevent air from flowing through the fixture. Any suitable lighting fixture may be used, with the preferred lighting fixture having a thin profile so that it can fit into the plenum space.

One or more air filters may be provided in the ceiling. The air filters are preferably HEPA filters sized and positioned to provide efficient clean air flow into the interior workspace below. The ceiling air filters may be effective to provide clean air meeting an ISO 8 standard or better, and are preferably effective for meeting an ISO 7 standard or better.

The space between the container roof and the interior ceiling forms a ceiling plenum to route air from the blower above to the air filters in the ceiling (and then to the workspace below). It is important to ensure that the ceiling plenum is sealed to air leaks so that all air to the interior workspace must pass through the air filters in the ceiling. The space between the container roof and the interior ceiling may also house ductwork for routing return air to an opening in the roof and then to the blower.

As with the ceiling and floor, clean, smooth interior walls are provided over each of the walls of the container when an intermodal shipping container is used as the module shell. All interior walls are finished to a clean appearance, and are preferably smooth to facilitate cleaning.

The interior walls may be spaced apart from the walls of the container shell, preferably using studs as are commonly used in new construction. The studs may be metal or wood, and typically provide a surface for drywall that is three to twelve inches from the container wall. The interior walls cooperate with an interior ceiling and an interior floor to define an interior workspace.

The interior walls are preferably made of drywall that is taped and finished to a smooth, clean surface. With the exception of air filter vents and air return vents described herein, all openings in and around the interior walls are preferably closed to prevent air from entering or leaving the interior work space except through the air filters and air return vents. To the extent electrical, water, or other service outlets are provided in the interior walls, those outlets are sealed to prevent uncontrolled air flow.

In one embodiment the interior walls include a first interior sidewall, a second interior sidewall, a first interior end wall, and a second interior end wall. One interior sidewall covers one of the container sidewalls, and is spaced a distance of two to twelve inches from the container sidewall. One interior sidewall covers another of the container sidewalls, and is spaced a distance of two to twelve inches from the container sidewall. One interior end wall covers the closed end wall of the container shell, and is spaced a distance of two to six inches from the container end wall. The other interior end wall covers the end of the container shell that has doors that open to allow access to the interior of the container. That interior end wall is preferable spaced a distance of six to eighteen inches from the container end wall. As described more fully below, the space between the interior end wall and the open container end wall may be used as a service compartment where electrical and other service components may reside. This allows access to the service panel without entering the interior clean space of the module.

An exterior door may be provided in one or more of the interior walls to allow entry into and out of the module. The exterior door will, of course, also pass though one or more walls of the container shell.

In addition to the four interior walls that overlay the four walls of the container shell, one or more additional interior walls may be provided to divide the interior workspace into separate work rooms or areas. For example, one or more interior walls may be provided to provide an outer room that may be used for gowning. This outer gowning room may be cleaned to an ISO 8 standard.

The same walls that define an outer room may, of course, also define an inner room. The inner work room may be designed and/or classified to the same standard as the outer room, or it may be designed and/or classified to a higher standard. For example, if the outer gowning room is designed and classified to an ISO 8 standard, the inner work room may be designed and classified to an ISO 7 standard. In other embodiments the inner room may be cleaned to an ISO 6 standard or better.

In addition, some areas of the inner work room may be provided with a hood or other device for providing air at a higher standard, for example ISO 5 air.

The interior walls that divide and define interior workspaces may be temporary walls such as are provided with a "hooded" workspace.

2. The Air Filtration and Handling System

Clean air is provided to the interior work space by an air handling system that preferably includes a blower to blow air through the system at a positive pressure, one or more filters in the blower to assist in cleaning the air, one or more filters in the ceiling to assist in cleaning the air, and a clean air plenum between the blower and the ceiling to provide clean air to the ceiling filters. Air return ducts in one or more interior walls may be used to route "dirty" air from the interior workspace back to the blower.

The air filtration equipment may be suitable to provide air cleaned to an ISO 8 standard in some portions of the module. Other portions of the module may be provided with air cleaned to an ISO 7 standard, while still other portions of the module may be provided with air cleaned to an ISO 6 standard or an ISO 5 standard. The clean air may be provided by filtering the air through filters mounted in the module ceiling (optionally referred to as "terminal" filters), with the preferred filters being high efficiency particulate air (HEPA) filters capable of meeting the appropriate standard.

As is known to the art, the ISO 8 clean air standard requires that each cubic foot of air must have no more than 100,000 particles sized greater than 0.5 μm, and no more than 700 particles sized greater than 5 μm. Similarly, the ISO 7 clean air standard requires that each cubic foot of air has no more than 10,000 particles sized greater than 0.5 μm, and no more than 70 particles sized greater than 5 μm. An ISO 6 clean air standard requires that each cubic foot of air has no more than 1,000 particles sized greater than 0.5 μm, and no more than 7 particles sized greater than 5 μm. An ISO 5 clean air standard requires that each cubic foot of air has no more than 750 particles sized greater than 0.2 μm, no more than 300 particles sized greater than 0.3 μm, and no more than 100 particles sized greater than 0.5 μm.

Converting to cubic meters, it can be seen that the ISO 8 clean air standard requires that each cubic meter of air must have no more than 3,520,000 particles sized greater than 0.5 μm, no more than 832,000 particles sized greater than 1.0 μm, and no more than 29,300 particles sized greater than 5 μm. Similarly, the ISO 7 clean air standard requires that each cubic meter of air has no more than 352,000 particles sized greater than 0.5 μm, no more than 83,200 particles sized greater than 1.0 μm, and no more than 2.930 particles sized greater than 5 μm. The ISO 6 clean air standard requires that each cubic meter of air has no more than 1,000,000 particles sized greater than 0.1 μm, no more than 237,000 particles sized greater than 0.2 μm, no more than 102,000 particles sized greater than 0.3 μm, no more than 35,200 particles sized greater than 0.5 μm, no more than 8,320 particles sized greater than 1.0 μm, and no more than 293 particles sized greater than 5 μm. The ISO 5 clean air standard requires that each cubic meter of air has no more than 100,000 particles sized greater than 0.1 μm, no more than 23,700 particles sized greater than 0.2 μm, no more than 10,200 particles sized greater than 0.3 μm, no more than 3,520 particles sized greater than 0.5 μm, no more than 832 particles sized greater than 1.0 μm, and no more than 29 particles sized greater than 5 μm.

Tables showing the ISO standards and U.S. Fed. 209E standards are shown below.

US FED STD 209E Cleanroom Standards

| | Maximum particles/ft$^3$ | | | | | ISO |
|---|---|---|---|---|---|---|
| Class | ≥0.1 μm | ≥0.2 μm | ≥0.3 μm | ≥0.5 μm | ≥5 μm | equivalent |
| 1 | 35 | 7 | 3 | 1 | | ISO 3 |
| 10 | 350 | 75 | 30 | 10 | | ISO 4 |
| 100 | | 750 | 300 | 100 | | ISO 5 |
| 1,000 | | | | 1,000 | 7 | ISO 6 |
| 10,000 | | | | 10,000 | 70 | ISO 7 |
| 100,000 | | | | 100,000 | 700 | ISO 8 |

ISO 14644-1 Cleanroom Standards

| | maximum particles/m$^3$ | | | | | | FED STD 209E |
|---|---|---|---|---|---|---|---|
| Class | ≥0.1 μm | ≥0.2 μm | ≥0.3 μm | ≥0.5 μm | ≥1 μm | ≥5 μm | equivalent |
| ISO 1 | 10 | 2 | | | | | |
| ISO 2 | 100 | 24 | 10 | 4 | | | |
| ISO 3 | 1,000 | 237 | 102 | 35 | 8 | | Class 1 |
| ISO 4 | 10,000 | 2,370 | 1,020 | 352 | 83 | | Class 10 |
| ISO 5 | 100,000 | 23,700 | 10,200 | 3,520 | 832 | 29 | Class 100 |
| ISO 6 | 1,000,000 | 237,000 | 102,000 | 35,200 | 8,320 | 293 | Class 1000 |
| ISO 7 | | | | 352,000 | 83,200 | 2,930 | Class 10,000 |
| ISO 8 | | | | 3,520,000 | 832,000 | 29,300 | Class 100,000 |
| ISO 9 | | | | 35,200,000 | 8,320,000 | 293,000 | Room air |

One or more air handling blowers may be mounted on the roof of the container shell. The air blowers are sized to provide adequate air flow into the interior work space to allow the air pressure in the workspace to be greater than the air pressure outside the workspace. Air filters may be provided in the blower to perform an initial "coarse" air purification. For example, filters effective for meeting a MERV-8 and/or a MERV-10 purification standard may be provided in the blower. (As is known to the art, the "MERV" designation refers to a Minimium Efficiency Reporting Value. MERV values are typically reported from 1 to 14, with the higher number meaning more effective filtration.) HEPA filters within the blower may also be included in addition to or as an alternative to the MERV filter to provide additional "coarse" filtration of the air.

In some embodiments, including where multiple workspaces are provided (e.g., a gowning workspace and a working workspace), the air handling system may be "balanced" or otherwise configured to provide greater air pressure in one workspace than in another space. For example, when an outer gowning room having an ISO 8 rating is provided adjacent to an inner workspace having an ISO 7 rating, the air pressure in the ISO 7 space may be greater than the air pressure in the ISO 8 space to prevent "less-clean" ISO 8 air from entering the "more-clean" ISO 7 workspace. This is typically accomplished by controlling the dampers in the return air ducts to allow greater air flow through some return air ducts than others.

In one embodiment the module is provided with automated damper controls. The dampers are typically installed in each return air duct trunk line, and motors are mounted just outside the duct and behind the drywall. The motor may be wired to a PLC and may be controlled by a computer screen (also know as a human machine interface). This allows automatic adjustment of the dampers, and eliminates the need to adjust the dampers manually. This makes testing and balancing more efficient.

In one preferred embodiment the air handling system is balanced to provide the ISO 8 workspace with a positive air pressure of at least 0.05" of water column when compared to the pressure of the outside air. Similarly, the ISO 7 workspace is preferably provided with a positive air pressure of at least 0.05" of water column when compared to the pressure of the adjacent ISO 8 workspace. The dampers in the return air ducts of the ISO 7 workspace may be less "open" than the dampers of the ISO 8 workspace to achieve that increased air pressure in the ISO 7 workspace.

The air cleaning provided by the filters in the ceiling and in the blower(s) may be supplemented by air cleaning in a clean air hood. In one embodiment an ISO 5 workspace is provided in the module by including in the ISO 7 workspace a laminar flow hood providing air filtered to an ISO 5 classification.

The air filtration system is designed and constructed to effectively clean all the air in the facility. Typically, the air filtration system moves enough air to provide at least 25 air changes per hour, with at least about 45 air changes an hour being more preferred.

In one embodiment cooling and air handling system components are designed such that the cooling of the air will occur in the air handing unit. The allows better mixing of the cool air and therefore more uniform cooling in the production area. Also, there will be no penetration of the clean room envelop with the refrigerant piping or condensate piping to and from the condensing unit.

3. Multiple Module Facilities

The cleanroom modules described above are scalable so that two or more units may be connected together to provide a larger workspace. For example, two modules may be connected to provide the ISO 8/ISO 7/ISO 5 cascade described above being provided by one module, and an additional ISO 8 work space being provided by another module attached to the main ISO 7 workspace. In other embodiments three or more modules are combined to form even larger workspaces.

In one embodiment the first module is substantially as described above, but an opening is cut into one sidewall so allow connection to a second module. The second module is also substantially described above, being made from a metal shipping container and having an interior floor, an interior ceiling, and interior walls. The interior ceiling of the second module is dropped about seven inches below the roof of the container and finished to provide a ceiling plenum as previously described.

When multiple modules are used the opening cut into the sides is sized to allow easy passage from one module to another. The opening is preferably about 12 feet wide, although a wider or narrower opening may be provided if desired. The opening preferably begins at floor level, and extends upward a distance of about seven feet from the floor, as is common for a doorway. The opening is sized and positioned to facilitate easy passage from one module to the other, particularly while carrying or rolling materials for biotech research or production.

The opening may include a module connector that is separate and distinct from either of the two module containers, although the module connector may be fixedly attached to one or both containers. The module connector preferably provides a smooth, "seamless" transition between the two modules, maintaining the level of elegance that is expected and desired for biotech and/or pharmaceutical facilities. It is understood that the transition need not be literally "seamless," and there will likely be one or more small seams where the connection assembly attaches to each module. For this disclosure, the term "seamless transition" means a transition that is smooth and cleanable and provides a figuratively "seamless" look consistent with the elegance expected of pharmaceutical and/or biotech facilities.

The module connection assembly additionally is effective for maintaining the cleanroom performance in the transition space. For example, where the space in each of the connected modules is ISO 8 cleanspace, the transition space should also be ISO 8. Accordingly, the transition space contained within the connection assembly is airtight and watertight with respect to the outside environment, and reflects and extends the cleanroom conditions of the modules being connected.

In one embodiment the module connection assembly comprises a pair of connector frames that are fastened together, such as with bolts. Each connector frame may include an end angle that is connectable to the container wall or floor, and a box-shaped portion that extends from the end angle to provide a surface for attachment with bolts or other removable connectors. In one embodiment the box-shaped portion includes a first wall that is also one leg of the end angle, a second wall extending at an angle of about 90° from the first wall portion, a third wall extending at an angle of about 90° from the second wall portion, and a fourth wall extending at an angle of about 90° from the third wall portion. Holes for receiving bolts may be provided in one of the walls, and are preferably included in the third wall. The end angle portion of each connector frame may be welded to the module/container side so that the box-shaped portion extends out from the module. When two modules are placed side-by-side so that the connector frames are immediately adjacent each other, the walls having holes for bolts face each other and the bolt homes are aligned so that bolts may pass through the two connector frames to connect the two modules together. The gap between adjacent pieces may be very small (the two pieces may touch) or it may be up to an inch or more. The two modules may then be connected using bolts or some other method of connection. A finishing trim piece may then be placed over the portions of the connector frames that extend between the two modules to provide a smooth, finished look to the module connector.

When two or more modules are used, one module may provide the ISO 8 gowning room and the ISO 7 and ISO 6 workspaces. A second module may provide additional ISO 8 and/or ISO 7 workspace, or other workspace as desired.

The second module preferably is accessed through the passageway between the modules. An exterior door may be provided in the second module to allow workers to exit the second module directly.

4. Method of Use

The mobile, modular cleanroom facilities of the present invention provide significant benefits when used according to preferred methods of use. In one embodiment, the modules are built to meet a customer's specific needs, including the ability to provide clean air meeting a desired cleanroom classification. For example, a module may be built to provide one or more workspaces meeting U.S.F.D.A. good manufacturing practice (GMP) standards for pharmaceutical or biotech research or production, as defined by 21 CFR 210 and 211. Additionally or alternatively, the interior walls, ceiling and floor may be designed and constructed so as to be consistent with the standards and guidelines of the International Society of Pharmaceutical Engineers (ISPE). Appropriate standards and guidelines are described by ISPE "Pharmaceutical Engineering Guides for New and Renovated Facilities," including particularly Vol. 3—Sterile Manufacturing Facilities, the entire contents of which are hereby incorporated herein by reference.

Once a module or group of modules has been designed for a specific purpose, each module is pre-assembled to meet the performance criteria. The interior walls, ceiling and floor are provided and are finished to the smooth, cleanroom appearance appropriate for a biotech or similar facility. In the context of this disclosure, "pre-assembled" means that all structural elements (e.g., the interior and exterior walls, the roof and interior ceiling, and the subfloor and floor) are assembled and finished to the appropriate standard. The ductwork for the air filtration and handling system is finished, including the ceiling plenum and air return ducts. While certain elements such as a rooftop blower may not be installed, the locations for those components are defined and are ready for component connection. The interior electrical wiring is complete. The appropriate windows and doors are installed.

The module(s) may also be verified to be in compliance with a desired cleanroom standard. This may include balancing the airflow in the module(s) to provide the air pressure appropriate to an ISO 8-ISO 7-ISO 5 cascade or cleanroom workspaces. For example, the airflow into the ISO 7 workspace may be sufficient to maintain a pressure differential of at least 0.05" water column relative to an adjacent ISO 8 space. Similarly, the airflow into an ISO 8 space may be sufficient to maintain a pressure differential of at least 0.05" water column relative to an adjacent non-classified space.

The module may then be certified as being in compliance with a desired standard or classification. Testing for particulate concentration and air pressure may be performed by an independent and certified technician who verifies and certifies that the module meets a desired standard.

The module(s) are transported to the customer's site, with the modules being transported in their pre-assembled form. As indicated above, certain components such as the rooftop blower, air conditioning compressor, rooftop guard rails, and interior sliding glass doors do not need to be installed during transport for the transport to be of a "pre-assembled" module, but all basic, structural components are in place. Similarly, technical instruments, laminar flow hoods, etc., do not need to be installed before transport for the transport to be of a "pre-assembled" modules. The uninstalled elements may be readily assembled and/or installed at the customer's site.

In some embodiments the facility is certified as being compliant with a desired cleanroom standard after the facility has been moved to the end use location.

The module(s) may be provided to a customer as a "turn key" facility that has been designed, built and tested to confirm compliance with GMP or other standards. The customer needs only inform the module provider as to the needs, and the module provider builds and tests the module (s) to satisfy those needs.

In one embodiment the modules are purchased by the end user. In another embodiment the modules may be leased to an end user. This may reduce the cost to an end user who has a limited budget or needs the facility for a relatively short period of time (e.g., less than three years).

5. Reference to the Drawings

To further describe various aspects of the present invention, reference will now be made to the embodiments shown in the drawings.

FIG. 1 is a perspective view FIG. 1 is a perspective view of one multi-module embodiment of the mobile, modular cleanroom facility of the present invention. The multi-module embodiment includes first module 1, second module 2, door 3, windows 4, and railing 5 on the top of the modules. Blowers 6 include a supply duct 6*a* and a return duct 6*b*, and a filter mix box 6*c* to provide make-up air for the air handling system. Dry cooler 7*a* and water:water heat pump 7*b* are also mounted on the roof or each of the two modules.

Figure 2:
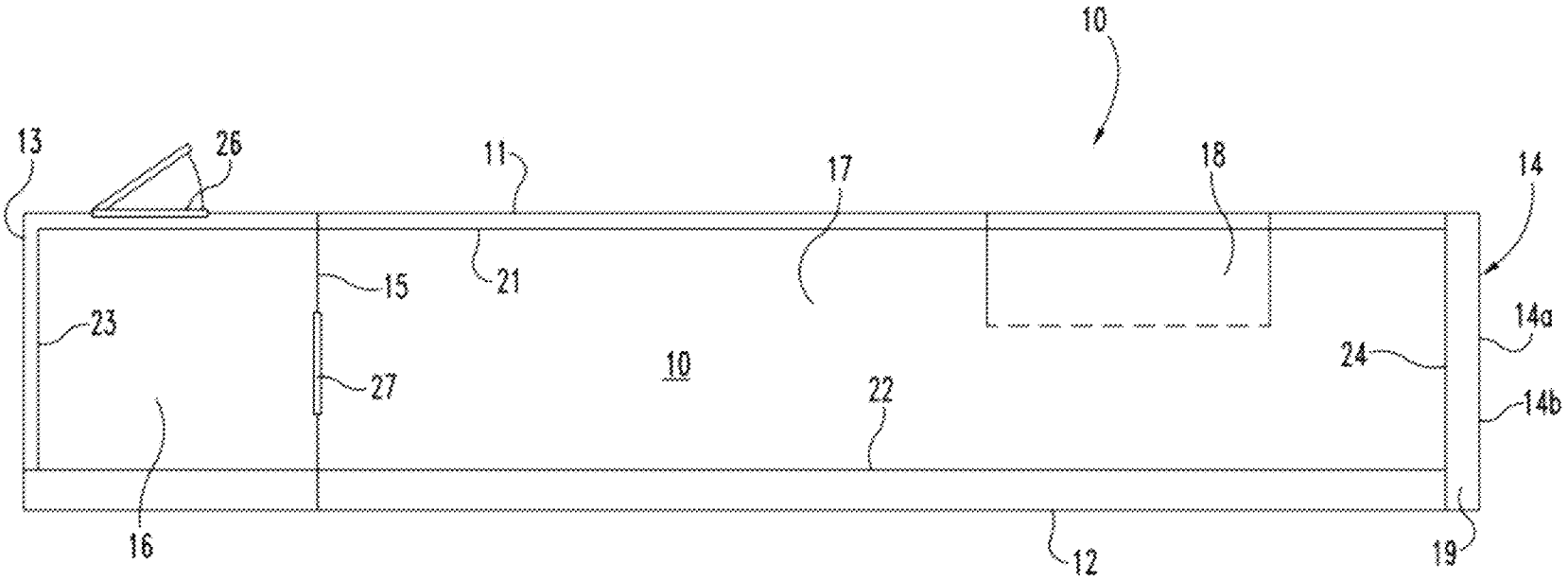
FIG. 2 is atop plan section view of one single-module embodiment of the mobile, modular cleanroom facility of the present invention.

FIG. 2 is a top plan view, in section, of a mobile modular cleanroom facility according to one embodiment of the present invention. Module 10 comprises a metal shipping container that includes sidewall 11, sidewall 12, closed end wall 13, and openable end wall 14. A container bottom and a container roof are present but are not illustrated and/or called out in the drawing. Openable end wall 14 includes a first portion 14*a* that opens like a first door to provide access to the interior of the container, and a second portion 14*b* that opens like a second door.

An interior wall 15 defines a gowning room 16 and a main workroom 17. A hooded work space 18 is included in main workroom 17. A utility closet 19 resides at one end of the module. Door 27 is included in interior wall 15 to allow passage from gowning room 16 to main workroom 17.

The inside of module 10 is finished with interior sidewalls 21 and 22, and interior end walls 23 and 24. (An interior floor and an interior ceiling are also included, and are shown in other Figures.) The interior walls are finished to a clean appearance, and are smooth to facilitate cleaning.

Gowning room 16 is provided with clean air to the ISO-8 standard. Main workroom 17 is provided with ISO 7 air. Hooded workspace 18 is provided with ISO 5 clean air.

Figure 3:
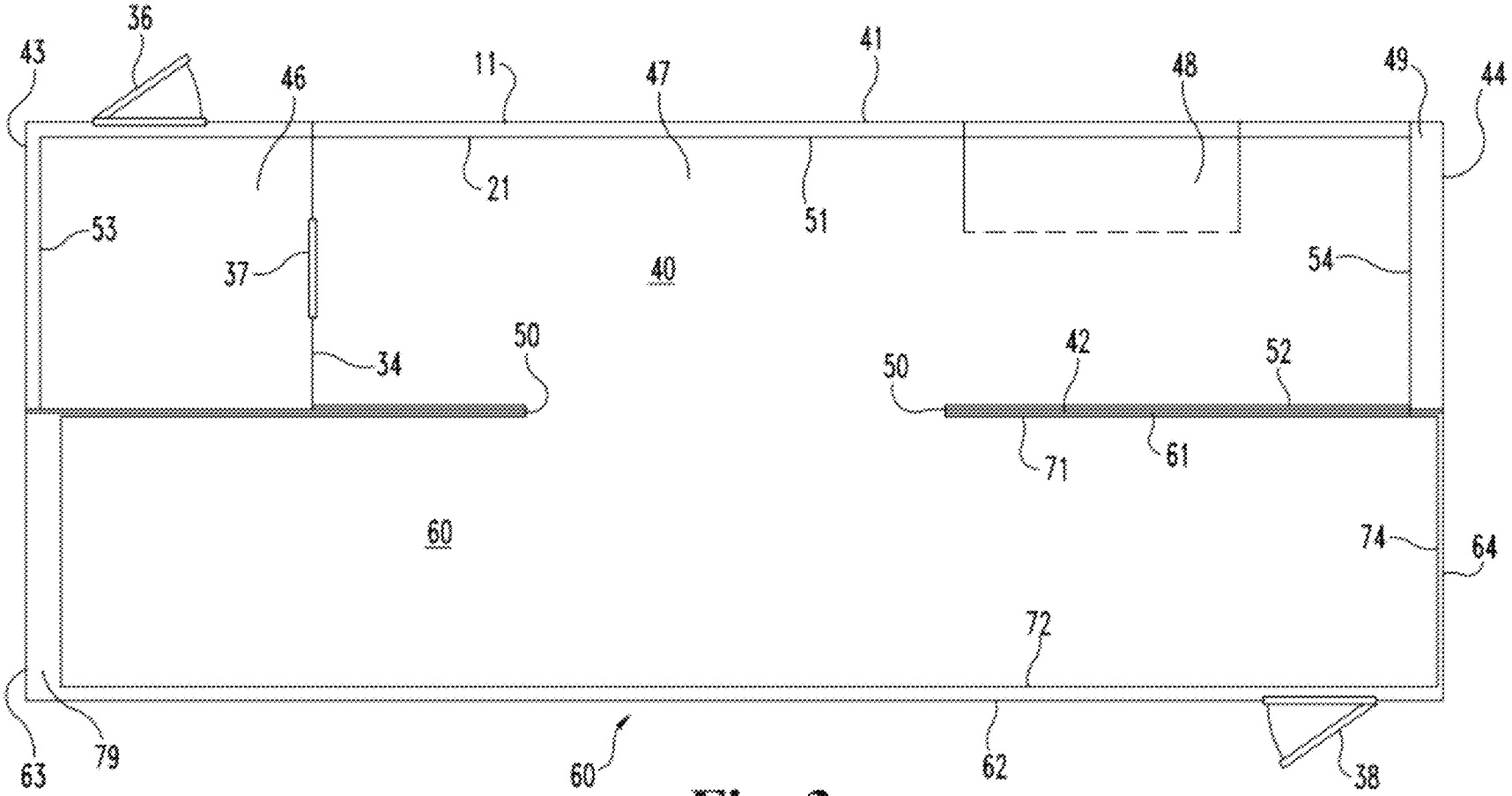
FIG. 3 is a top plan section view of a two-module mobile cleanroom facility according to one preferred embodiment of the present invention.

FIG. 3 shows a top plan view, in section, of a mobile modular cleanroom facility according to one "two-module" embodiment of the present invention. First module 30 comprises a first metal shipping container that includes sidewall 41, sidewall 42, closed end wall 43, and openable end wall 44. A container bottom and a container roof are present but are not illustrated and/or called out in the drawing. Openable end wall 44 includes a first portion 44*a* that opens like a first door to provide access to the interior of the container, and a second portion 44*b* that opens like a second door.

An interior wall 34 defines a gowning room 46 and a main workroom 47. A hooded work space 48 is included in main workroom 47. A utility closet 49 resides at one end of the module. Door 37 is included in interior wall 34 to allow passage from gowning room 46 to main workroom 47.

The inside of module 30 is finished with interior sidewalls 51 and 52, and interior end walls 53 and 54. (An interior floor and an interior ceiling are also included, and are shown in other Figures.) The interior walls are finished to a clean appearance, and are smooth to facilitate cleaning.

Gowning room 46 is provided with clean air to the ISO-8 standard. Main workroom 47 is provided with ISO 7 air. Hooded workspace 48 is provided with ISO 5 clean air.

Second module 60 also comprises a first metal shipping container that includes sidewall 61, sidewall 62, closed end wall 63, and openable end wall 64. A container bottom and a container roof are present but are not illustrated and/or called out in the drawing. Openable end wall 64 includes a first portion 64*a* that opens like a first door to provide access to the interior of the container, and a second portion 64*b* that opens like a second door. A utility closet 79 resides at one end of the module.

The inside of module 60 is finished with interior sidewalls 71 and 72, and interior end walls 73 and 74. (An interior floor and an interior ceiling are also included, and are shown in other Figures.) The interior walls are finished to a clean appearance, and are smooth to facilitate cleaning.

An exterior door 38 allows entry or exit from module 60. Most preferably, door 38 is used for exit only, with entry into the workspace being through gowning room 46 and workspace 40.

The interior workspace of module 60 is provided with clean air to the ISO-8 standard.

Figure 4:
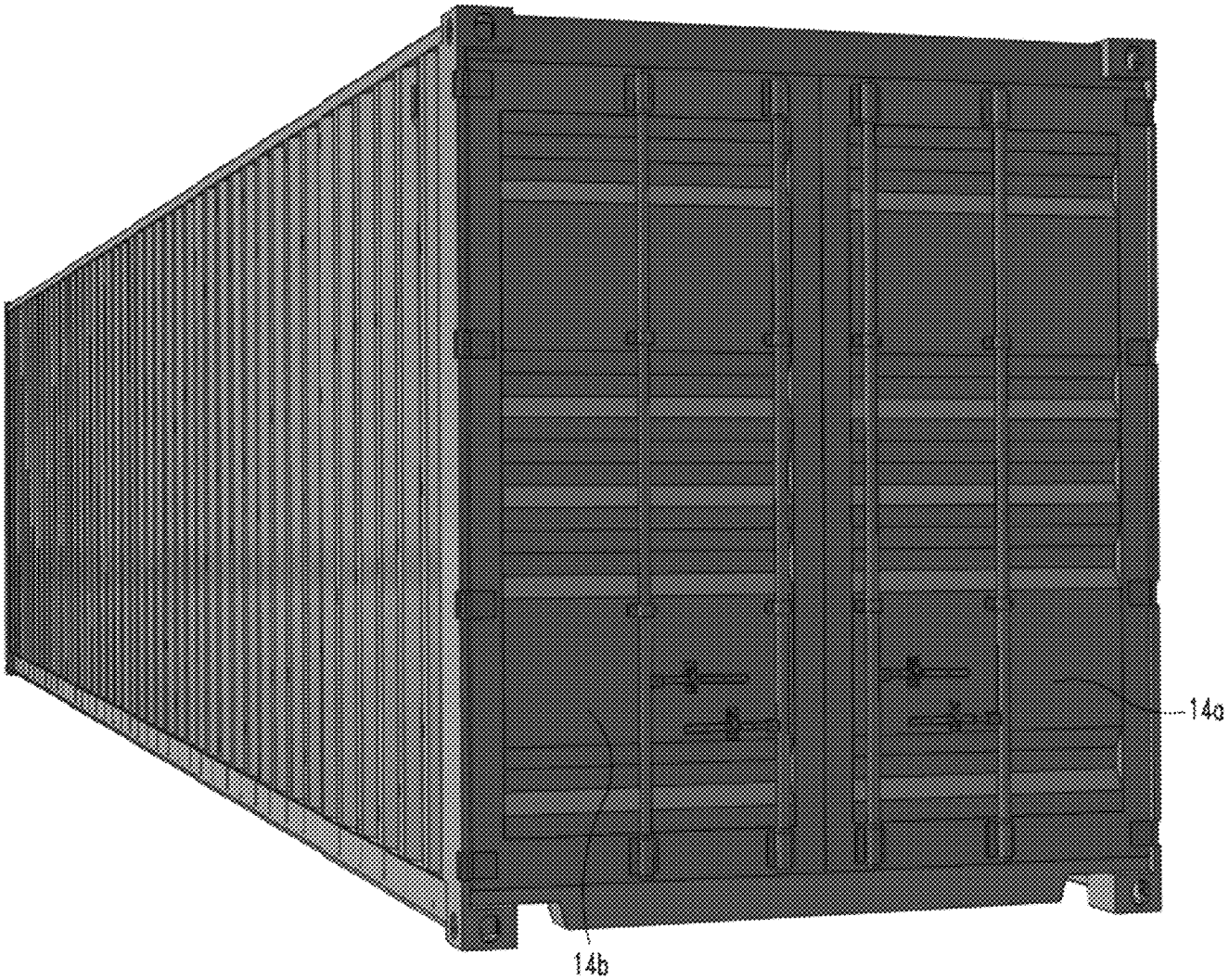
FIG. 4 is a perspective view of a shipping container appropriate for use as a mobile, modular cleanroom facility according to one embodiment of the present invention.

FIG. 4 shows a metal shipping container that may be used to construct the mobile, modular cleanroom facilities of the present invention. Metal shipping container 80 includes side walls 81 and an openable end 82 with two end doors 14*a* and 14*b*.

Figure 5:
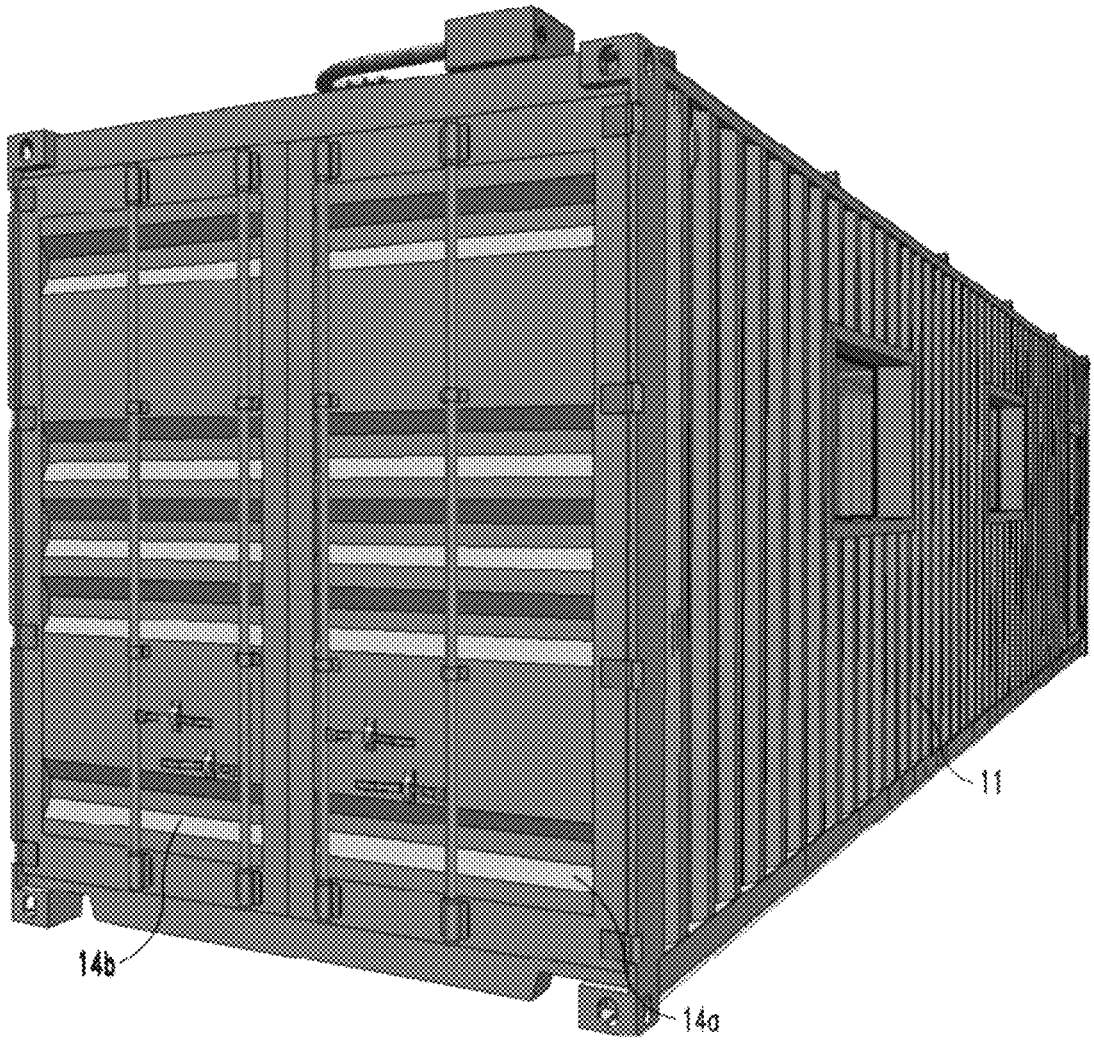
FIG. 5 is an end perspective view of a shipping container as it is being converted to a mobile, modular cleanroom facility according to one embodiment of the present invention.

FIG. 5 shows a metal shipping container that has been used to construct a mobile, modular cleanroom facility according to the present invention. Metal shipping container 90 includes side walls 11 and an openable end with two end doors 14*a* and 14*b*. Windows are included in sidewall 11.

Figure 6:
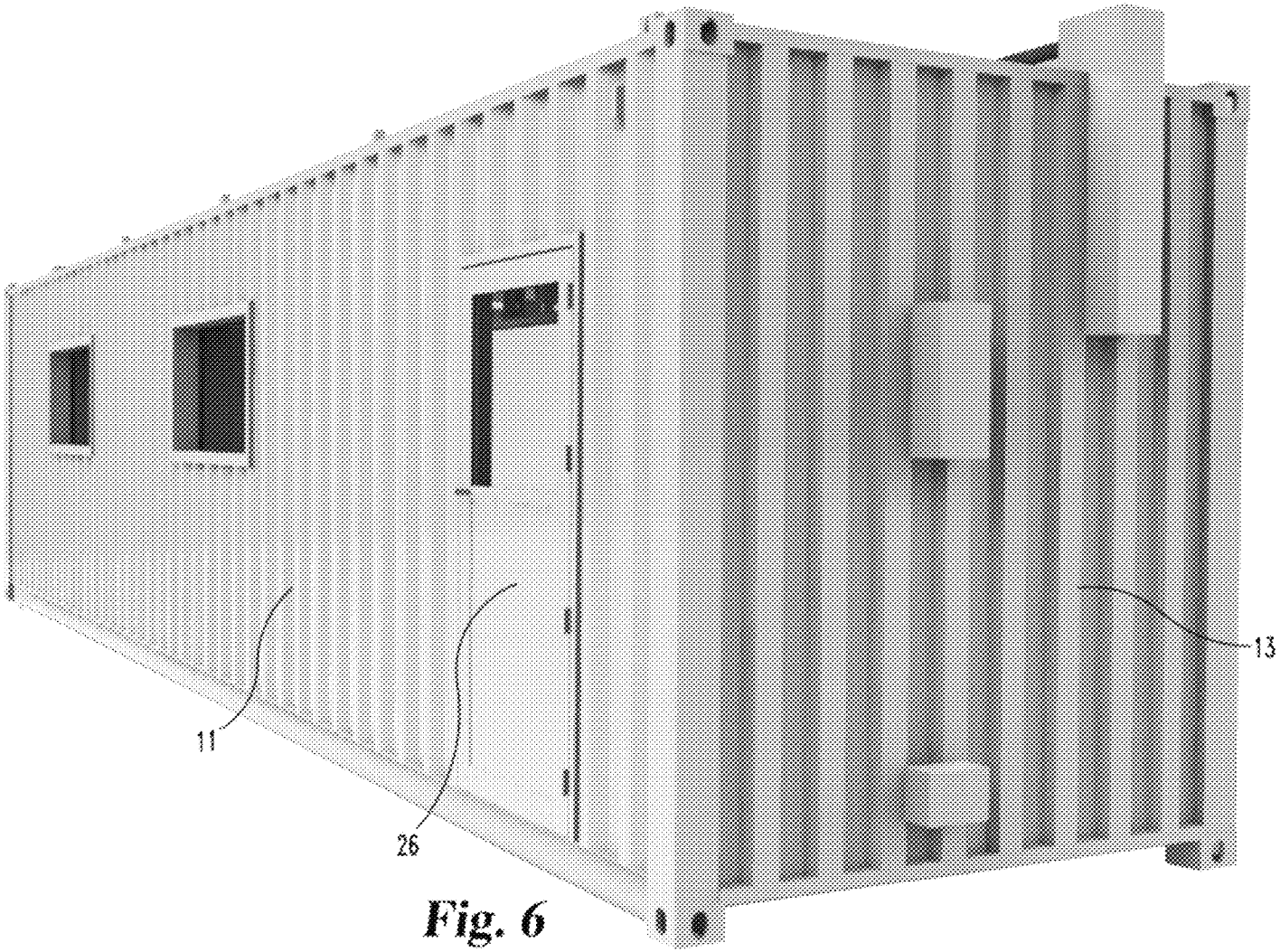
FIG. 6 is another perspective view of a shipping container as it is being converted to a mobile, modular cleanroom facility according to one embodiment of the present invention.

FIG. 6 is another view of a metal shipping container that has been used to construct a mobile, modular cleanroom facility according to the present invention. In this view, closed end 13 is shown, as is exterior door 26.

Figure 7:
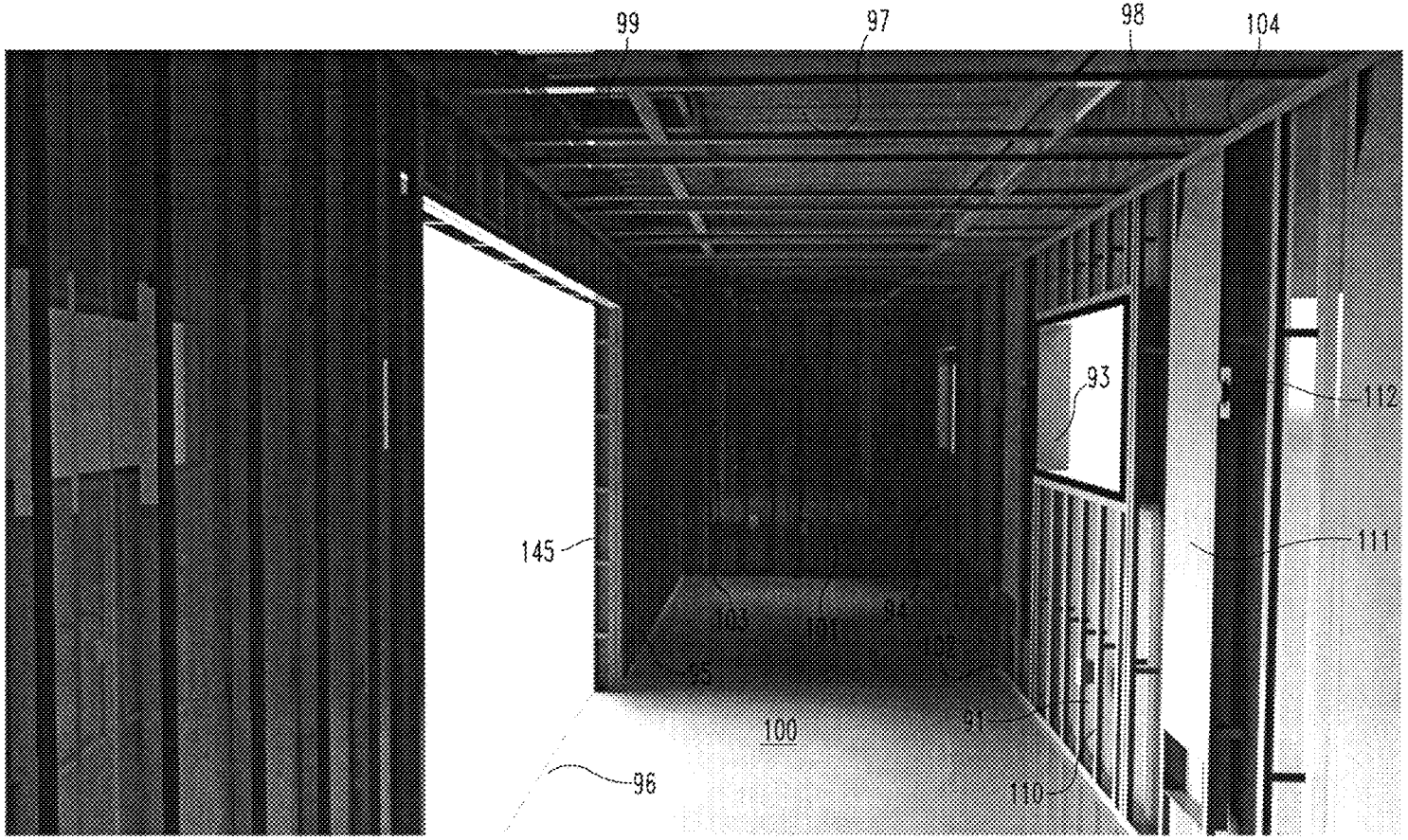
FIG. 7 is an interior view of a shipping container as it is being converted to a mobile, modular cleanroom facility according to one embodiment of the present invention.

FIG. 7 shows the interior of a metal shipping container as it is being transformed into a mobile, modular cleanroom facility according to the present invention. Side wall 91 includes window 93 and exterior door 94. Side wall 95 is provided with a module connector 145, including finish trim 96. Container roof 97 and the supports 98 for the interior ceiling are also shown, as is an opening 99 for access to a roof-mounted blower. Interior floor 100 is also indicated. Closed end wall 101 is provided near exterior door 94.

Wall studs 110 are provided to allow placement of the interior walls a distance of one to three inches (preferably about 1.5 inches) from sidewall 95, and a distance of three to eight inches (preferably about 5.5 inches) from sidewall 91. The studs may be supported by angle irons 104 running parallel to the container sidewall along the floor, and by angle irons 106 running parallel to the container sidewall along the ceiling. Similarly, the studs may be supported by angle irons 105 running parallel to the container end wall along the floor, and by angle irons 107 running parallel to the container end wall along the ceiling.

Air return ducts 111 are located in the space between sidewall 91 and the interior wall adjacent to that sidewall. Damper controls 112 are located adjacent air returns 111.

Figure 8:
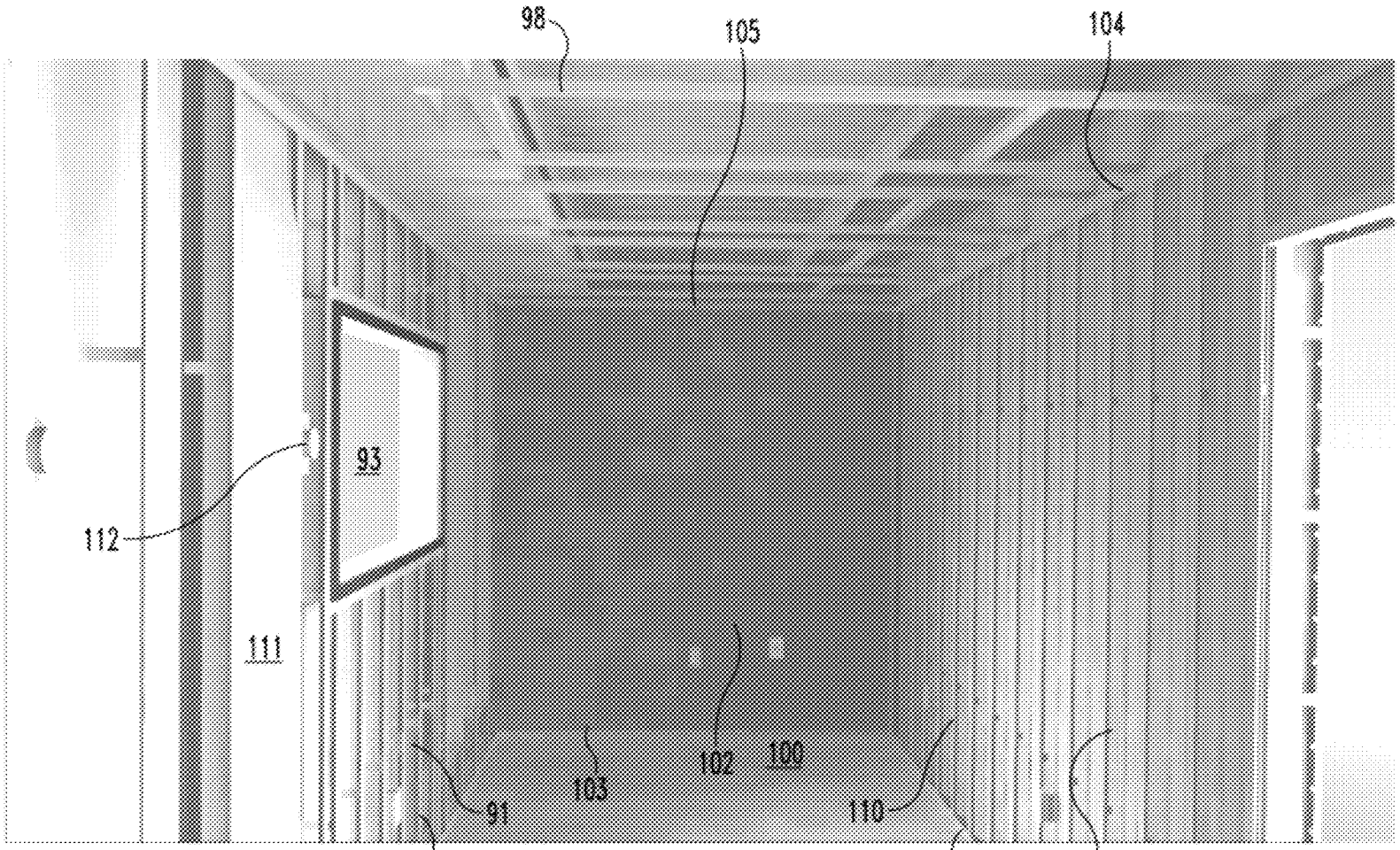
FIG. 8 is another interior view of a shipping container as it is being converted to a mobile, modular cleanroom facility according to one embodiment of the present invention.

FIG. 8 shows another view of a metal shipping container as it is being transformed into a mobile, modular cleanroom facility. Sidewalls 91 and 95 and end wall 102 are shown. Angle irons 104 run parallel to the container sidewall along the floor, and angle irons 106 run parallel to the container sidewall along the ceiling. Angle iron 105 runs parallel to the container end wall along the floor, and angle iron 107 runs parallel to the container end wall along the ceiling. Studs 110 are supported by the angle irons.

Figure 9:
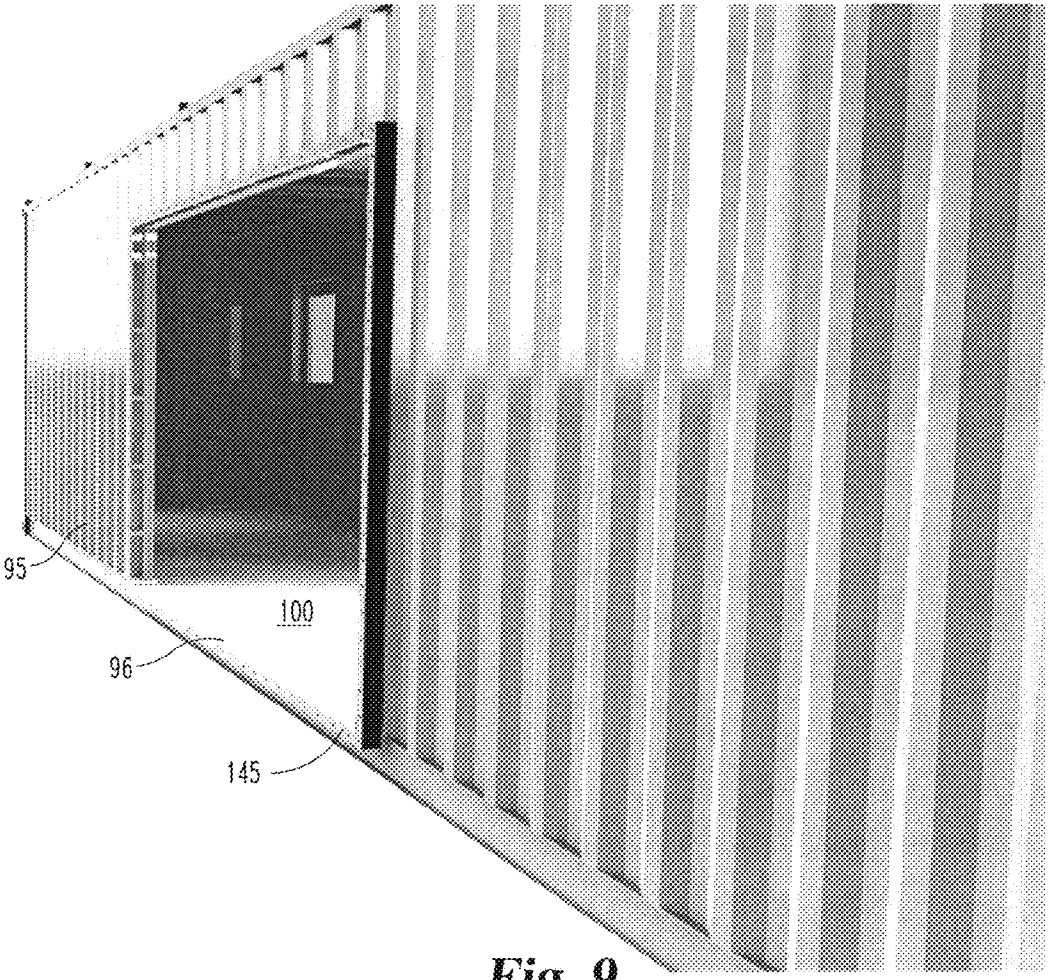
FIG. 9 is an exterior view of a shipping container as it is being converted to a multi-module embodiment of the mobile, modular cleanroom facility according to one embodiment of the present invention.

FIG. 9 shows another view of a metal shipping container as it is being transformed into a mobile, modular cleanroom facility. Side wall 95 includes module connector 145 for connecting two modules together to form a larger workspace. Finish trim 96 covers one portion of the connector frame.

Figure 10:
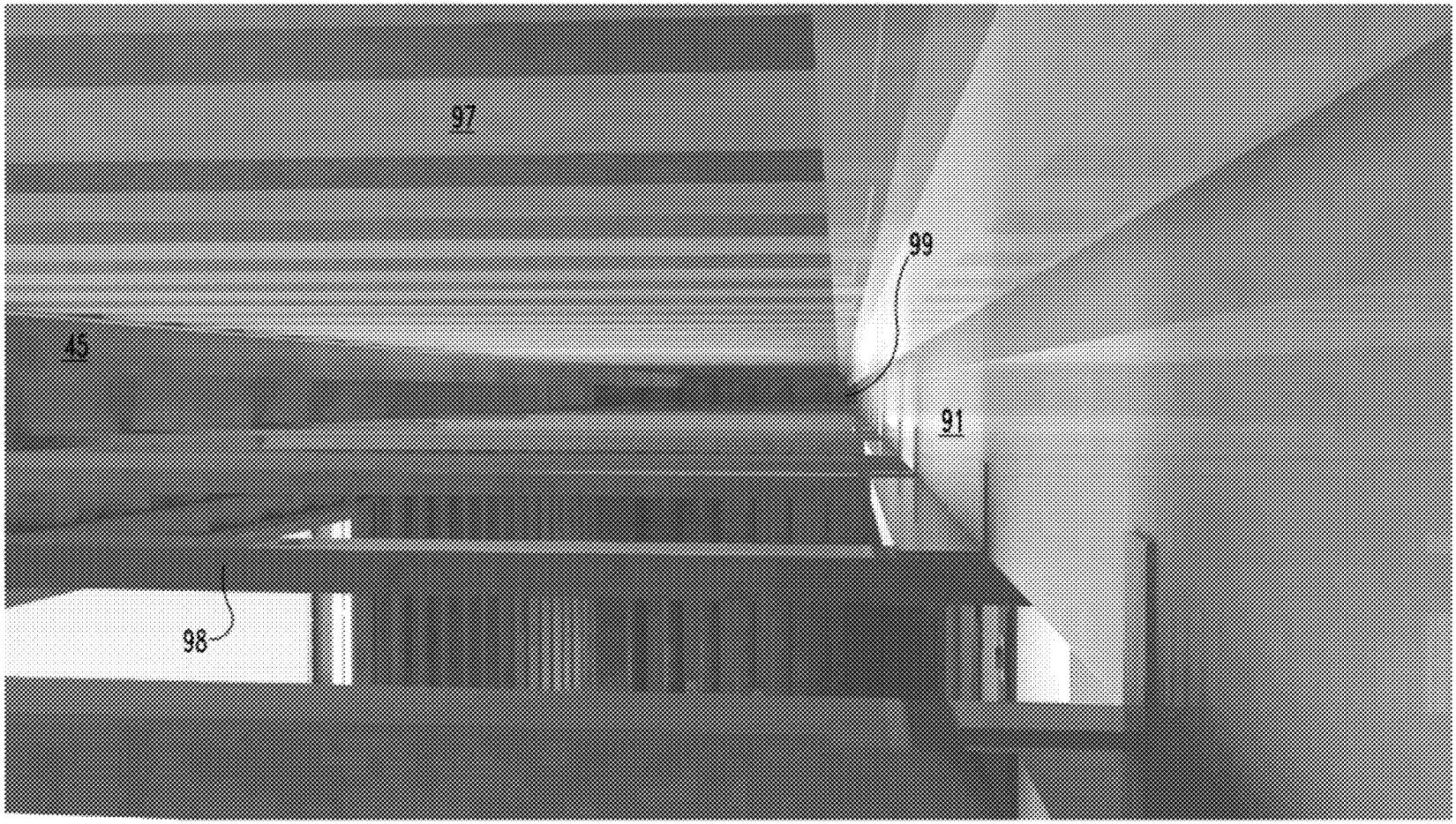
FIG. 10 is an interior view of the space below the container roof as a ceiling plenum is being constructed in a mobile, modular cleanroom facility according to one embodiment of the present invention.

FIG. 10 shows one embodiment of a ceiling plenum as it is being constructed. Container roof 97 serves as the upper, horizontal "wall" of the ceiling plenum, with sidewall 91 and sidewall 95 forming two of the vertical plenum "walls." End walls 101 and 102 serve as the other two vertical "walls" of the ceiling plenum. The bottom horizontal "wall" is provided by the interior ceiling which is supported by ceiling supports 98. Ceiling supports 98 are positioned a distance of about 12 inches below the container roof.

Opening 99 provides a passage from the blower (located on the container roof) to the ceiling plenum, thus allowing air to be blown into the plenum.

Figure 11:
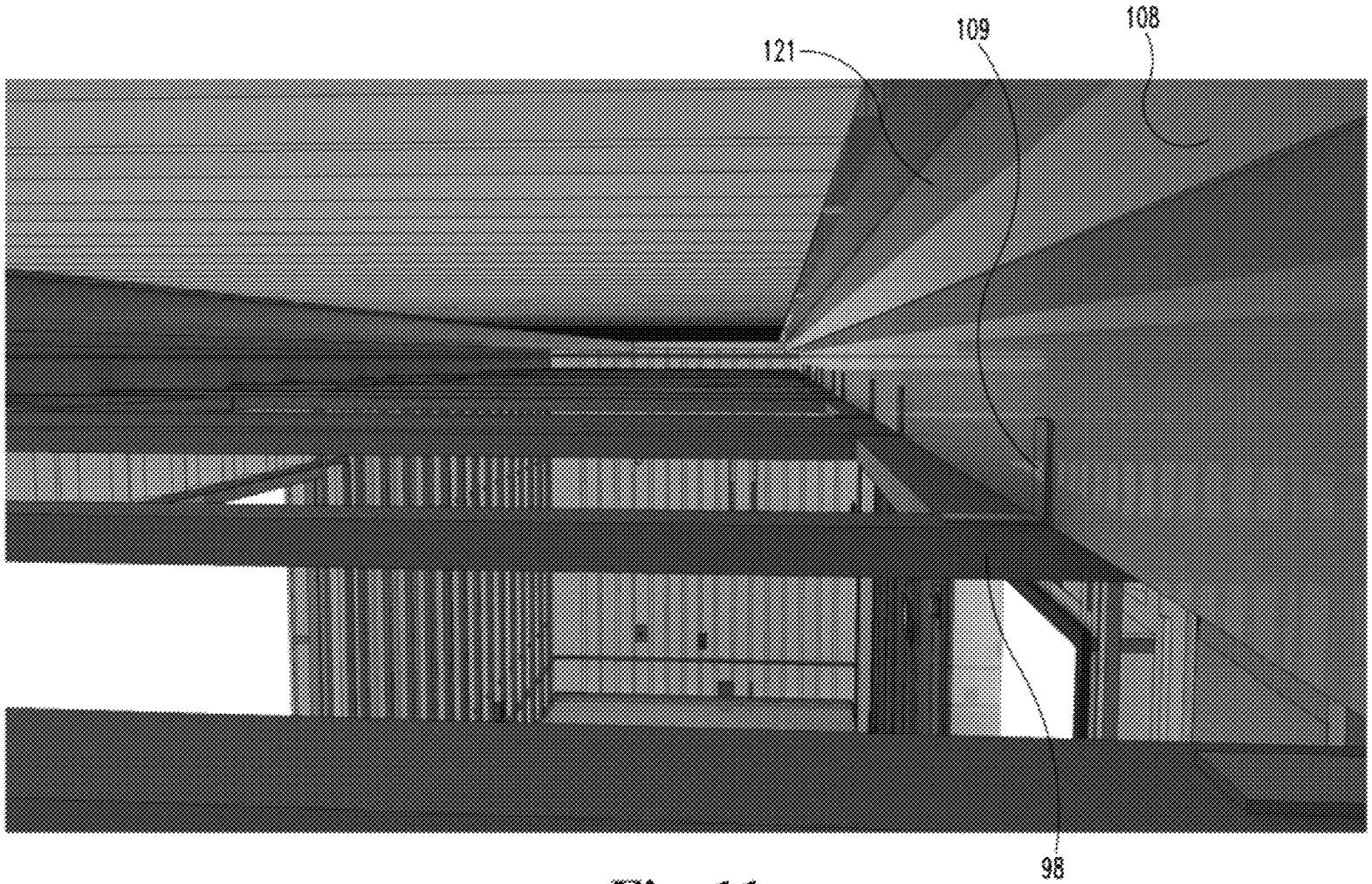
FIG. 11 is another view of the space below the container roof as a ceiling plenum is being constructed in a mobile, modular cleanroom facility according to one embodiment of the present invention.

FIG. 11 is another view of the space below the container roof as a ceiling plenum is being constructed in a mobile, modular cleanroom facility according to one embodiment of the present invention. Roof 97 is supported by container side roof rail 121. Ceiling supports 98 are supported by ceiling angle iron 109. A sealing material 108 is provided to seal gaps that might otherwise allow air to enter or exit the ceiling plenum without passing through the ceiling filters.

Figure 12:
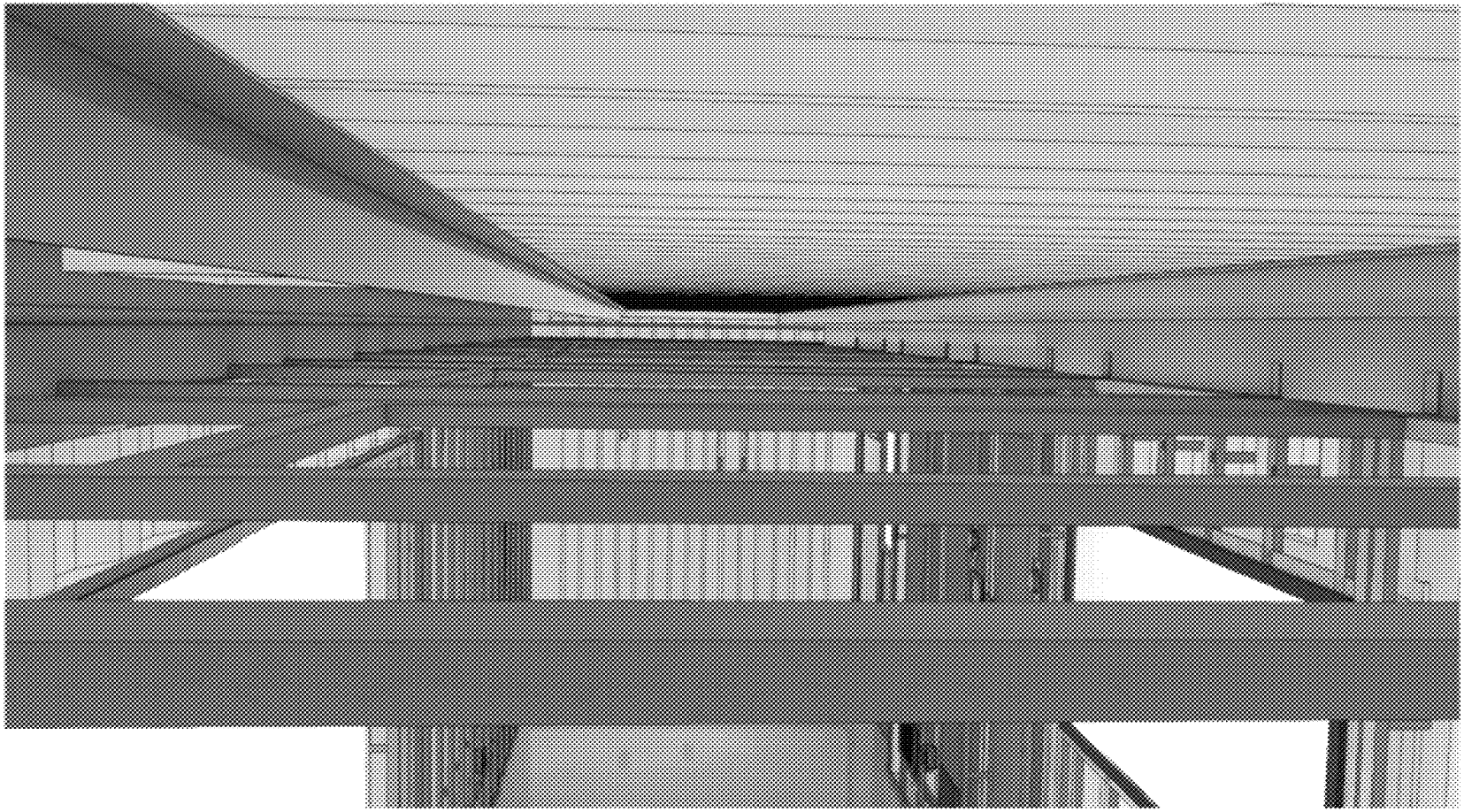
FIG. 12 is another view of the space below the container roof as a ceiling plenum is being constructed in a mobile, modular cleanroom facility according to one embodiment of the present invention.

FIG. 12 is another view of the space below the container roof as a ceiling plenum is being constructed in a mobile, modular cleanroom facility according to one embodiment of the present invention.

Figure 13:
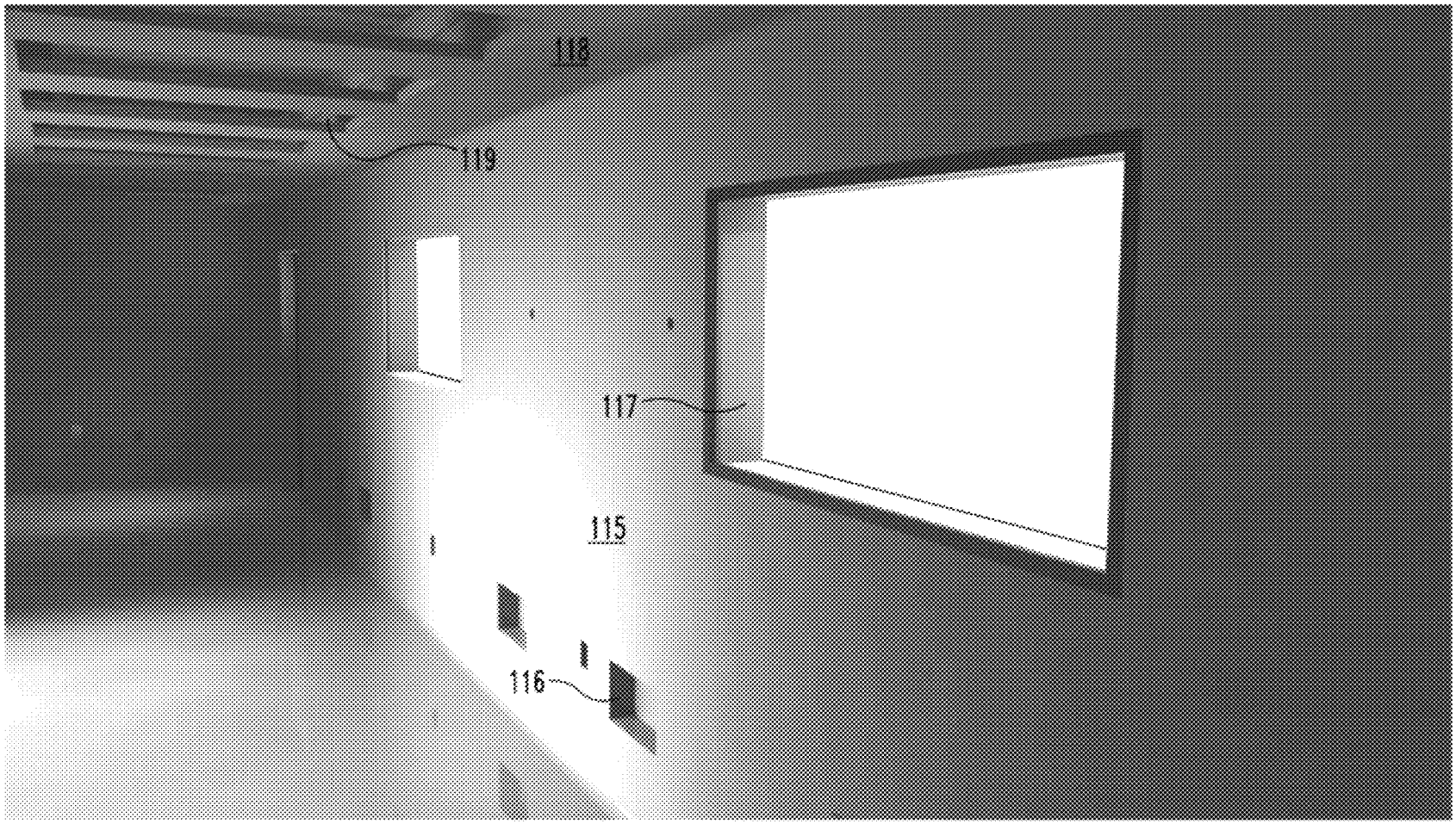
FIG. 13 is a view of an interior wall as it is being constructed in a mobile, modular cleanroom facility according to one embodiment of the present invention.

FIG. 13 is a view of an interior wall as it is being constructed in a mobile, modular cleanroom facility according to one embodiment of the present invention. Interior wall 115 has cut-outs for air return ducts 116 and windows 117. Ceiling 118 includes cut-outs 119 for air filters and light fixtures.

Figure 14:
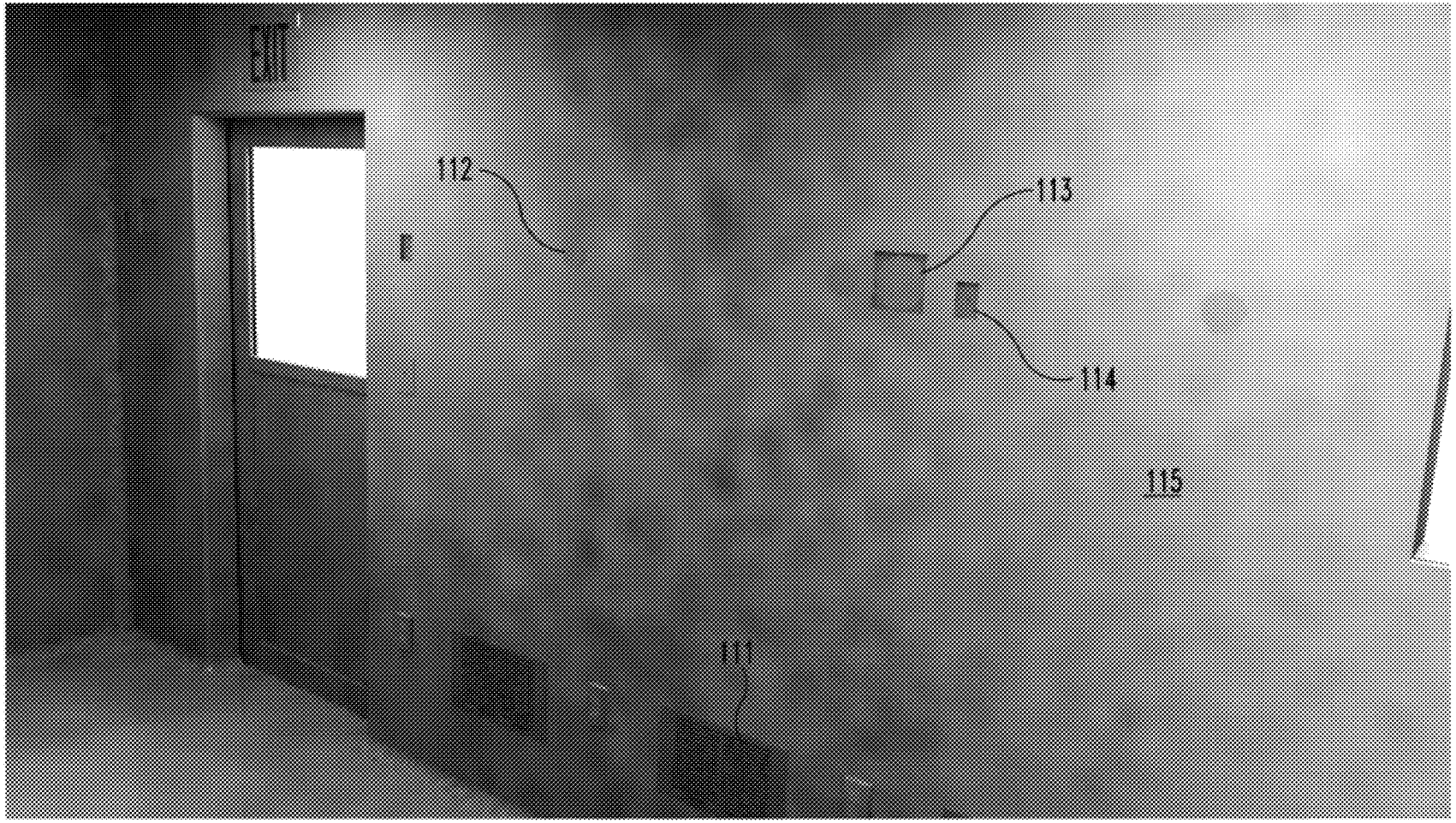
FIG. 14 is a view of a finished interior wall in a mobile, modular cleanroom facility according to one embodiment of the present invention.

FIG. 14 is a view of a finished interior wall in a mobile, modular cleanroom facility according to one embodiment of the present invention. Side wall 115 includes air return ducts 111 and air return controls 112 for controlling the flow of air through the returns. Air pressure gauge 113 displays the air pressure that is read by pressure tubes 114.

Figure 15:
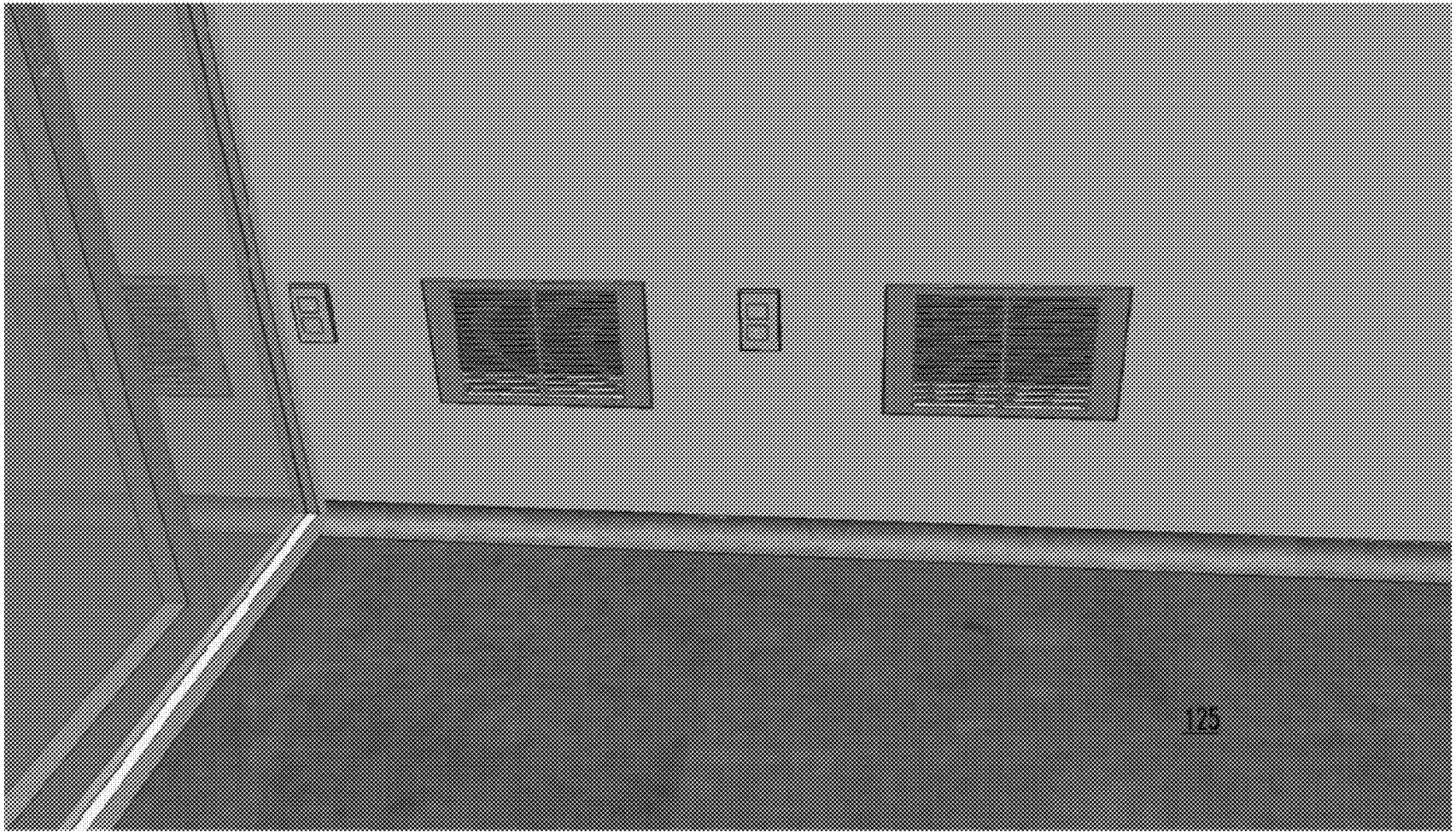
FIG. 15 is a view of a finished interior wall and its interface with the floor in a mobile, modular cleanroom facility according to one embodiment of the present invention.

FIG. 15 is a view of a finished interior wall and its interface with the floor in a mobile, modular cleanroom facility according to one embodiment of the present invention. It can be seen from the figure that the interface between the interior walls 115 and the interior floor 125 is coved (i.e., the "corner" between the floor and the wall is curved and is not a sharp angle) and splayed (i.e., the flooring material extends partway up the wall) to eliminate corners that may hold dust or other contaminants.

Figure 16:
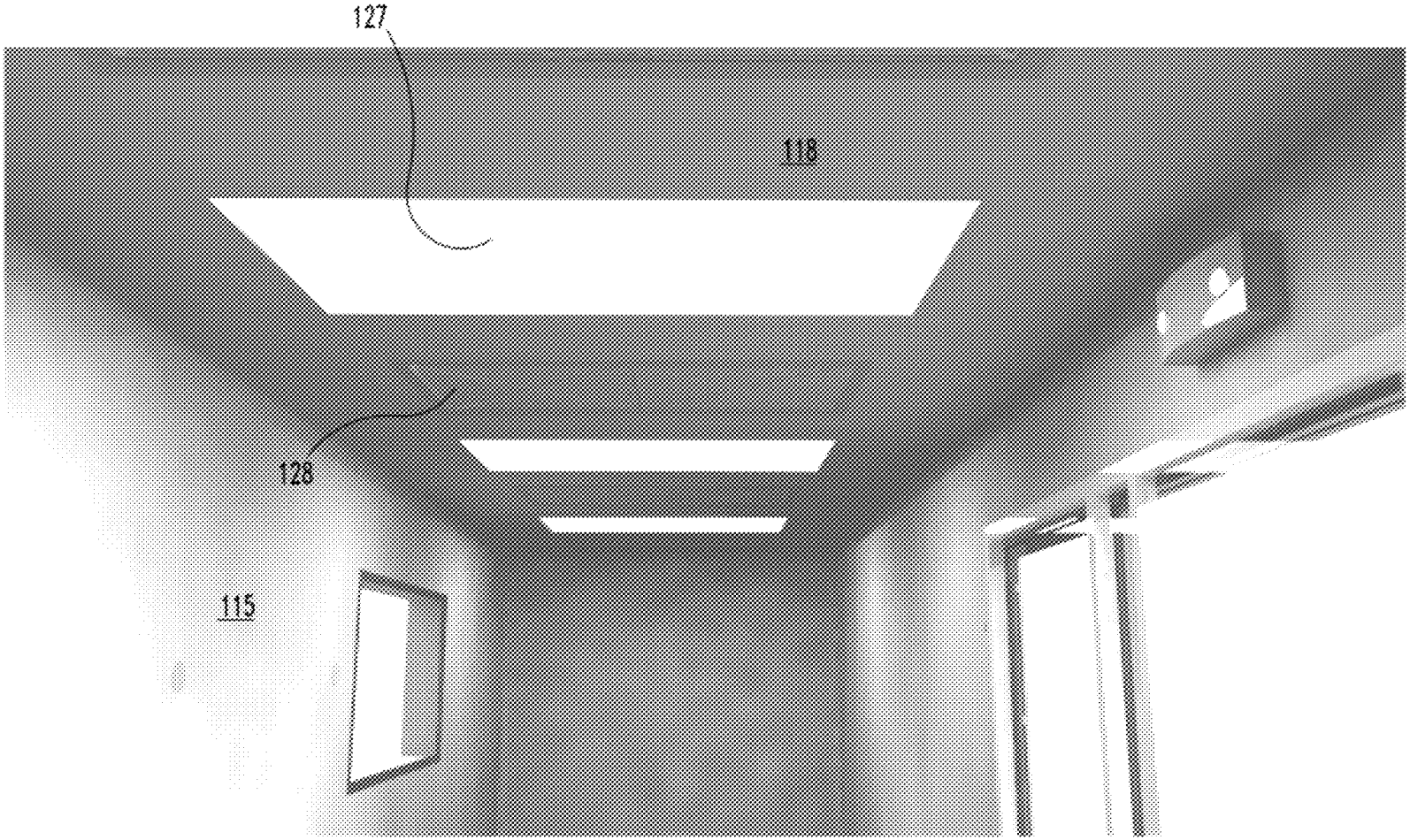
FIG. 16 is a view of a ceiling in a mobile, modular cleanroom facility according to one embodiment of the present invention.

FIG. 16 is a view of a ceiling in a mobile, modular cleanroom facility according to one embodiment of the present invention. Ceiling 118 includes spaces for light fixtures 127 and ceiling filters 128. Light fixtures 127 are closed to prevent air from passing through the fixtures. The only path for air to pass from the ceiling plenum into the workroom is through ceiling filters 128.

Figure 17:
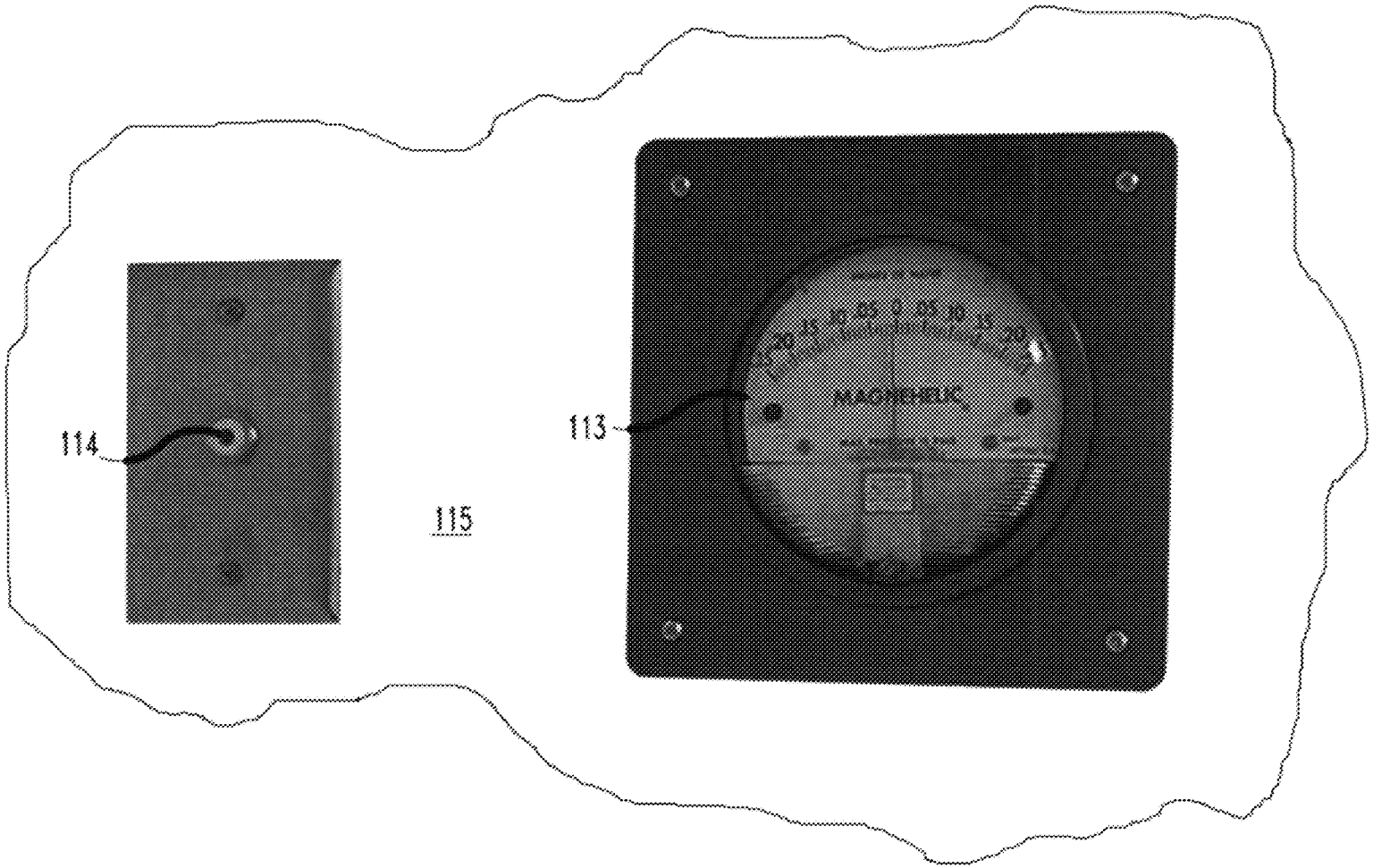
FIG. 17 is a view of an interior air pressure gauge on a wall of a mobile, modular cleanroom facility according to one embodiment of the present invention.

FIG. 17 is a close-up view of an interior air pressure gauge 113 on a wall 115 of a mobile, modular cleanroom facility according to one embodiment of the present invention. Air pressure tubes 114 measure the air pressure in the space, and gauge 113 reports the pressure difference between tubes 114 and similar tubes located in another space.

Figure 18:
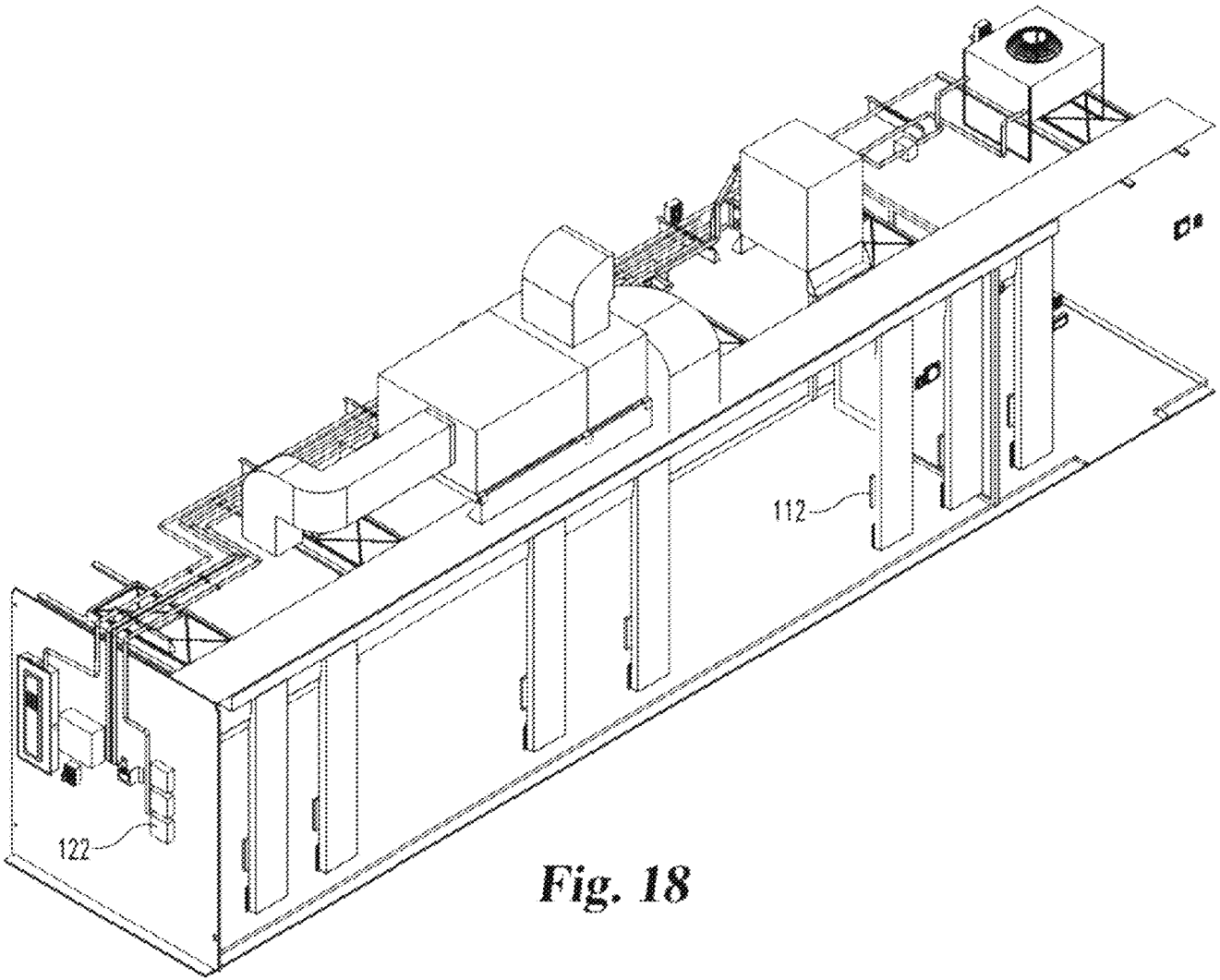
FIG. 18 is a view of automatic damper control units provided to control air flow through the air return ducts in one wall of a mobile, modular cleanroom facility according to one embodiment of the present invention.

FIG. 18 shows automated damper controls 112 provided with return air ducts to control the flow fair through the ducts. Automated damper controls may be controlled by PLC units 122 in the utility closet of the module.

Figure 19:
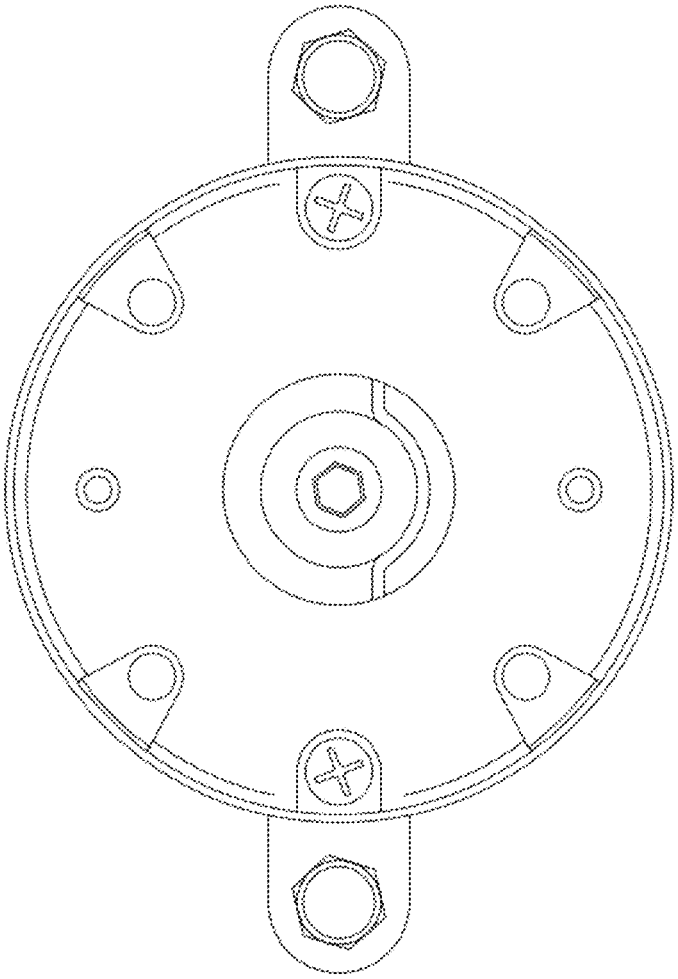
FIG. 19 is a view of a damper control mechanism behind a damper control cover on a wall of a mobile, modular cleanroom facility according to one embodiment of the present invention.

FIG. 19 is a view of a damper control mechanism behind a damper control cover on a wall of a mobile, modular cleanroom facility according to one embodiment of the present invention. Damper control 112*b* includes an internal worm gear to open or close dampers in the air return ducts.

Figure 20:
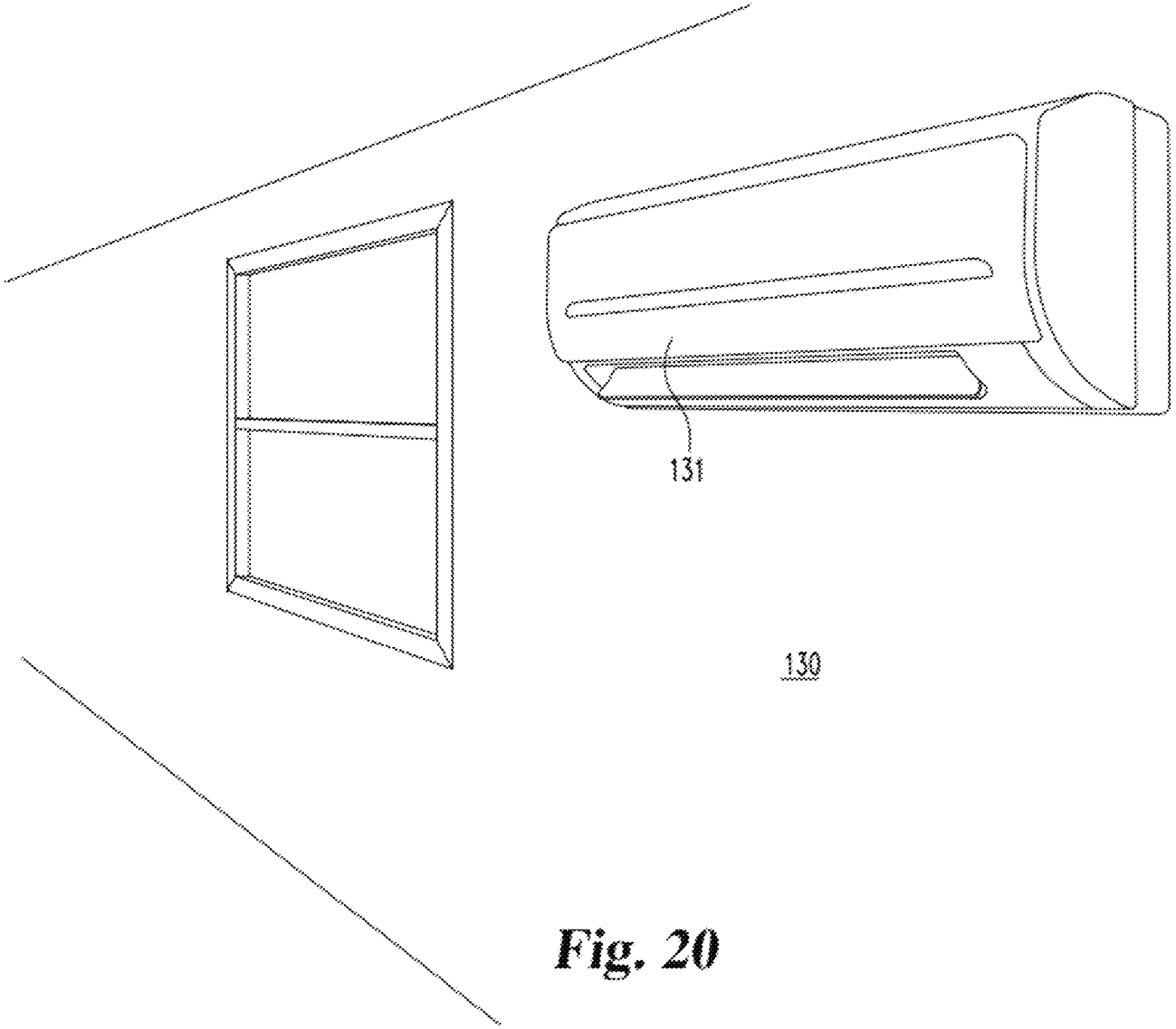
FIG. 20 is a view of an air conditioning blower on a wall of a mobile, modular cleanroom facility according to one embodiment of the present invention.

FIG. 20 is a view of an air conditioning blower on a wall of a mobile, modular cleanroom facility according to one embodiment of the present invention. Blower 131 is mounted on interior end wall 130, and contains only the cooling coils and a fan for passing air over the coils. All air is recirculated from within the room; no outside air is introduced into the room through the air conditioning blower.

In the most preferred embodiment a wall-mounted air conditioning unit is not used. Instead, cooling coils containing a refrigerant (preferably water) are provided in air blower (6 in FIG. 1) to cool the air that is blown into the cleanroom through the filters. This avoids penetration of the clean room envelop with the air conditioner blower, or with refrigerant piping or condensate piping to and from the condensing unit.

Figure 21:
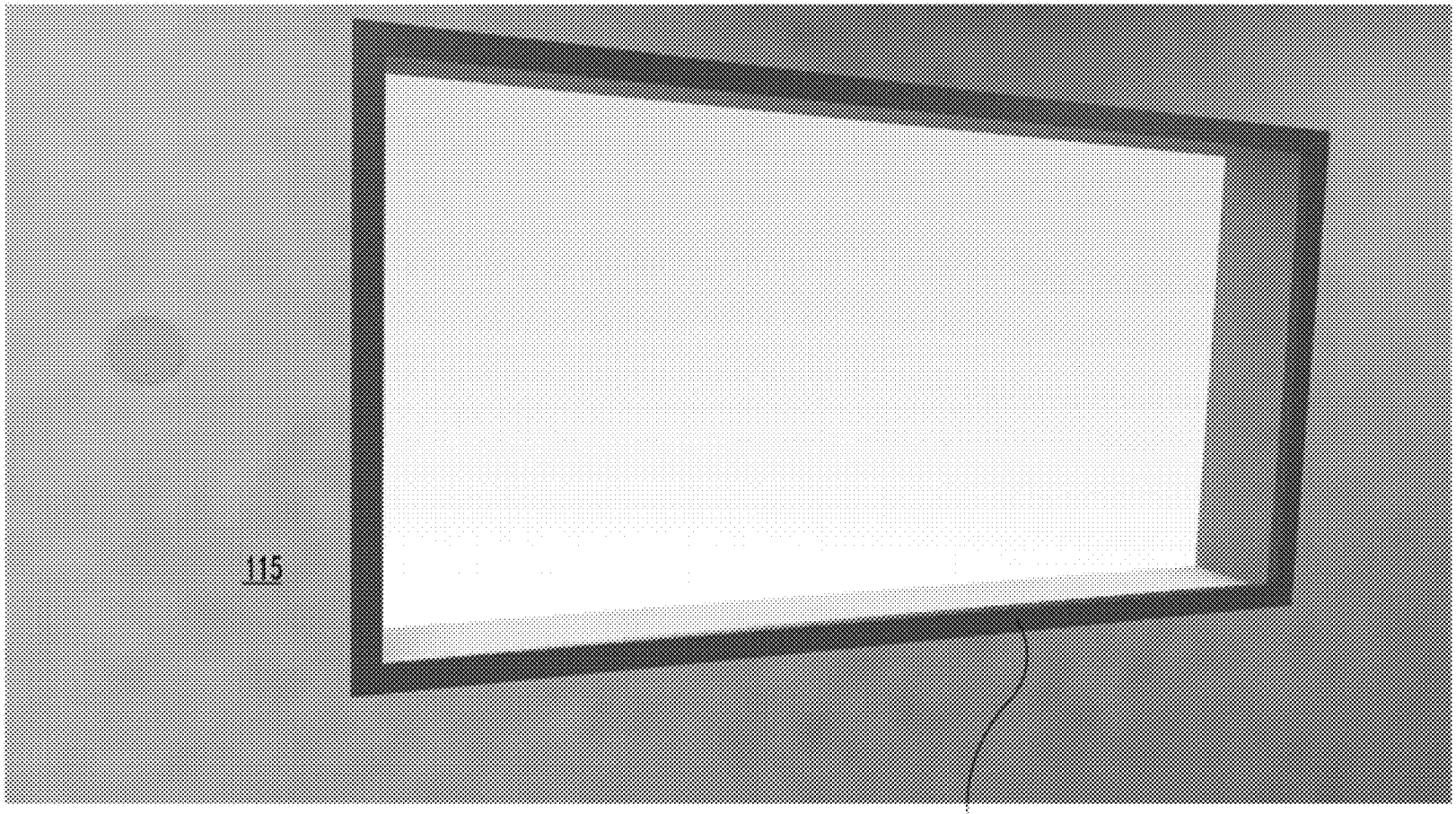
FIG. 21 is an interior view of an exterior window in a wall of a mobile, modular cleanroom facility according to one embodiment of the present invention.

FIG. 21 is an interior view of an exterior window 117 in an interior sidewall 115 of a mobile, modular cleanroom facility according to one embodiment of the present invention.

FIG. 22 shows a cleanroom certificate of performance for a mobile, modular cleanroom facility according to one embodiment of the present invention. The Certificate of Performance is issued when the space is tested and certified as being in compliance with a particular cleanroom standard, in this case with the ISO 7 classification.

Figure 23:
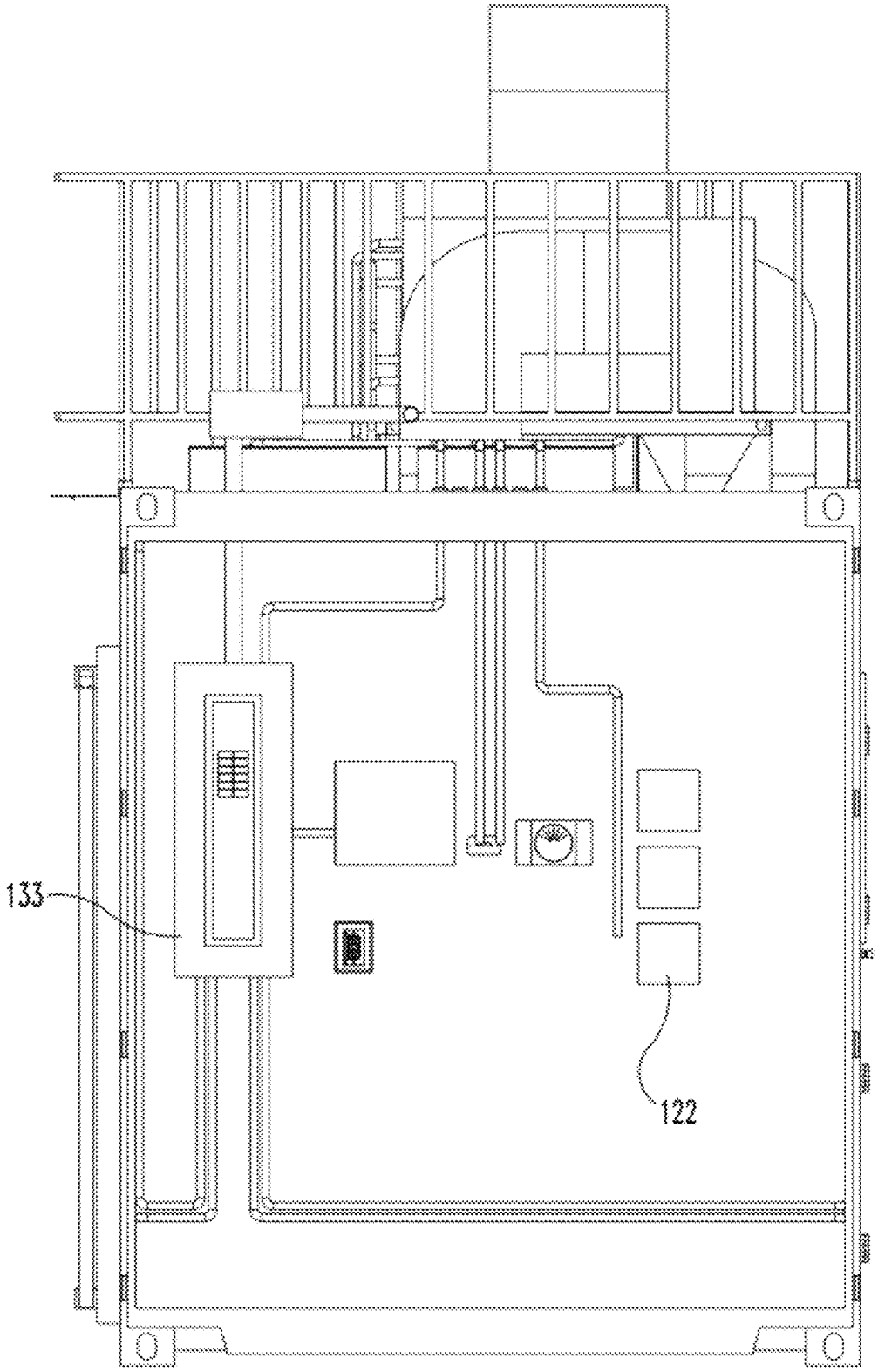
FIG. 23 is a view of a utility closet of a mobile, modular cleanroom facility according to one embodiment of the present invention.

FIG. 23 is a view of a utility closet 132 of a mobile, modular cleanroom facility according to one embodiment of the present invention. Utility closet 132 resides behind outer doors 14*a* and 14*b*, and houses a service panel 133, one or more PLC units 122 to control the automated damper controls, and other utility components.

Figure 24:
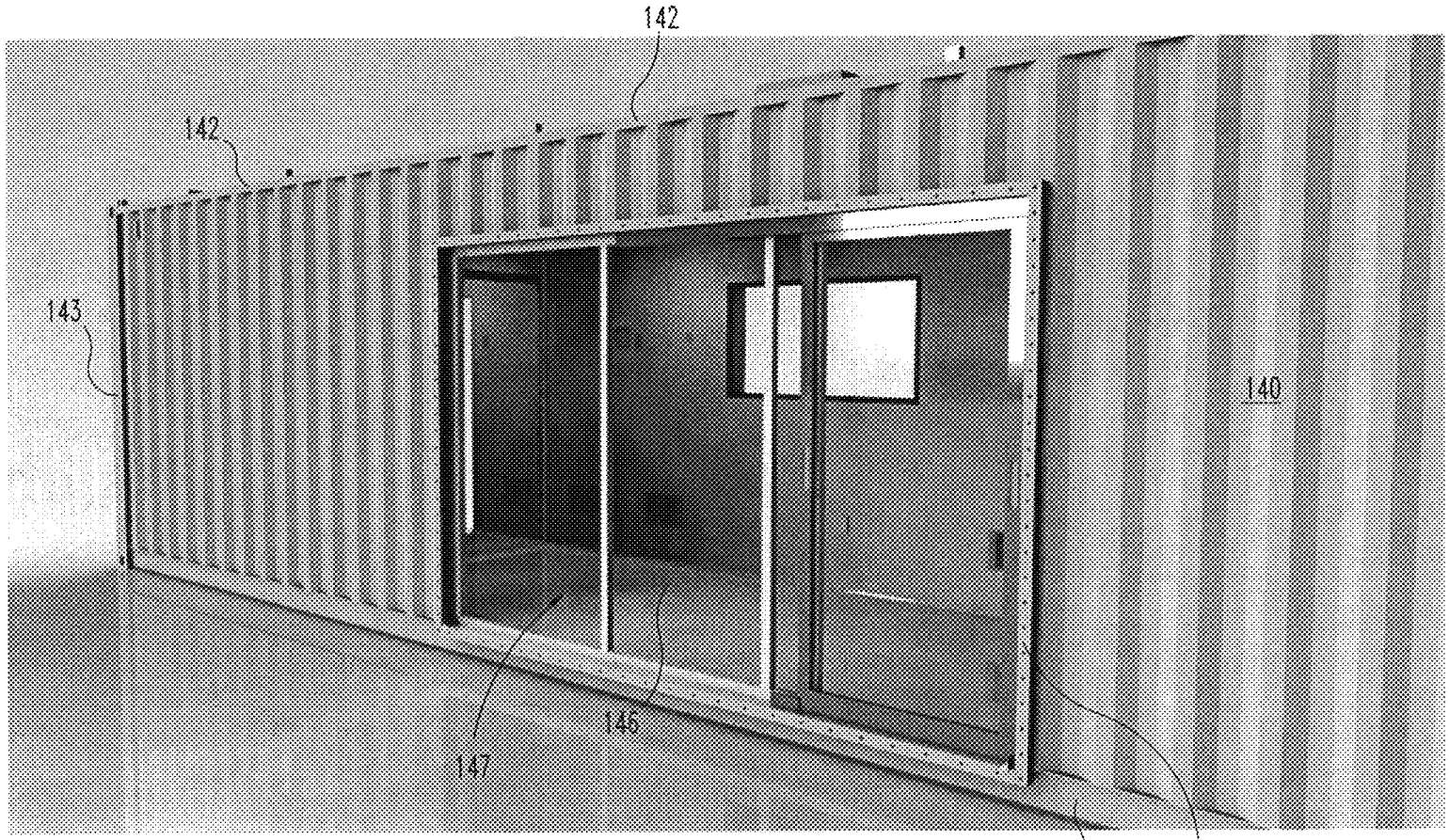
FIG. 24 is a view of a module connector in a wall of a mobile, modular cleanroom facility, according to one embodiment of the present invention.

FIG. 24 is a view of an exterior wall, including a module connector, according to one embodiment of the present invention. Exterior container wall 140 extends upward from container lower side rail 141 and terminates at container upper side rail 142. Container corner rails 143 are provided at each corner of the container. Module connector 145 surrounds opening 147 and is provided to allow two modules to be connected together. Sliding glass door 146 is provided in opening 147 to seal the passageway between the two modules.

Figure 25:
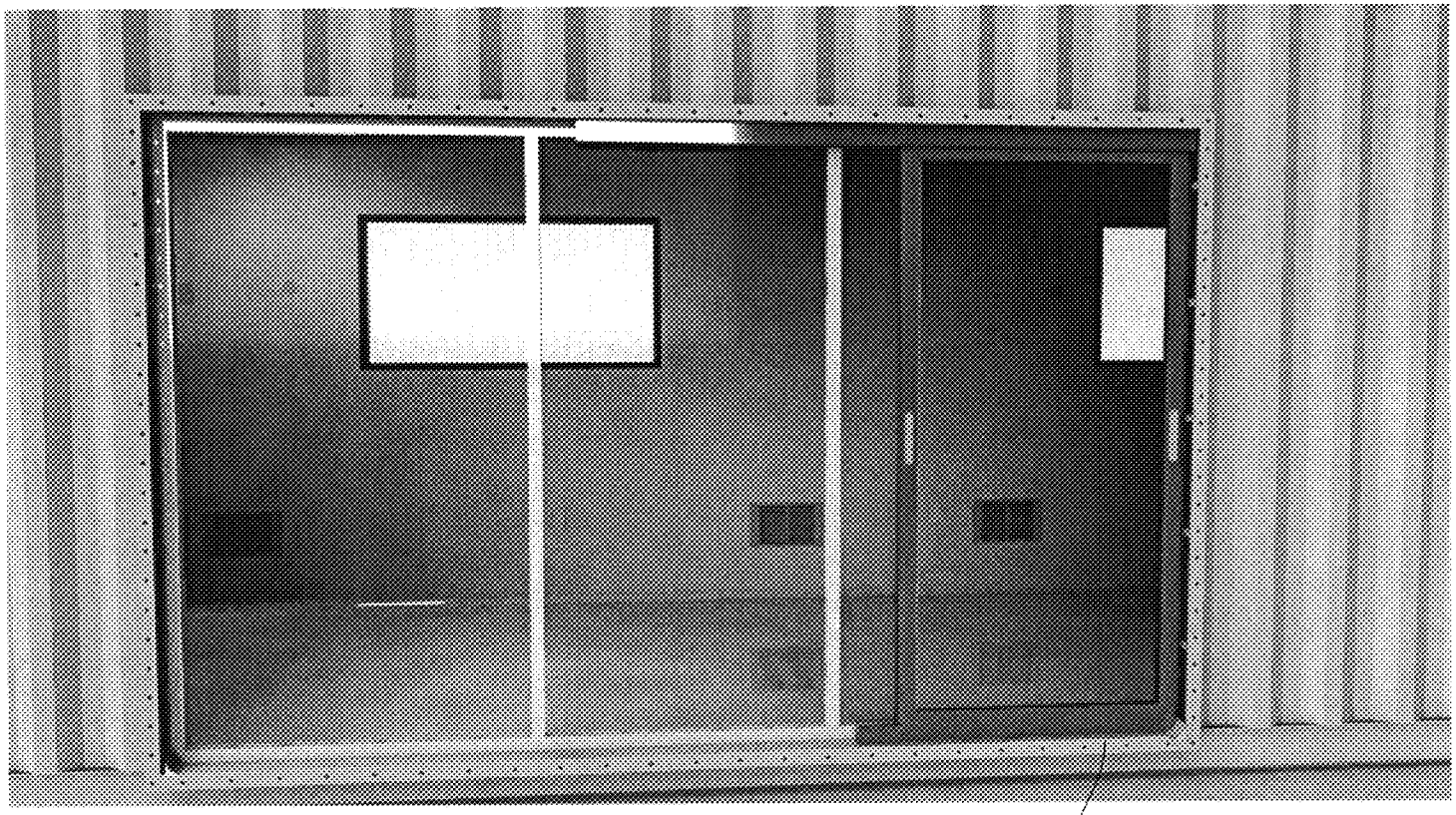
FIG. 25 is another view of a module connector in a wall of a mobile, modular cleanroom facility, according to one embodiment of the present invention.

FIG. 25 is another view of module connector 145 in sidewall 140 of a mobile, modular cleanroom facility.

Figure 26:
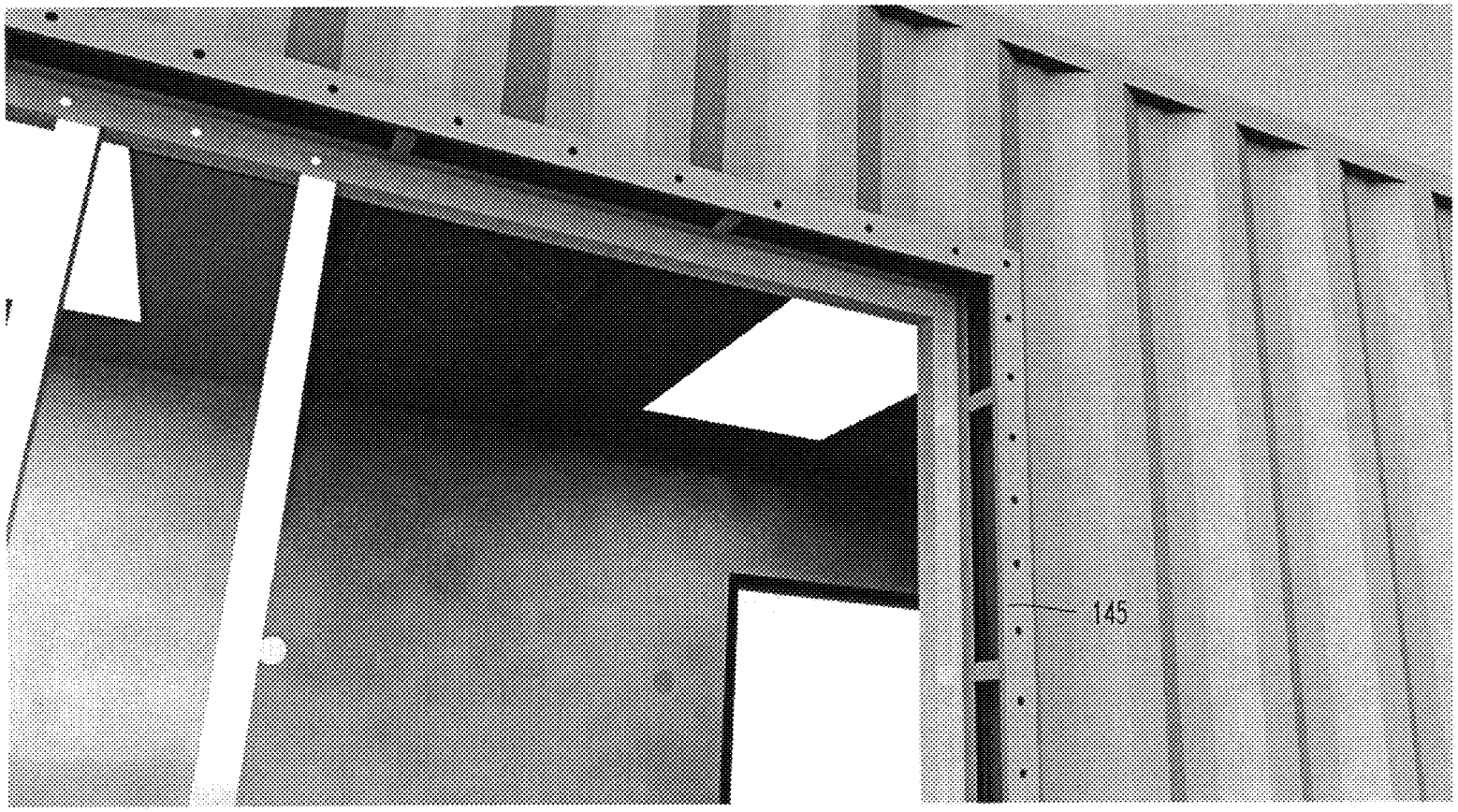
FIG. 26 is another view of a module connector in a wall of a mobile, modular cleanroom facility, according to one embodiment of the present invention.

FIG. 26 is another view of module connector 145 in sidewall 140 of a mobile, modular cleanroom facility.

Figure 27:
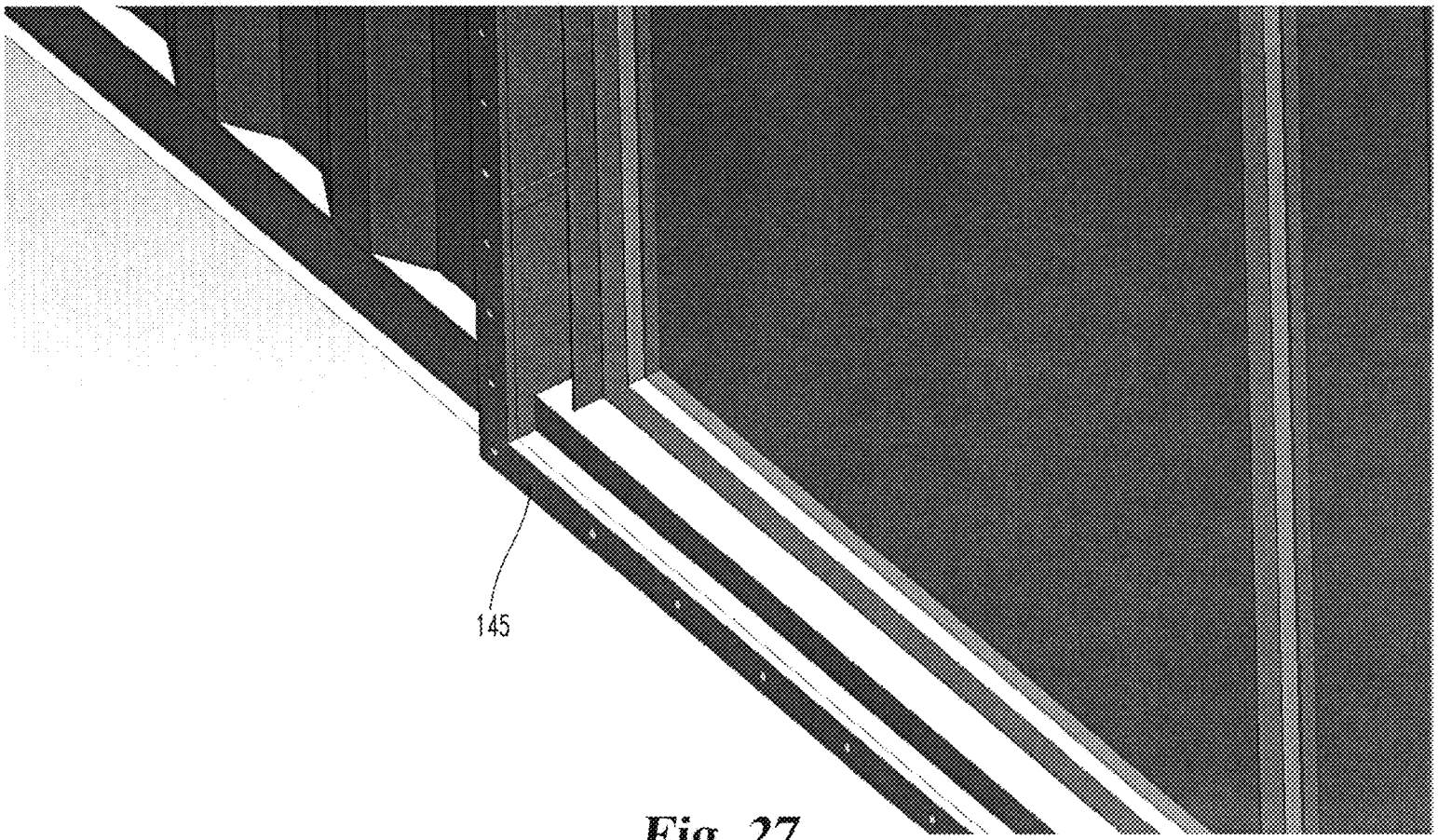
FIG. 27 is a view of a lower portion of a module connector for a mobile, modular cleanroom facility, according to one embodiment of the present invention.

FIG. 27 is another view of module connector 145 in sidewall 140 of a mobile, modular cleanroom facility.

Figure 28:
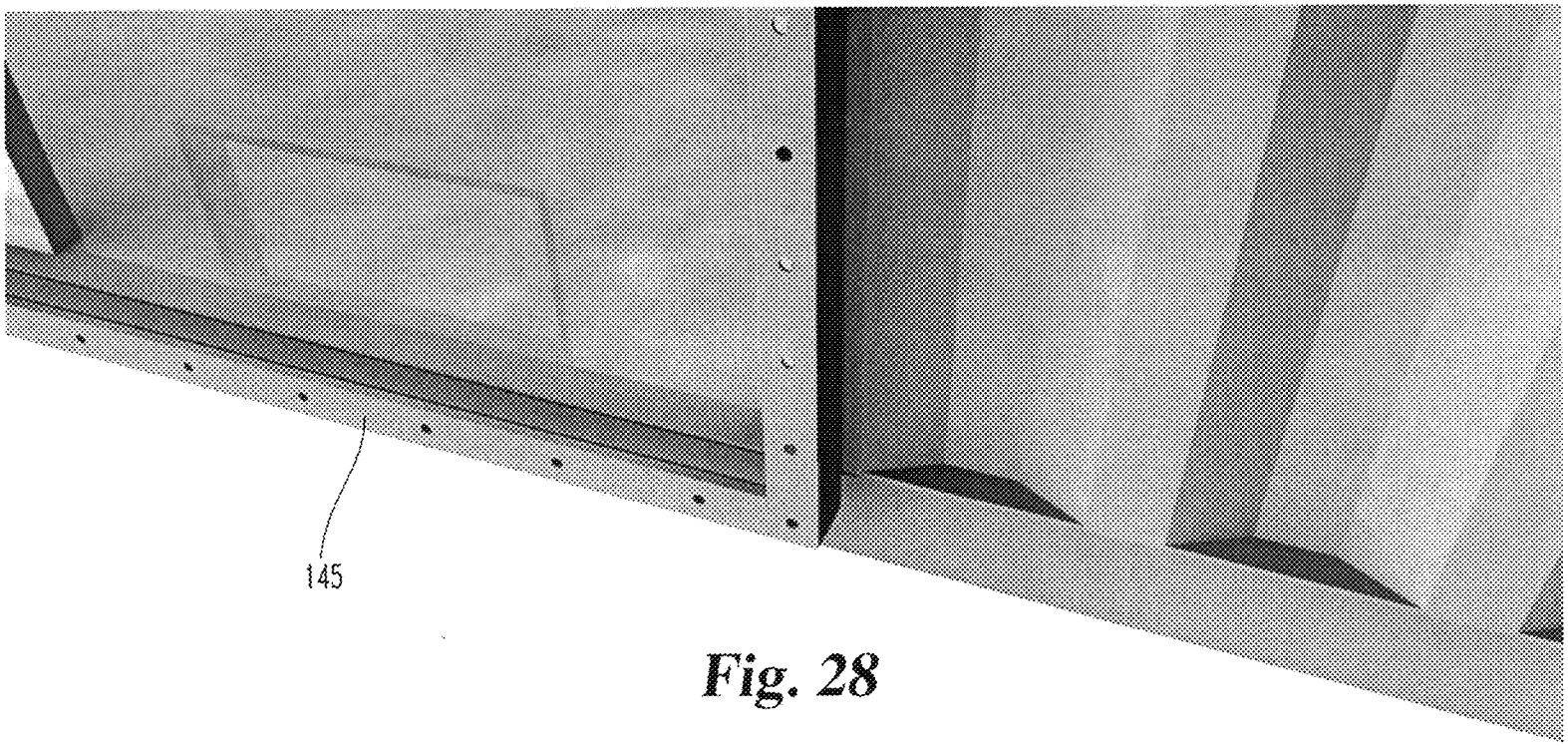
FIG. 28 is a view of a lower corner portion of a module connector for a mobile, modular cleanroom facility, according to one embodiment of the present invention.

FIG. 28 is another view of module connector 145 in sidewall 140 of a mobile, modular cleanroom facility.

Figure 29:
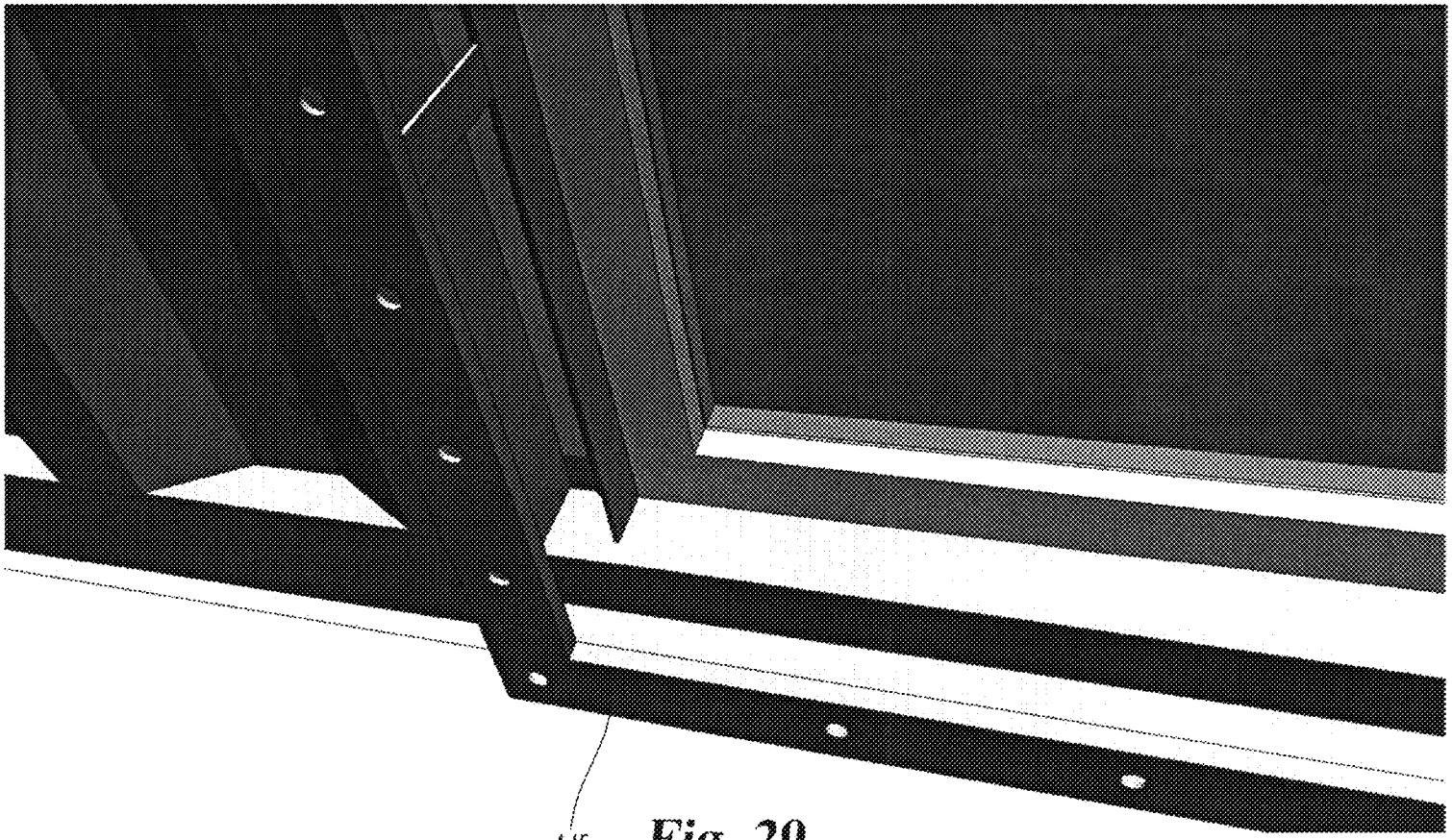
FIG. 29 is a view of another lower corner portion of a module connector for a mobile, modular cleanroom facility, according to one embodiment of the present invention.

FIG. 29 is another view of module connector 145 in sidewall 140 of a mobile, modular cleanroom facility.

Figure 30:
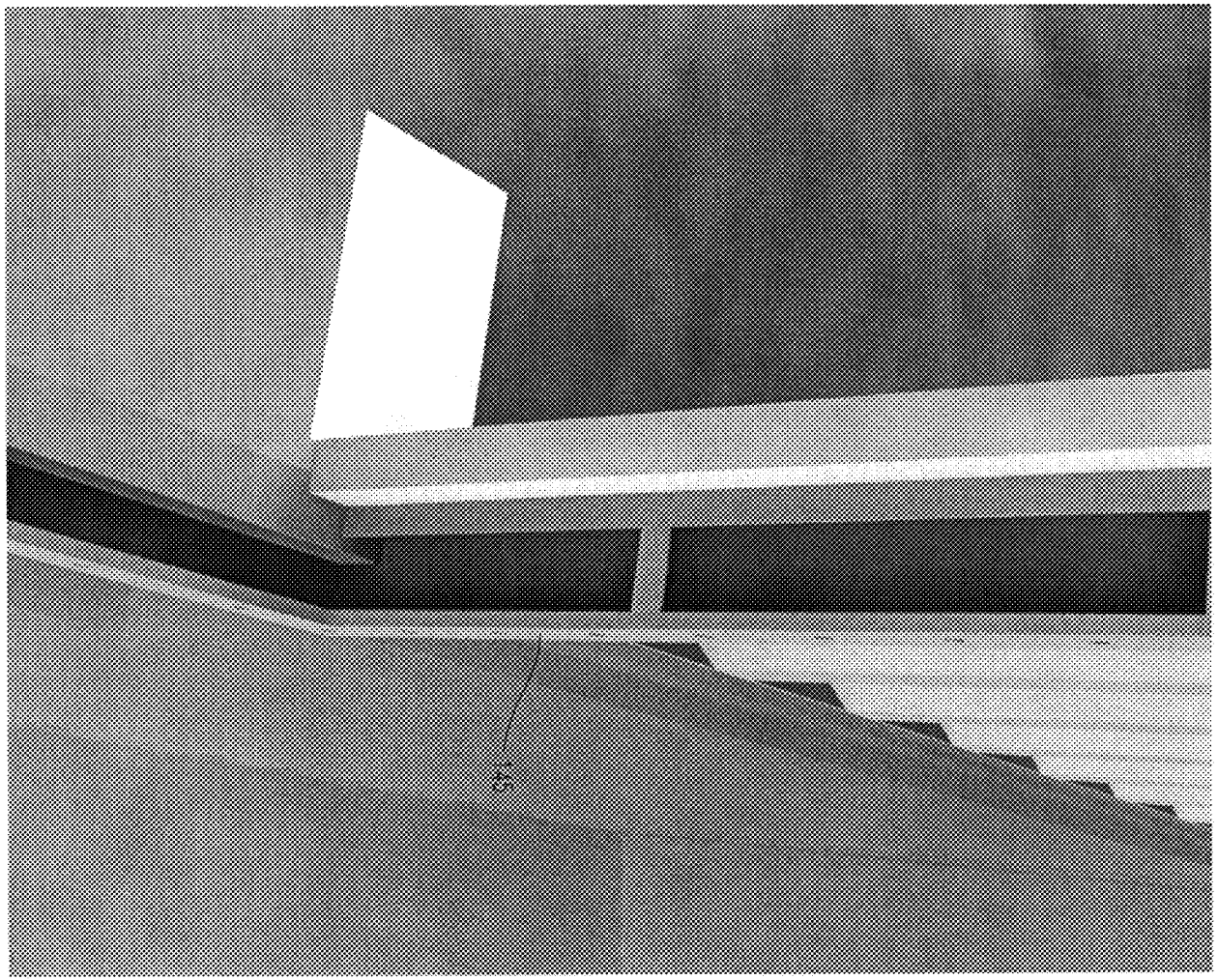
FIG. 30 is a view of a lower corner portion of a module connector for a mobile, modular cleanroom facility, according to one embodiment of the present invention.

FIG. 30 is another view of module connector 145 in sidewall 140 of a mobile, modular cleanroom facility.

Figure 31:
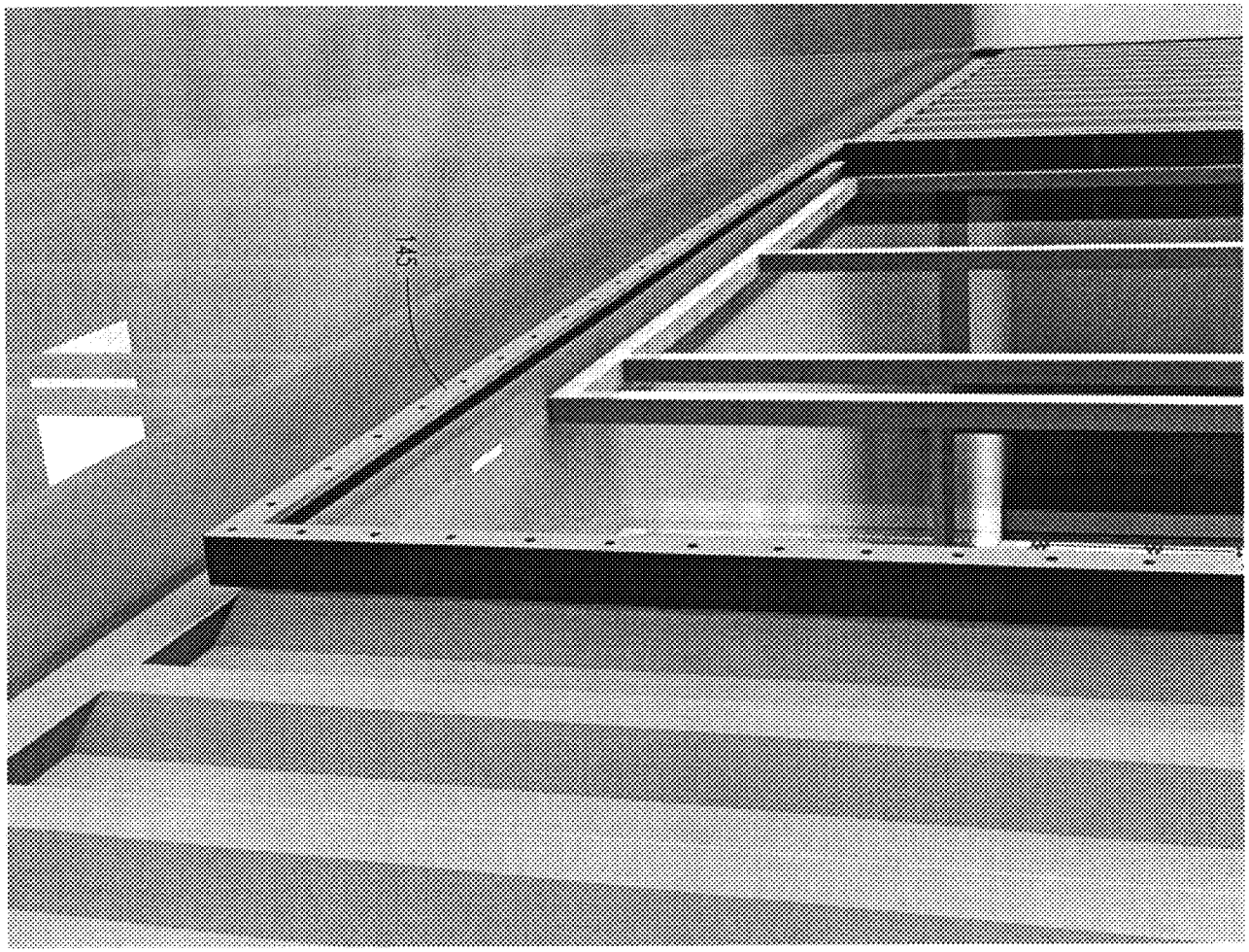
FIG. 31 is another view of a module connector for a mobile, modular cleanroom facility, according to one embodiment of the present invention.

FIG. 31 is another view of module connector 145 in sidewall 140 of a mobile, modular cleanroom facility.

Figure 32:
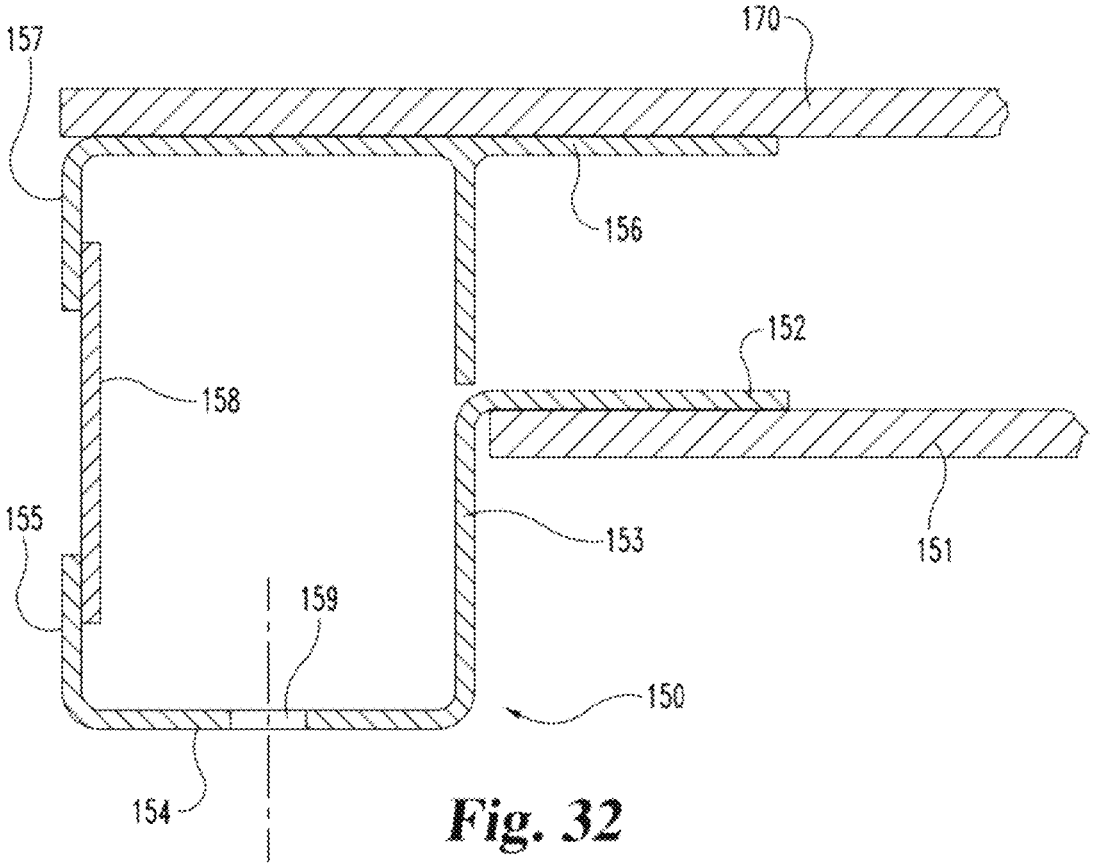
FIG. 32 is a section view of a portion of a module connector for a mobile, modular cleanroom facility, according to one embodiment of the present invention.

FIG. 32 is a section view of one portion of a module connector for a mobile, modular cleanroom facility, according to one embodiment of the present invention. Module connector 150 is provided in container wall 151. Module connector 150 includes a connector end 152 that may be welded to container wall 151 so that the module connector is fixedly attached to the module. A connector side 153 extends outward (preferably at a right angle) from the container to provide sufficient space for bolts or other connectors to be used, and to allow the module connector to extend beyond the container lower side rail. Connector face plate 154 extends to the side (preferably at a right angle) from connector side 153, and provides a surface for bolts to grip to connect two modules. Bolt holes 159 are preferably provided in the connector face plate. A short side/end piece 155 extends backward (preferably at a right angle) from connector face plate 154.

Module connector 150 may cooperate with other structural elements to provide a clean finished look to the facility. In particular, wall stud 156 may extend backward from connector side 153 as illustrated in the Figure. Angle iron 157 may be positioned adjacent wall stud 156 to provide support for drywall to cover the module connector. Connecting tabs 158 may be used to connect angle iron 157 to connector short side/end 155.

Figure 33:
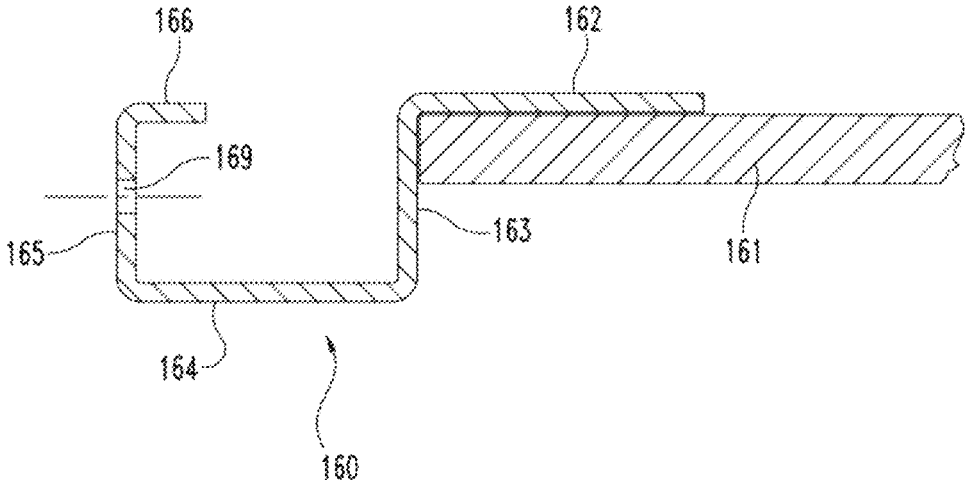
FIG. 33 is a section view of a portion of a module connector for a mobile, modular cleanroom facility, according to one embodiment of the present invention.

Similarly, FIG. 33 is a section view of another portion of a module connector for a mobile, modular cleanroom facility, according to one embodiment of the present invention. Module connector 160 is provided in the lower portion of container wall 152 where the wall meets the container floor 151. Module connector 160 includes a connector end 162 that may be welded to container bottom rail 161 so that the module connector is fixedly attached to the module. A connector back 163 extends downward (preferably at a right angle) from the top of the container rail, and connector bottom 164 extends outward to provide sufficient space for bolts or other connectors to be used. Connector face plate 165 extends upward (preferably at a right angle) from connector bottom 163, and provides a surface for bolts to grip to connect two modules. Bolt holes 169 are preferably provided in the connector face plate. A short side/end piece 166 extends inward (preferably at a right angle) from connector face plate 165.

Figure 34:
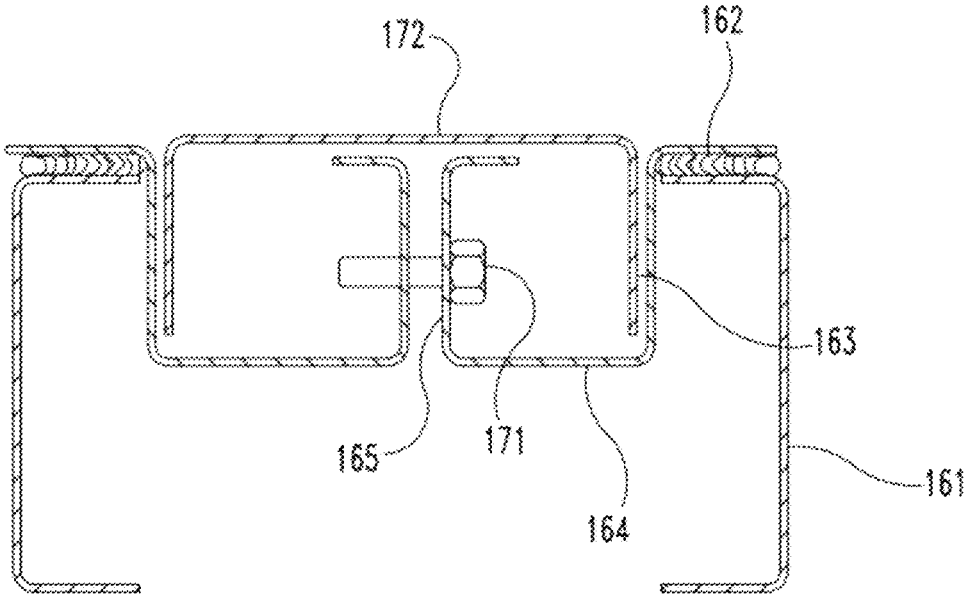
FIG. 34 is a section view of a module connector for a mobile, modular cleanroom facility, according to one embodiment of the present invention.

FIG. 34 is a section view of two module connectors connected together, according to one embodiment of the present invention. For each connector, module connector end 162 is welded to container bottom rail 161 so that the module connector is fixedly attached to the module. Each connector back 163 extends downward from the rail, and each connector bottom 164 extends outward to provide sufficient space for bolts or other connectors to be used. Each connector face plate 165 extends upward from the corresponding connector bottom 164, and each short side/end piece 166 extends inward from the connector face plates 165. The two module connectors are then bolted together with bolts 171. When the connection is complete, a floor cover plate 172 may be snapped into place to provide a finished look.

Figure 35:
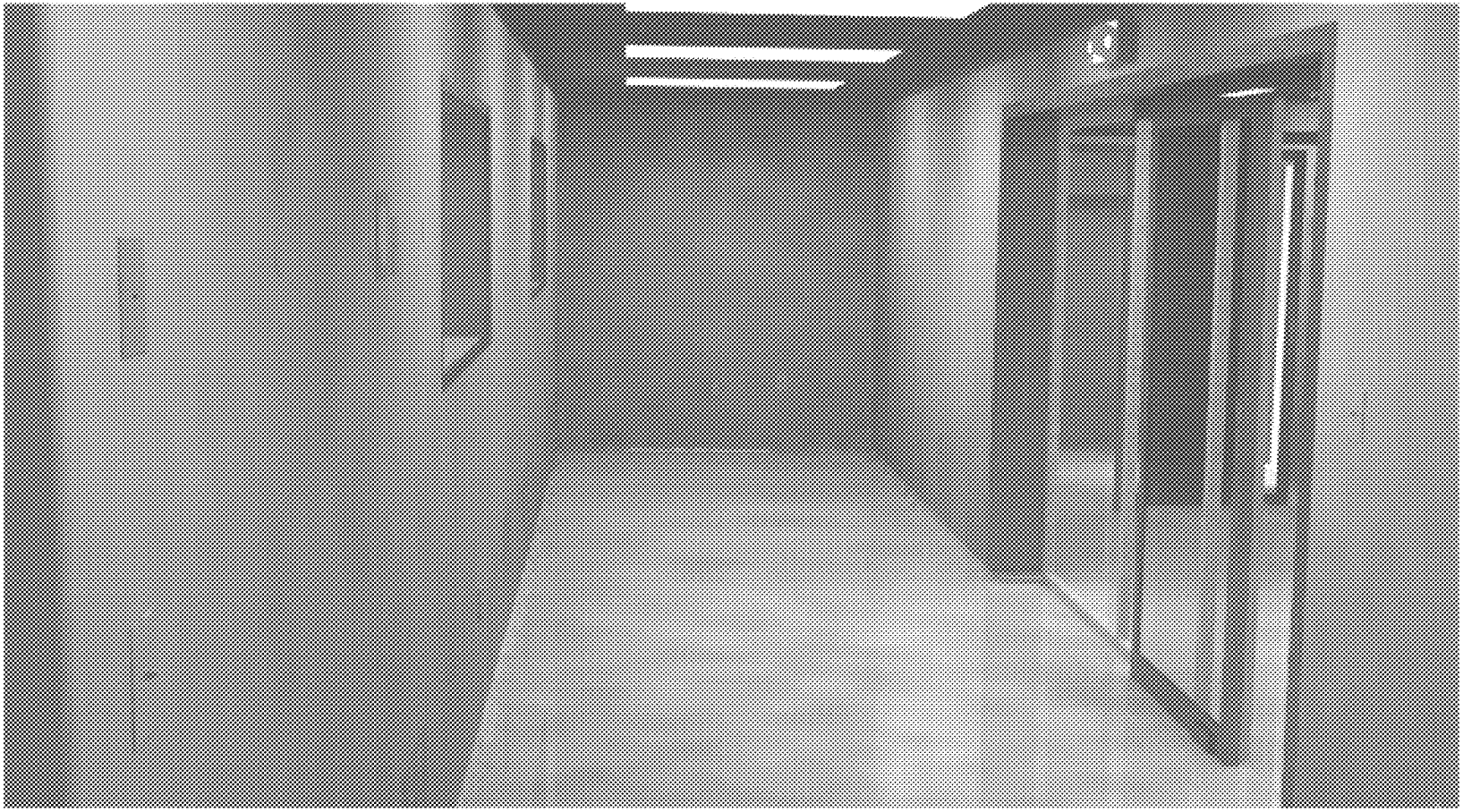
FIG. 35 is a view of the interior workspace of a mobile, modular cleanroom facility, according to one embodiment of the present invention.

FIG. 35 is a view of the interior workspace of a mobile, modular cleanroom facility, according to one embodiment of the present invention. The transition space within the module connection assembly is shown, with the transition space being "seamless" from one module to the other while maintaining the cleanroom performance and properties of the connected modules.

Figure 36:
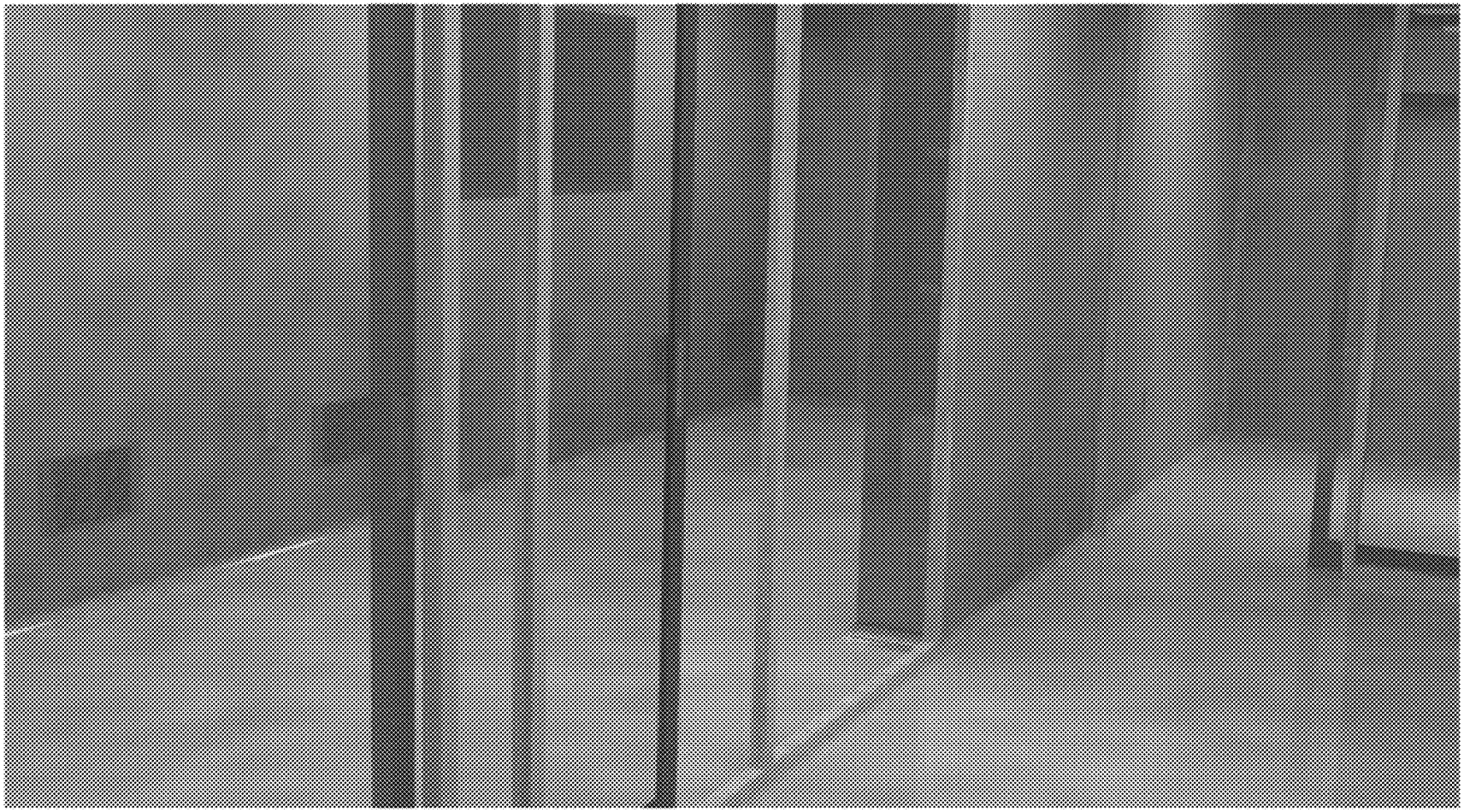
FIG. 36 is another view of the interior workspace of a mobile, modular cleanroom facility, showing the module connector and the glass wall and door between two modules, according to one embodiment of the present invention.

FIG. 36 is another view of the interior workspace of a mobile, modular cleanroom facility, showing the module connector and the glass wall and door between two modules, according to one embodiment of the present invention.

Figure 37:
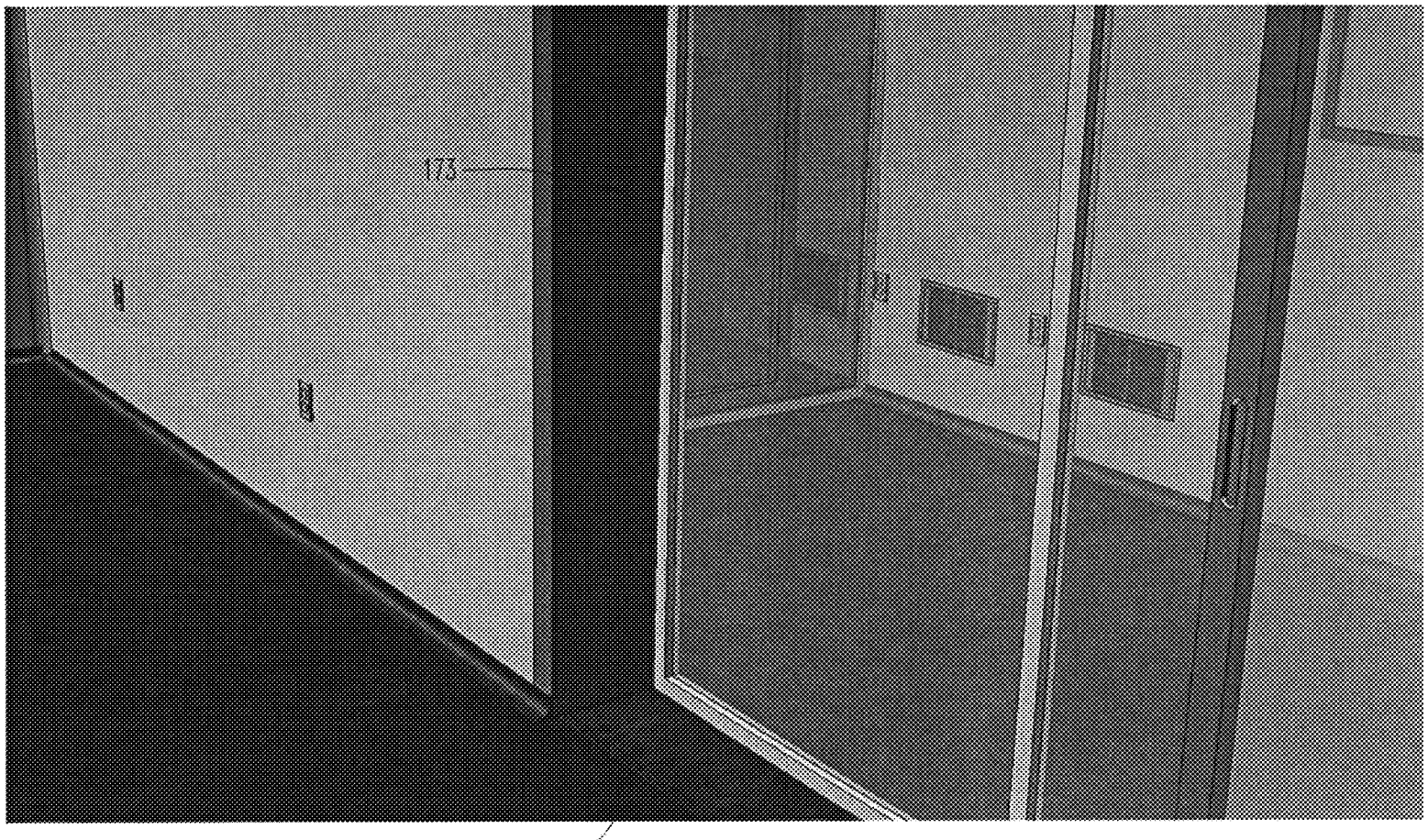
FIG. 37 is another view of the module connector and the glass wall and door between two modules, according to one embodiment of the present invention.

FIG. 37 is another view of the module connector and the glass wall and door between two modules, according to one embodiment of the present invention. Floor cover plate 172 is provided to cover the lower portions of the two module connectors. Upper plate 173 covers the upper portions of the connection/transition space. Here too, the transition space within the module connection assembly can be seen to be "seamless" from one module to the other, although small seam lines may be visible where the modules connect to the module connection assembly. In the illustrated embodiment the seam line has not yet been caulked, although seam caulking is generally preferred before the module is turned over to the customer. In the finished module all connections are caulked to prevent air or water from being able to enter, thus providing an airtight and watertight connection between the modules.

Figure 38:
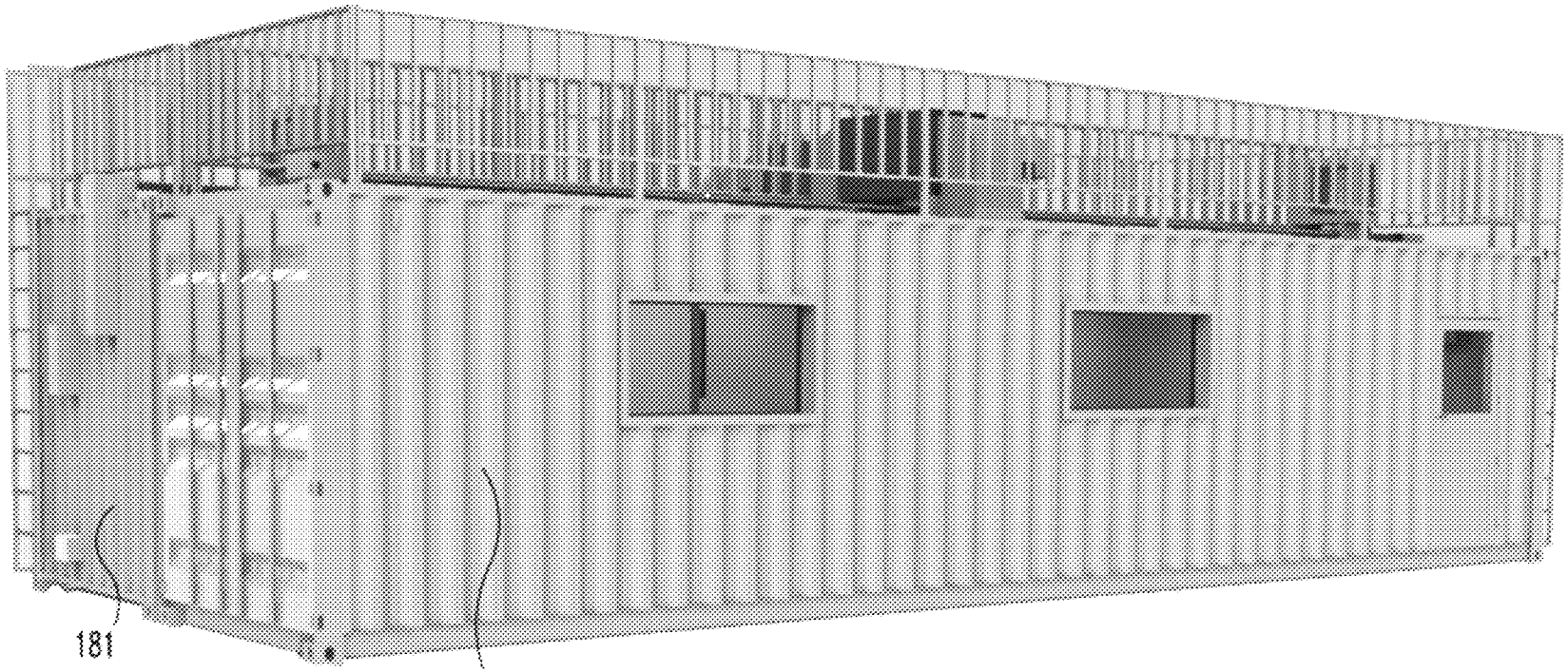
FIG. 38 is a view of two modules connected to provide a mobile, modular cleanroom facility, according to one embodiment of the present invention.

FIG. 38 is a view of two modules connected to provide a mobile, modular cleanroom facility, according to one embodiment of the present invention. First module 181 is connected to second module 182 to provide a two-module mobile cleanroom facility.

Figure 39:
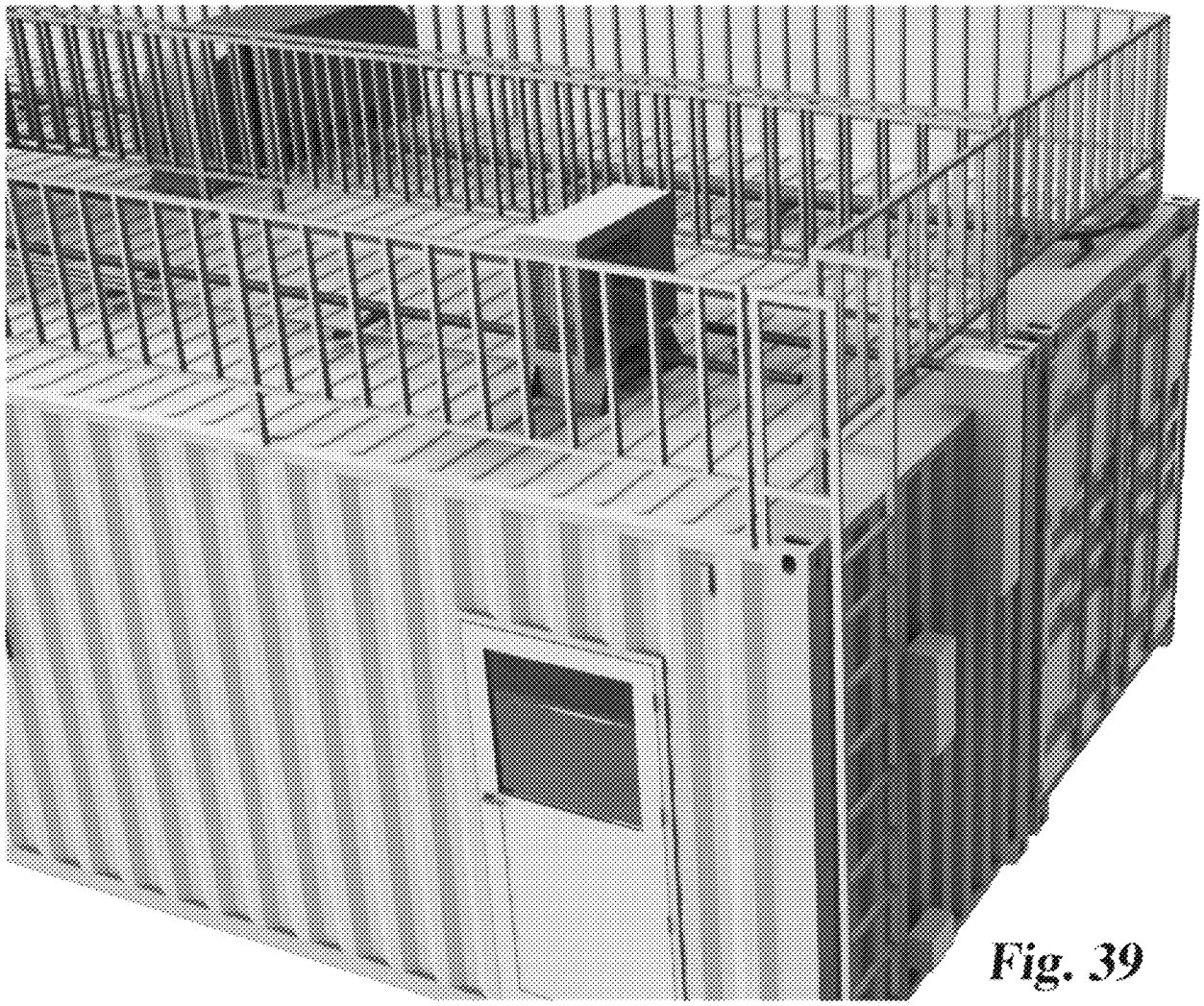
FIG. 39 is another view of two modules connected to provide a mobile, modular cleanroom facility, according to one embodiment of the present invention.
Figure 40:
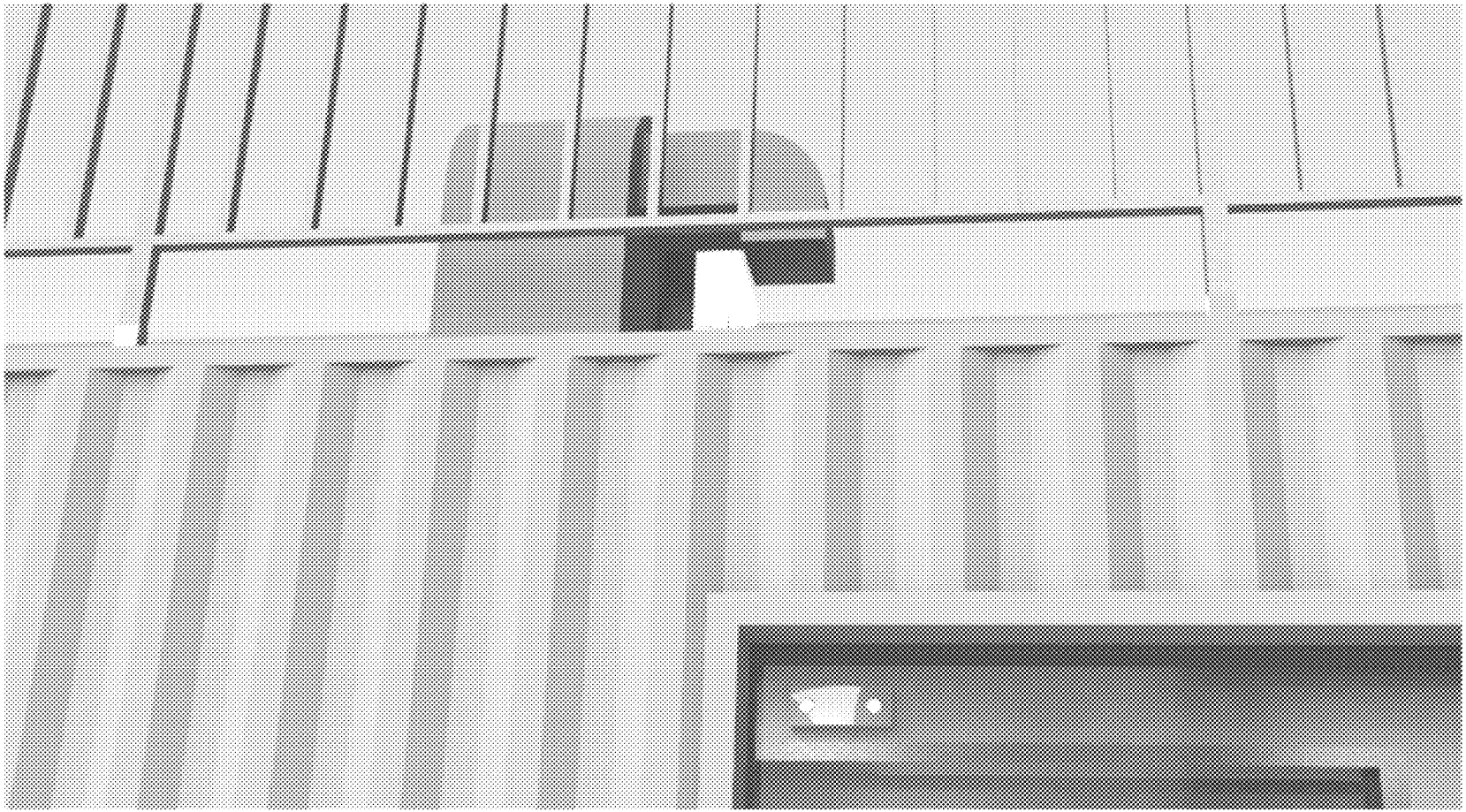
FIG. 40 is a view of a blower mounted on the roof of a mobile, modular cleanroom facility, according to one embodiment of the present invention.

FIG. 39 is another view of two modules connected to provide a mobile, modular cleanroom facility. An air conditioning compressor 184 can be seen on the roof FIG. 40 is a view of a blower mounted on the roof of a mobile, modular cleanroom facility, according to one embodiment of the present invention. Blower 186 is fed by return air duct 187 and air intake 188. The blower blows air into the ceiling plenum through blower duct 189.

Figure 41:
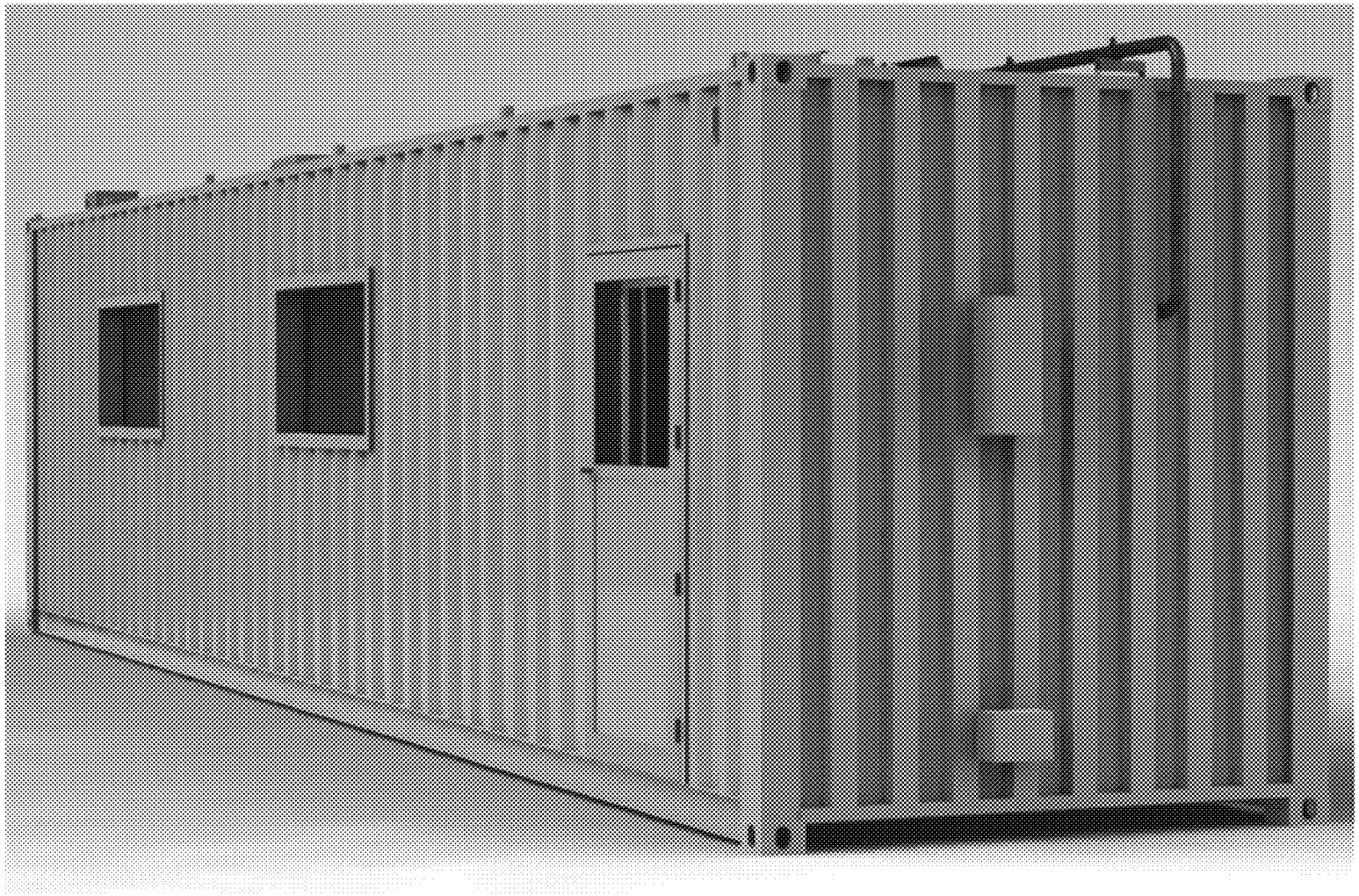
FIG. 41 is a perspective view of a pre-assembled cleanroom module after being transported in its pre-assembled condition.

FIG. 41 shows a perspective view of a pre-assembled cleanroom module after being transported in its pre-assembled condition according to one embodiment of the present invention. The connection blocks common to intermodal shipping containers can be seen at the bottom corners of the module. All exterior walls and the roof and bottom/floor are pre-assembled. In the illustrated embodiment the exterior doors are also pre-assembled.

Figure 42:
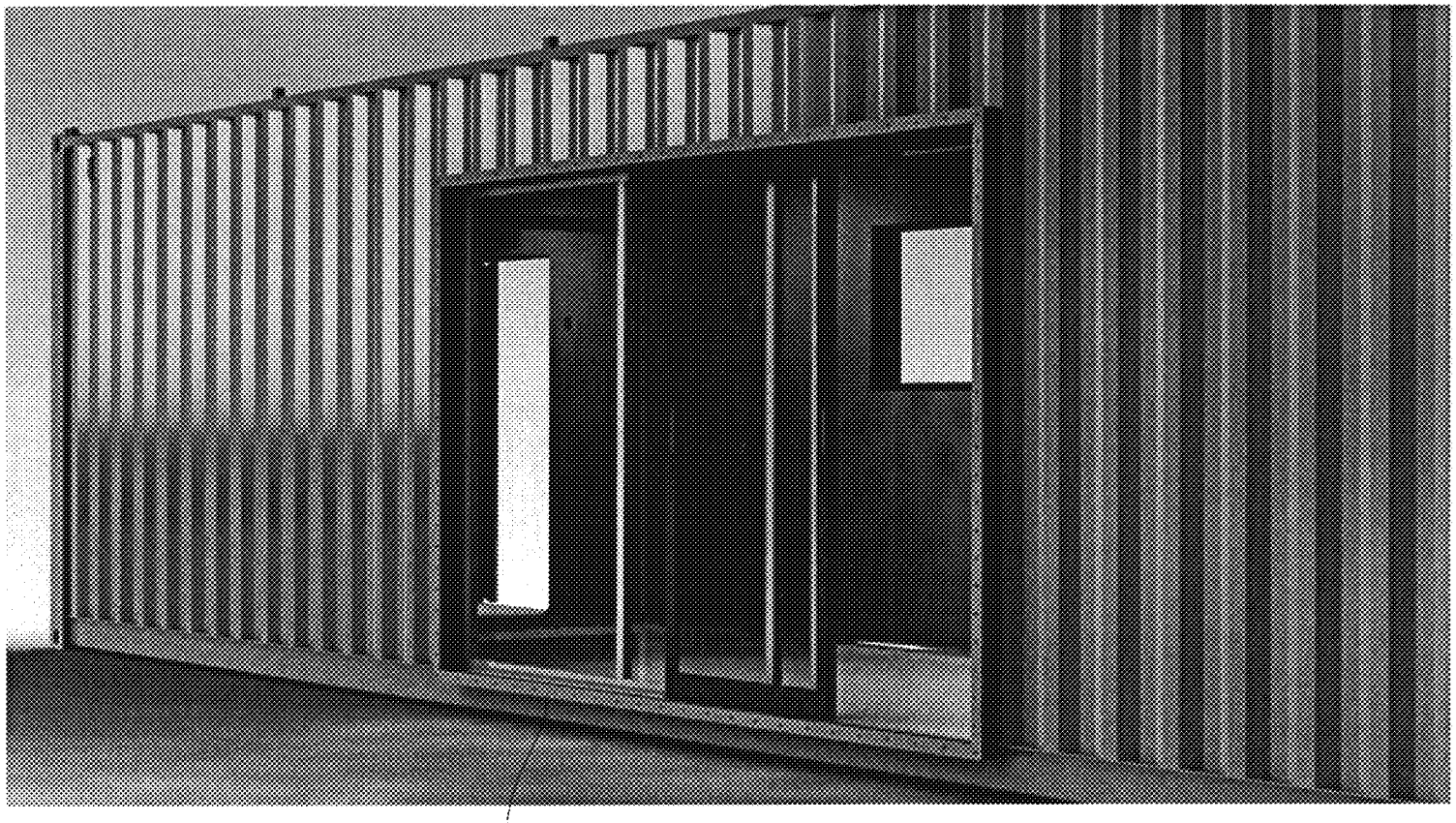
FIG. 42 is another perspective view of the pre-assembled cleanroom module of FIG. 41 after being transported in its pre-assembled condition.

FIG. 42 shows another perspective view of a pre-assembled cleanroom module after being transported in its pre-assembled condition according to one embodiment of the present invention. As in the embodiment shown in FIG. 41, all exterior walls and the roof and bottom/floor are pre-assembled, as is the exterior door that is open and cannot be seen in the Figure. Connector frame 145 allows the module to be connected to a second module. The sliding glass doors in the foreground provide entry to the transition space within the connection assembly, and they may be pre-assembled or left to be installed at the job site. Typically, only one set of sliding glass doors is used when two modules are connected together.

Figure 43:
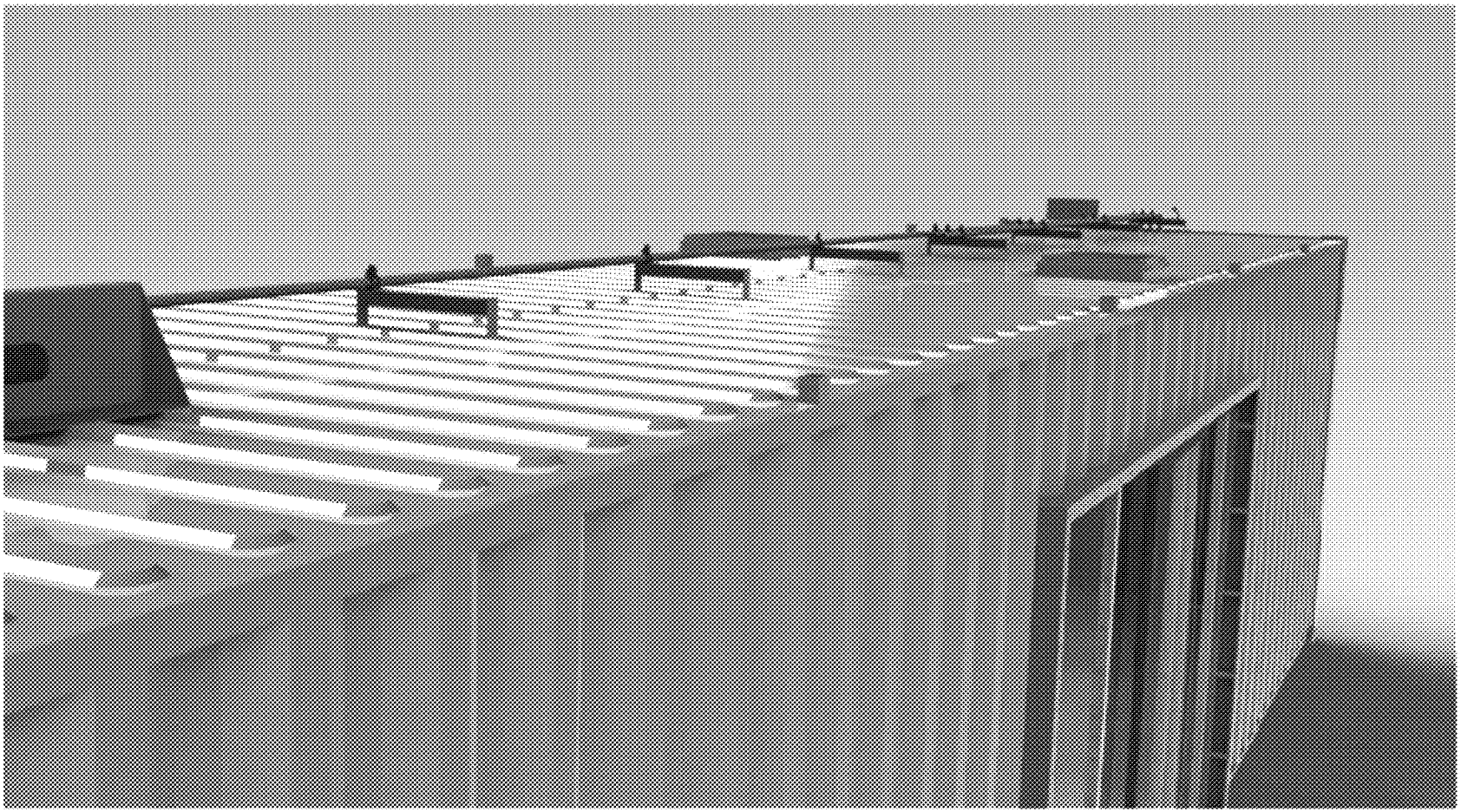
FIG. 43 is a perspective view of the roof of the pre-assembled cleanroom module of FIG. 41 after being transported in its pre-assembled condition.

FIG. 43 is a perspective view of the roof of the pre-assembled cleanroom module of FIG. 41 after being transported in its pre-assembled condition. As can be seen from the Figure, the blowers and the air conditioning compressor are not installed on the container roof. Connection hardware, including cut-outs and support hardware, are provided so that the blowers and air conditioning compressor may quickly be installed into the pre-assembled ductwork.

Figure 44:
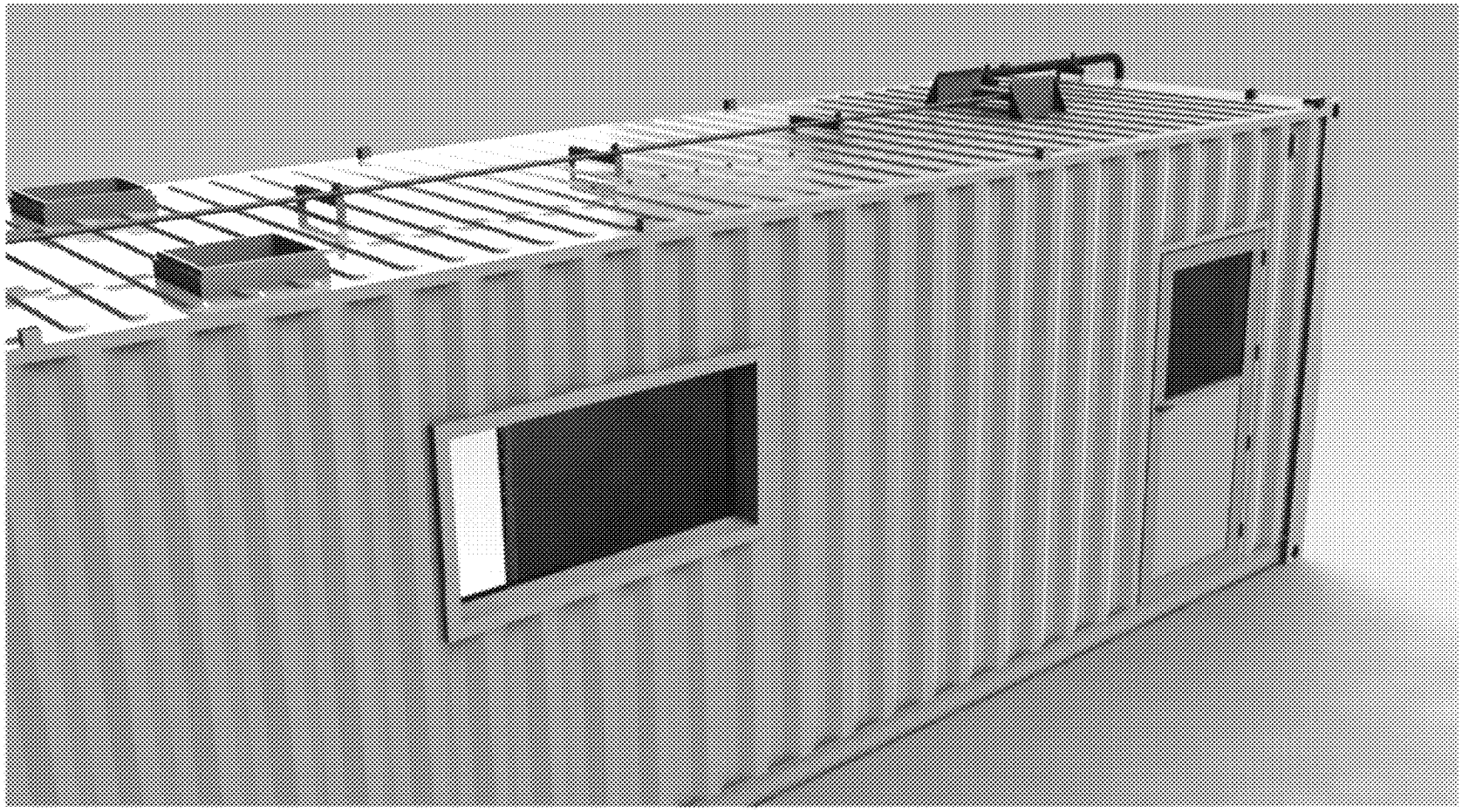
FIG. 44 is another perspective view of the roof of the pre-assembled cleanroom module of FIG. 41 after being transported in its pre-assembled condition.

FIG. 44 is another perspective view of the roof of the pre-assembled cleanroom module of FIG. 41 after being transported in its pre-assembled condition. The hardware for installing the blowers and air conditioning compressor are particularly shown in this Figure.

Figure 45:
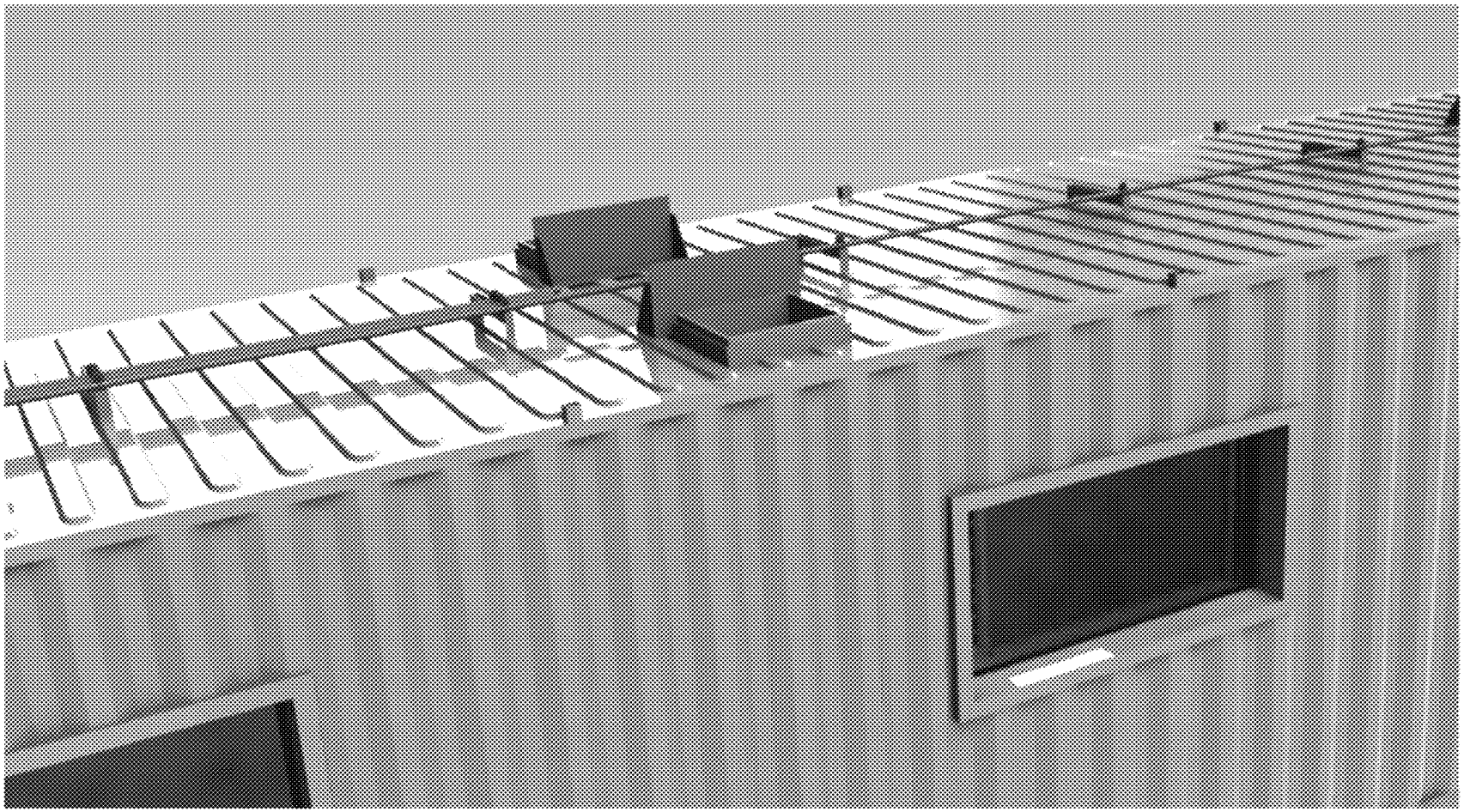
FIG. 45 is another perspective view of the roof of the pre-assembled cleanroom module of FIG. 41 after being transported in its pre-assembled condition.

FIG. 45 is another perspective view of the roof of the pre-assembled cleanroom module of FIG. 41 after being transported in its pre-assembled condition. The hardware for installing the blowers is particularly shown in this Figure.

Figure 46:
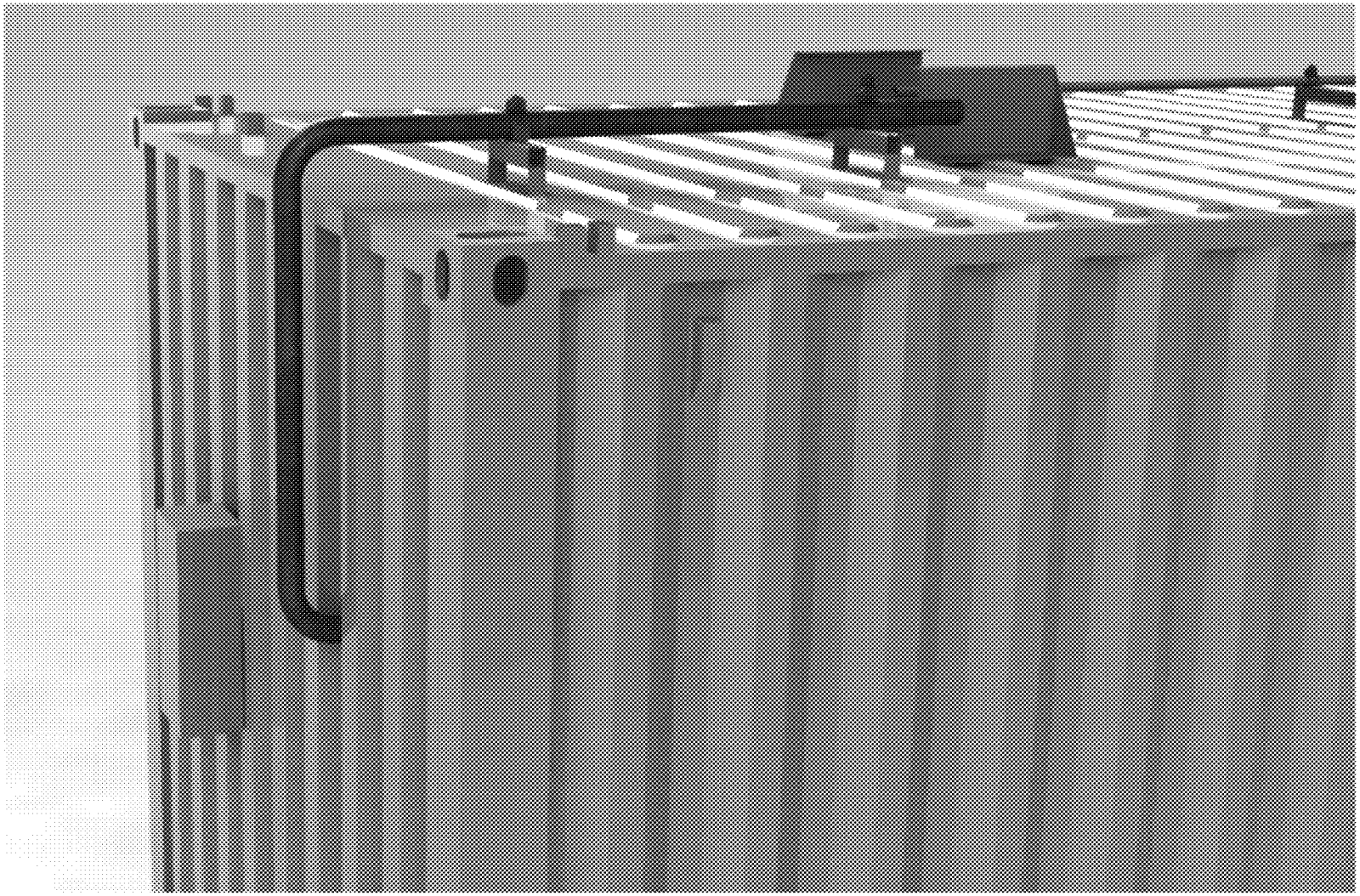
FIG. 46 is another perspective view of part of the roof and a top corner of the pre-assembled cleanroom module of FIG. 41 after being transported in its pre-assembled condition.

FIG. 46 is another perspective view of part of the roof and a top corner of the pre-assembled cleanroom module of FIG. 41 after being transported in its pre-assembled condition. The hardware for installing the air conditioning compressor is particularly shown in this Figure.

Figure 47:
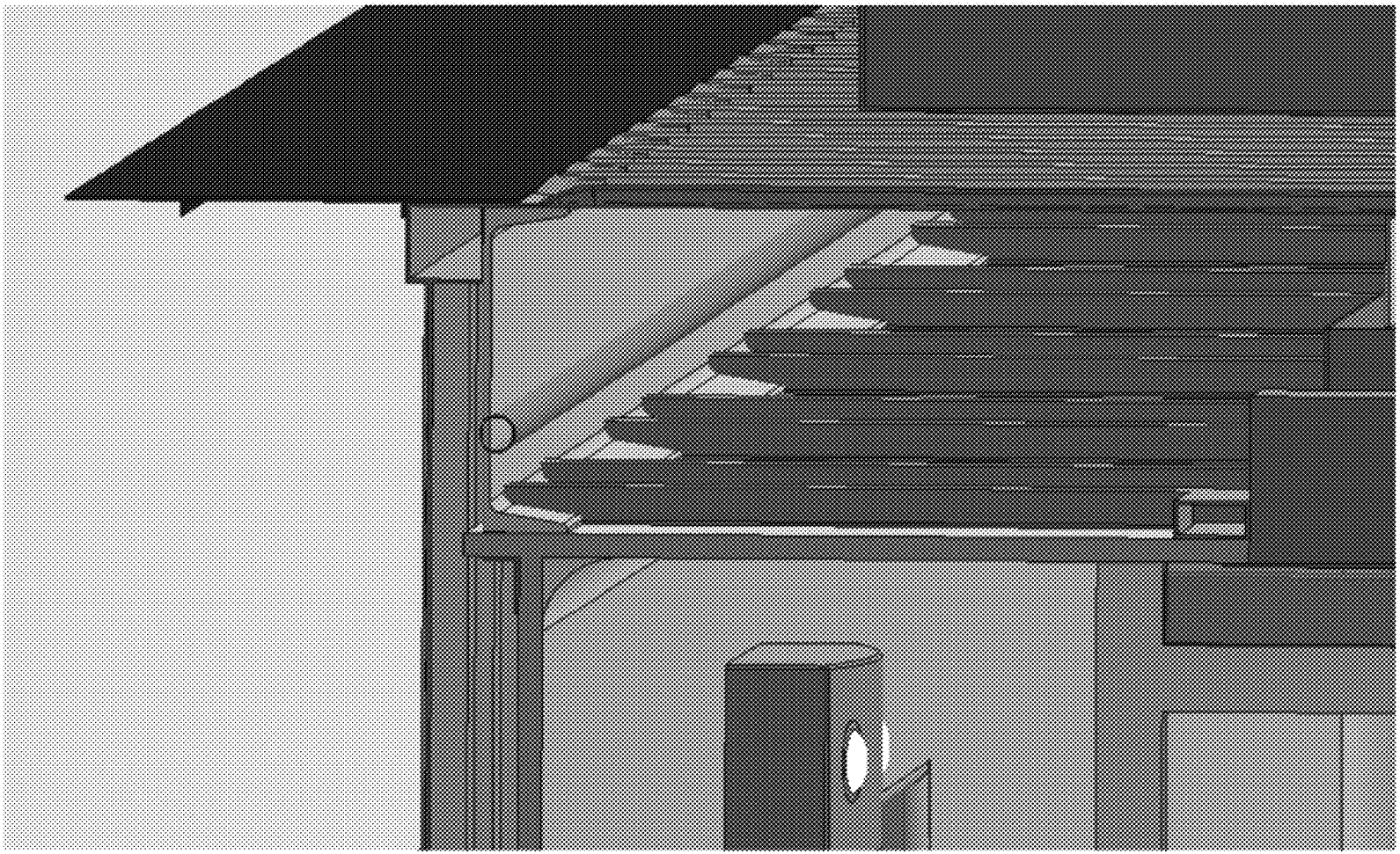
FIG. 47 is a view of a portion of a ceiling plenum according to one embodiment of the present invention.

FIG. 47 is a view of a portion of a ceiling plenum according to one embodiment of the present invention. Container top 101 and container side wall 102 join at top rail 103. One end of plenum sidewall 105 is welded to and extends downward from top rail 103 and the other end of plenum sidewall 105 is welded to and supports ceiling joists 107. Ceiling drywall 108 is secured to ceiling joists 107 above, and is seamlessly joined to interior sidewalls 111 below.

Figure 48:
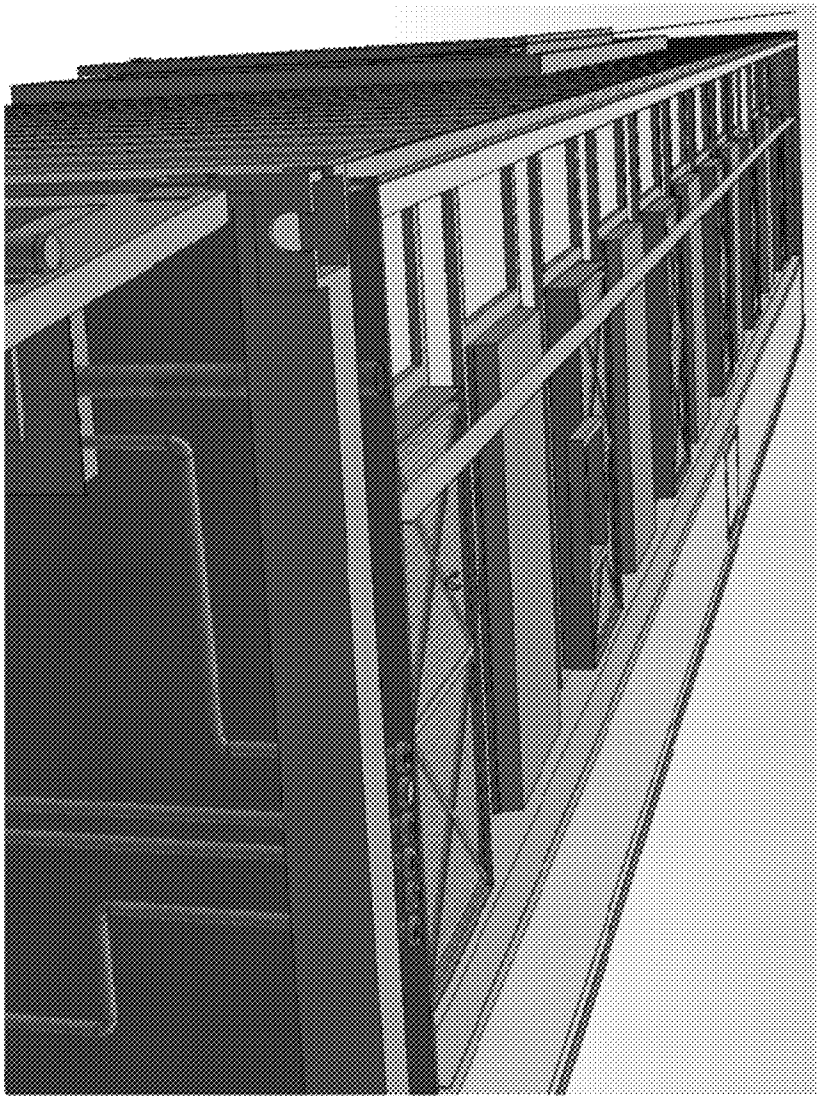
FIG. 48 is another view of a portion of a ceiling plenum according to one embodiment of the present invention.

FIG. 48 is another view of a portion of a ceiling plenum according to one embodiment of the present invention.

Figure 49:
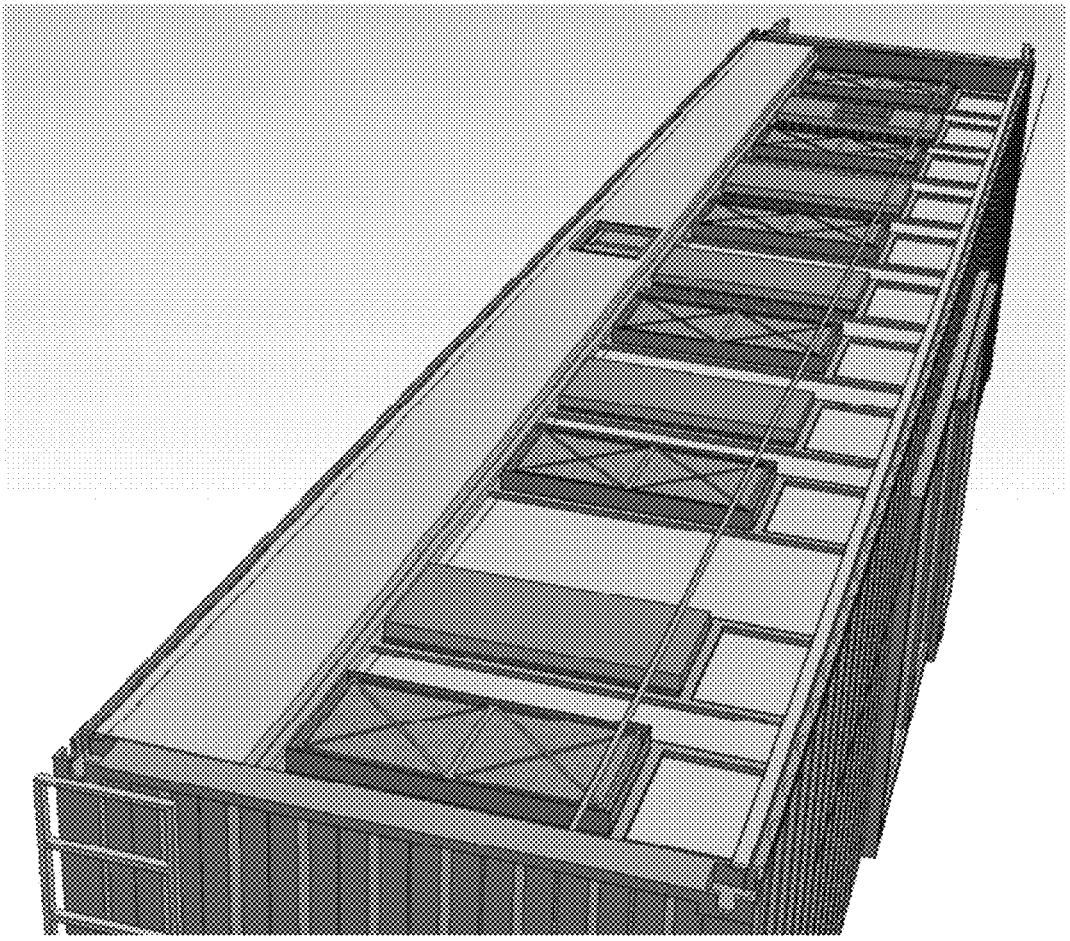
FIG. 49 is another view of a portion of a ceiling plenum according to one embodiment of the present invention.

FIG. 49 is another view of a portion of a ceiling plenum according to one embodiment of the present invention.

Figure 50:
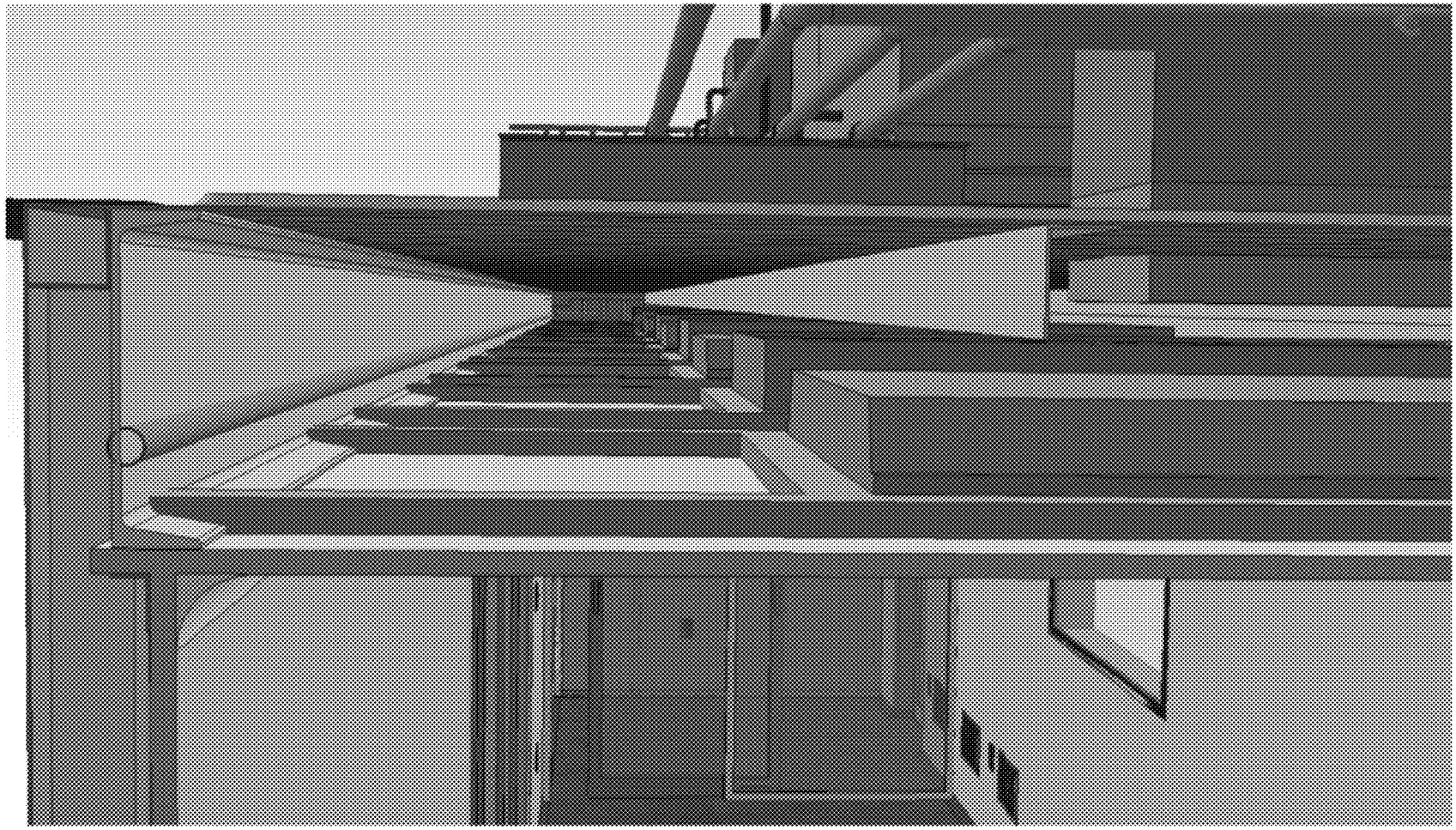
FIG. 50 is another view of a portion of a ceiling plenum according to one embodiment of the present invention.

FIG. 50 is another view of a portion of a ceiling plenum according to one embodiment of the present invention. Ceiling lighting fixtures and ceiling filters are illustrated, as is a return air duct that runs adjacent the plenum space. FIG. 50 also illustrates how interior walls 51 contact ceiling dry wall 108 in an airtight connection. Ceiling dry wall 108 thus may form a boundary of two airtight spaces. One space is the space defined by the illustrated module roof, the illustrated plenum sidewall, the two plenum end walls (one illustrated and one not illustrated), and the illustrated ceiling joists/ceiling drywall. The other space is the space defined by the illustrated ceiling joists/ceiling drywall, the illustrated interior sidewall, the opposite interior sidewall (not illustrated), the two interior end walls (one illustrated and one not illustrated), and the module floor.

Figure 51:
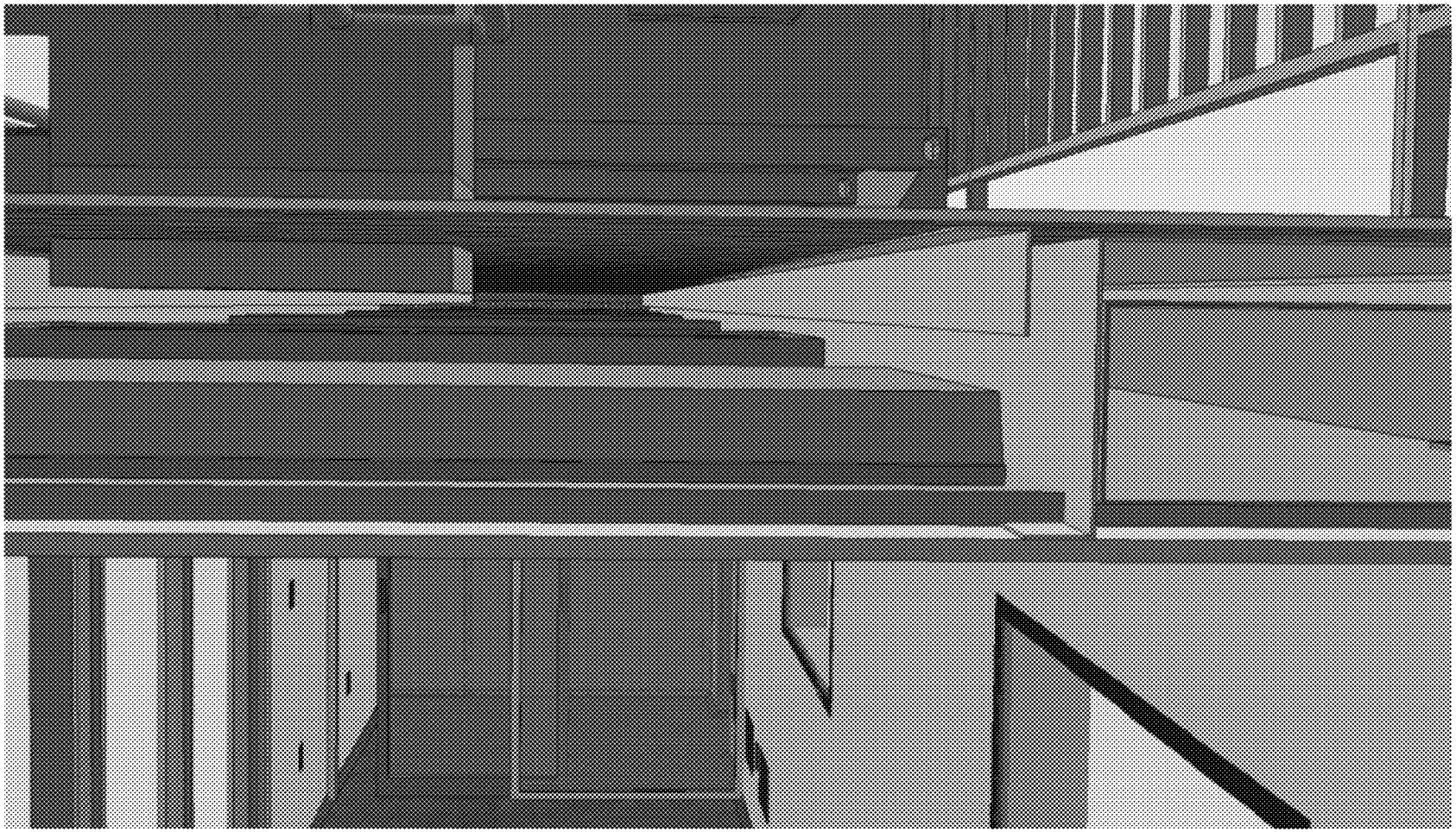
FIG. 51 is another view of a portion of a ceiling plenum according to one embodiment of the present invention.

FIG. 51 is another view of a portion of a ceiling plenum according to one embodiment of the present invention. Plenum divider 106 is illustrated, as are ceiling joists 107*a* and 107*b* and ceiling dry wall 108. Air return duct 112 runs adjacent the plenum space 110. Container top 101 includes an opening to allow the air supply duct to provide air to the plenum. The entire plenum space is sealed so that air may only enter the plenum through the air supply duct, and may only exit the plenum through the filters in the module ceiling. All spaces around the lighting fixtures, as well as all spaces where plenum walls join other walls or surfaces, are sealed to provide an airtight plenum space.

Figure 52:
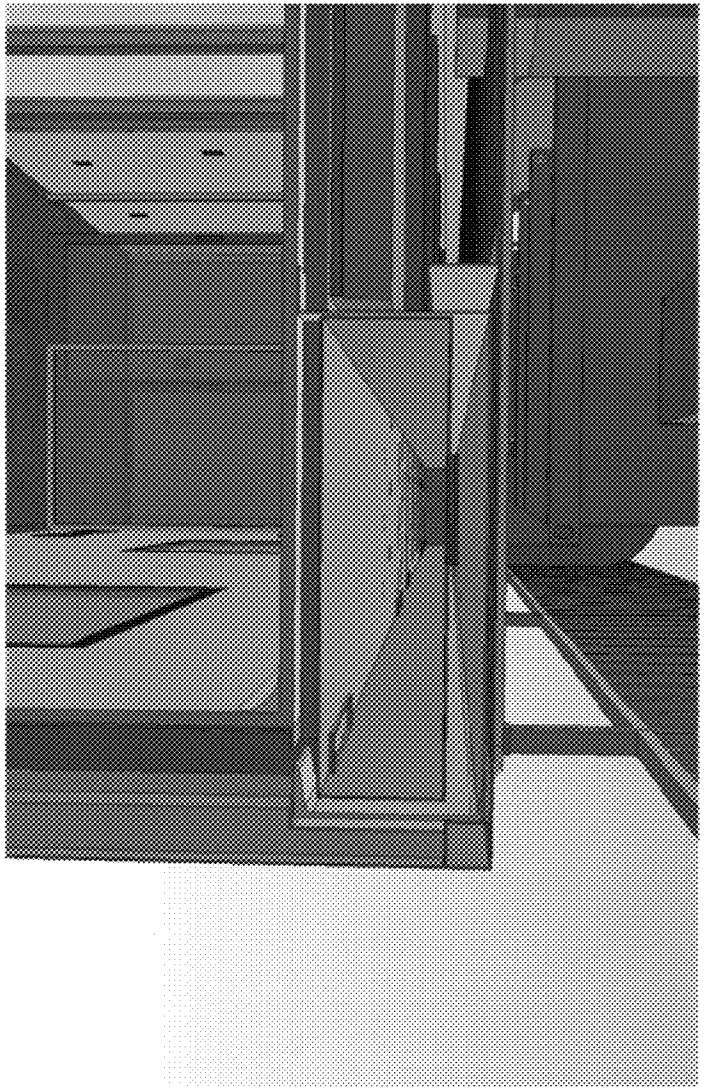
FIG. 52 is a view of an air return duct adjacent a ceiling plenum according to one embodiment of the present invention.

FIG. 52 is a view of an air return duct adjacent a ceiling plenum according to one embodiment of the present invention. Air return duct 112 is bounded on the outside by side wall 105*b*, and on the inner side by plenum divider wall 106. Air return duct openings to allow return air to enter the duct from air returns in the module wall are also illustrated.

Figure 53:
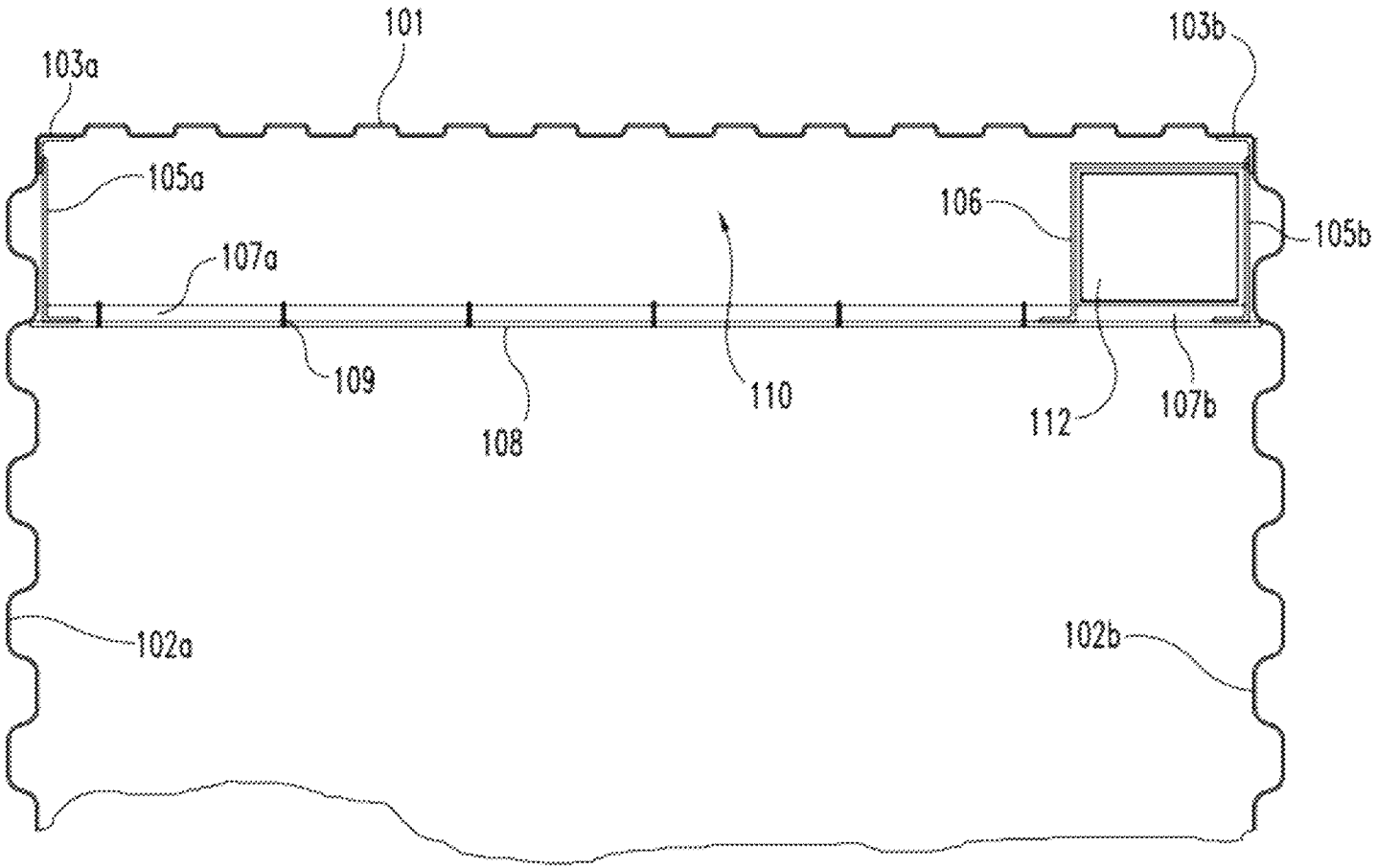
FIG. 53 is a section view of a ceiling plenum according to one embodiment of the present invention.

FIG. 53 is a section view of a ceiling plenum according to one embodiment of the present invention. Container top 101 and container side walls 102*a* and 102*b* join at top rails 103*a* and 103*b* respectively. One end of plenum sidewall 105*a* is welded to and extends downward from top rail 103*a* and the other end of plenum sidewall 105*a* is welded to and supports ceiling joists 107*a*. Similarly, one end of plenum divider 106 is welded to and extends downward from top rail 103*b* and the other end of plenum divider 106 is welded to and supports ceiling joists 107*a*. Ceiling drywall 108 is secured to ceiling joists 107 above, preferably using screws 109. An air return duct 112 resides on the outside of plenum divider 106.

In the illustrated embodiment a second sidewall 105*b* is provided along the side of the module opposite sidewall 105*a*. Ceiling joist 107*b* provide a structure for attaching ceiling drywall 108 under air return duct 112.

An airtight plenum is formed in the space bounded by ceiling 101 above, plenum sidewall 105 on one side, plenum divider 106 on the opposite side, and ceiling joists 107 and ceiling drywall 108 below. Filters and lighting fixtures are provided in ceiling drywall 108 that forms the bottom surface of the plenum, and one or more air supply openings are provided in the roof that forms the top surface of the plenum above. All openings other than the filter openings and the air supply duct are filled to prevent air from leaking into or out of the plenum.

Figure 54:
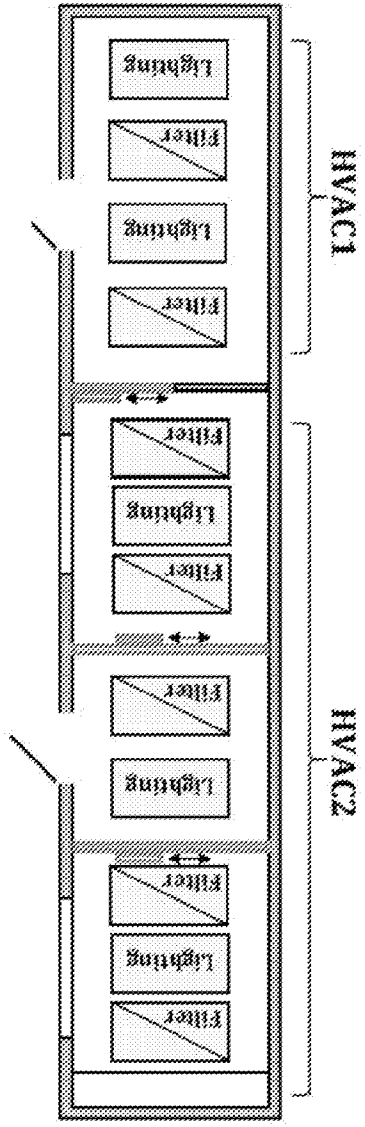
FIG. 54 illustrates certain design features of a mobile, modular radiopharmaceutical facility embodiment of the present invention.

FIG. 54 illustrates certain design features of a mobile, modular radiopharmaceutical facility embodiment of the present invention. For example, FIG. 47 illustrates features of the container and its lighting and HVAC system. Interior walls to separate the manufacturing, gowning, and compounding areas are also indicated.

Figure 55:
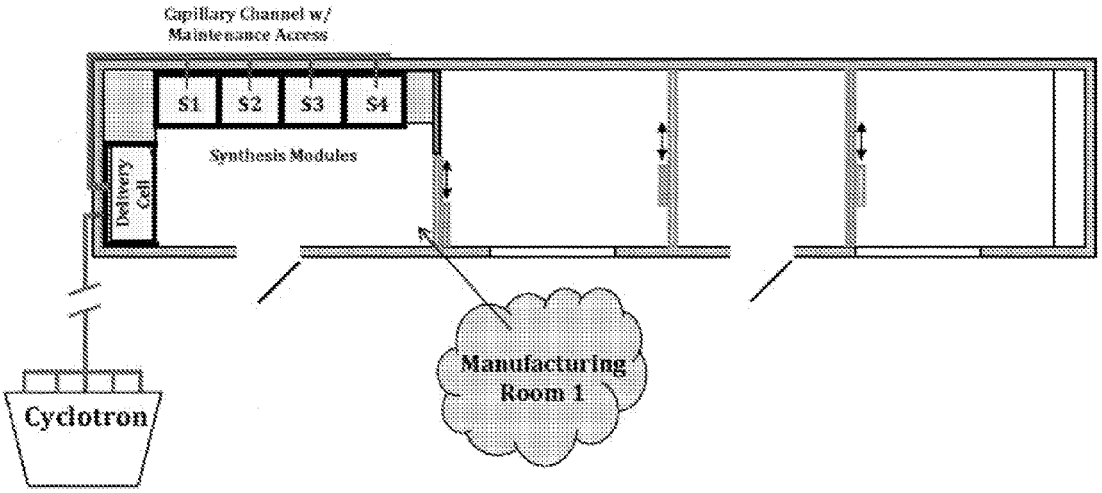
FIG. 55 illustrates certain design features of the manufacturing area of a mobile, modular radiopharmaceutical facility embodiment of the present invention.

FIG. 55 illustrates certain design features of the manufacturing area of a mobile, modular radiopharmaceutical facility embodiment of the present invention. For example, a bench comprising a radiation-shielded material for supporting various synthesis modules is shown. A delivery cell for receiving radiation-containing materials from a cyclotron is also indicated, as is a capillary channel from moving radiation-containing materials through the workspace. The synthesis modules may be accessed from the interior of the facility, or access panels to allow access from the outside may be provided.

Figure 56:
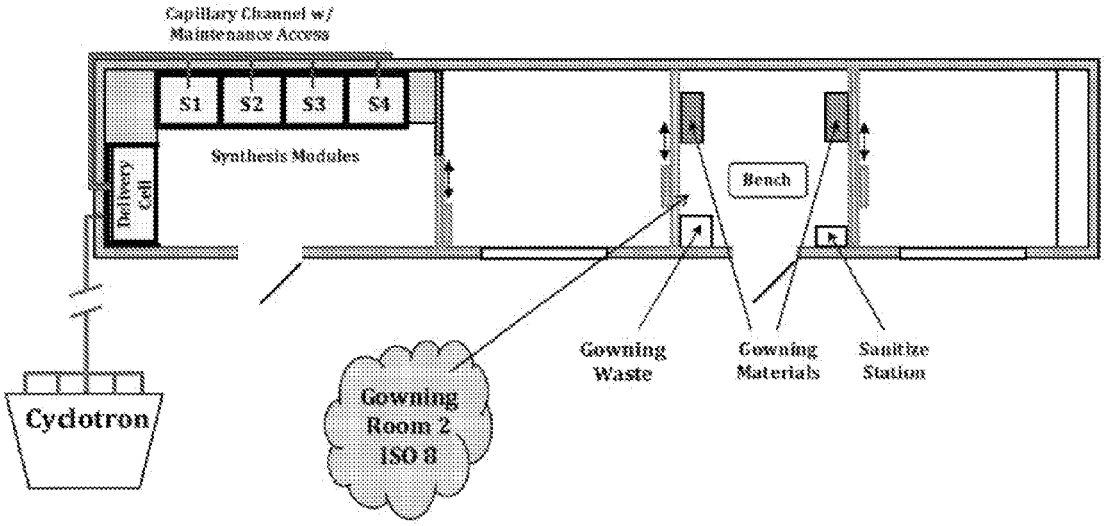
FIG. 56 illustrates certain design features of the manufacturing and gowning areas of a mobile, modular radiopharmaceutical facility embodiment of the present invention.

FIG. 56 illustrates certain design features of the manufacturing and gowning areas of a mobile, modular radiopharmaceutical facility embodiment of the present invention. For example, a gowning area is provided immediately inside a main entry door to allow workers to gown and prepare for their work.

Figure 57:
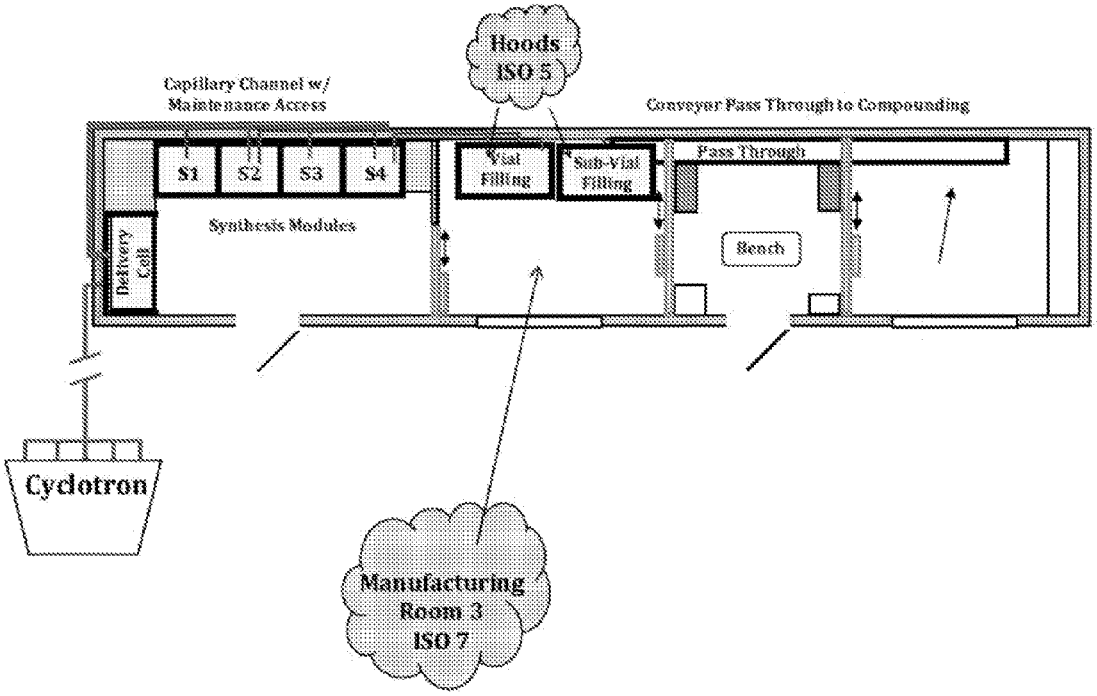
FIG. 57 illustrates certain design features of the manufacturing and gowning areas of a mobile, modular radiopharmaceutical facility embodiment of the present invention.

FIG. 57 illustrates certain design features of the manufacturing and gowning areas of a mobile, modular radiopharmaceutical facility embodiment of the present invention. For example, vial filling areas inside ISO 5-rated hoods are indicated in a cleanroom area between the initial manufacturing area and the gowning area.

Figure 58:
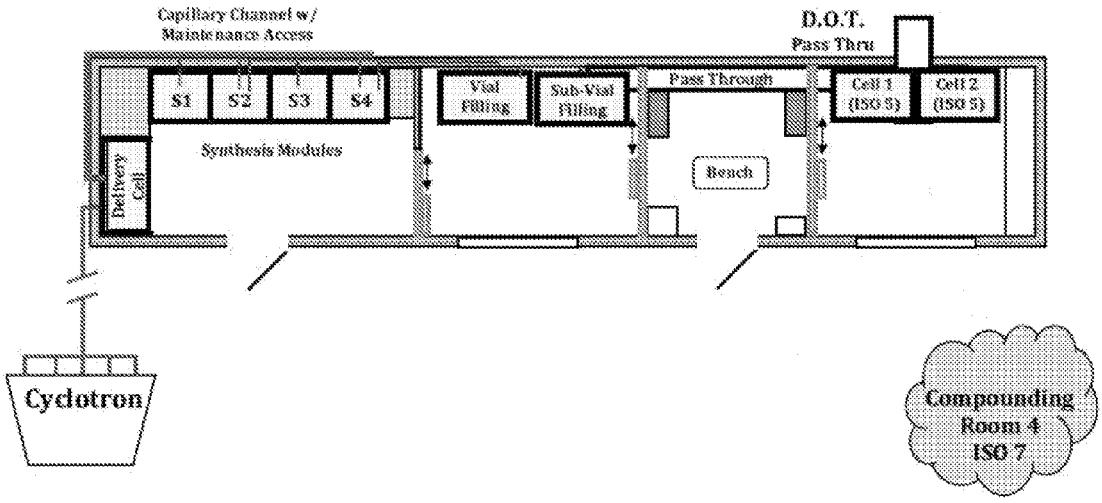
FIG. 58 illustrates certain design features of the manufacturing, gowning, and compounding areas of a mobile, modular radiopharmaceutical facility embodiment of the present invention.

FIG. 58 illustrates certain design features of the manufacturing, gowning, and compounding areas of a mobile, modular radiopharmaceutical facility embodiment of the present invention. For example, a compounding area at the end of the module is indicated, with a pass-through to allow radiation-containing materials to be transferred from the inside of the module to the outside of the module while protecting workers and the environment from radiation. Similarly, waste containers may be provided below one or more of the synthesis modules, vial-filling modules, or compounding cells to facilitate collection and disposal or radiation-containing waste materials.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A mobile, modular cleanroom facility comprising at least two pre-assembled modules, wherein each of said pre-assembled modules comprises a metal shipping container and is transportable by intermodal freight transport in its pre-assembled form, and wherein said modular cleanroom facility includes an air filtration system effective for cleaning air to at least an ISO 8 classification and for providing such air to an interior space of the facility;

wherein each of said modules includes an opening in its side adapted to permit easy passage into and from the module;

wherein the side opening of a first module is connected to the side opening of a second module by a module connector;

wherein said module connector comprises a first connector frame assembly fixedly attached to said first module in a manner to completely surround the side opening of the first module, and a second connector frame assembly fixedly attached to said second module in a manner to completely surround the side opening of the second module, wherein said first connector frame assembly is connected directly to said second connector frame assembly in a manner effective to provide a smooth, seamless, and airtight passageway between the two modules through the adjacent and connected side openings.

2. A mobile, modular cleanroom facility according to claim 1 wherein said direct connection between said first connector frame assembly and said second connector frame assembly is secured by one or more bolts securing the first connector assembly directly to the second connector assembly.

3. A mobile, modular cleanroom facility according to claim 1 wherein each of said first and second connector frame assemblies comprises an end portion fixedly attached to its respective module, a central portion extending away from the module, and a face portion extending from the central portion and effective to provide a surface for connection by bolts.

4. A mobile, modular cleanroom facility according to claim 1 wherein said first mobile cleanroom module roof includes an opening therein, and wherein said first mobile cleanroom module includes a blower mounted above said container roof and ducted to blow air through said roof opening and into said interior space.

5. A mobile, modular cleanroom facility according to claim 1 wherein each module includes a space between an interior end wall and an openable container endwall, with a service compartment housing an electrical service panel being provided in that space.

6. A mobile, modular cleanroom facility according to claim 1 wherein each module includes a roof that is coated on its outside with a durable water-resistant coating.

7. A mobile, modular cleanroom facility according to claim 1 wherein said first mobile cleanroom module includes one or more air filters in said ceiling, wherein at least one of said one or more air filters is effective for filtering air to at least an ISO 8 cleanroom standard.

8. A mobile, modular cleanroom facility according to claim 1 wherein said first connector frame completely surrounds the side opening of said first module and said second connector frame completely surrounds the side opening of said second module and said first connector frame assembly is connected directly to said second connector frame assembly in a manner effective to provide a smooth, seamless and airtight passageway between the two modules through the adjacent and connected side openings.

9. A mobile, modular, cleanroom facility comprising at least two pre-assembled modules, wherein each of said pre-assembled modules comprises a metal shipping container and is transportable by intermodal freight transport in its pre-assembled form; and wherein said modular cleanroom facility includes an air filtration system effective for cleaning air to at least an ISO 8 classification and for providing such air to an interior space of the facility;

wherein each of said mobile cleanroom modules comprises a metal container having a container roof, a container bottom, a first container sidewall, a second container sidewall, a closed container endwall, and an openable container endwall;

wherein each of said mobile cleanroom modules has a floor over substantially all of said container bottom, a ceiling below and spaced apart from said container roof, a first interior sidewall substantially parallel to and spaced slightly apart from said first container sidewall, a second interior sidewall substantially parallel to and spaced slightly apart from said second container sidewall, a first interior end wall substantially parallel to and spaced slightly apart from said closed container end wall, and a second interior end wall substantially parallel to and spaced slightly apart from said openable container endwall;

wherein said floor, said ceiling, said first interior sidewall, said second interior sidewall, said first interior end wall, and said second interior end wall all combine to define an interior clean space having controlled air flow therethrough;

wherein said ceiling extends substantially from said first container sidewall to said second container sidewall, and from said closed container endwall to said openable container endwall, and wherein the space between said container roof and said module ceiling provides a ceiling plenum for providing cleanroom air to said module;

wherein each of said modules includes an opening in its side adapted to permit easy passage into and from the module;

wherein the side opening of a first module is connected to the side opening of a second module by a module connector;

wherein said module connector comprises a first connector frame assembly fixedly attached to said first module in a manner effective to surround the side opening of said first module, and wherein said module connector comprises a second connector frame assembly fixedly attached to said second module in a manner effective to surround the side opening of said second module, wherein said first connector frame assembly is connected directly to said second connector frame assembly in a manner effective to provide a smooth, seamless and airtight passageway between the two modules through the adjacent and connected side openings.

10. A mobile, modular, cleanroom facility according to claim 9 wherein the space between the container roof and the module ceiling includes a return air duct adjacent the ceiling plenum.

11. A mobile, modular, cleanroom facility according to claim 9 wherein the space between the container roof and the module ceiling includes a plenum divider having a first end welded to and extending downward from a top rail, and having a second end welded to and supporting ceiling joists.

12. A mobile, modular, cleanroom facility according to claim 9 wherein each of said modules includes an opening in its side adapted to permit easy passage into and from the module; and wherein the side opening of a first module is connected to the side opening of a second module by a module connector effective to provide a smooth, seamless transition between the two modules through the adjacent and connected side openings.

13. A mobile, modular cleanroom facility according to claim 12 wherein said module connector comprises a first connector assembly fixedly attached to said first module, and a second connector assembly fixedly attached to said second module, and wherein said first connector assembly is connected directly to said second connector assembly.

14. A mobile, modular cleanroom facility according to claim 13 wherein said direct connection between said first connector assembly and said second connector assembly is secured by one or more bolts securing the first connector assembly directly to the second connector assembly.

15. A mobile, modular cleanroom facility according to claim 14 wherein each of said first and second connector assemblies comprises an end portion fixedly attached to its respective module, a central portion extending away from the module, and a face portion extending from the central portion and effective to provide a surface for connection by bolts.

16. A mobile, modular cleanroom facility according to claim 9 wherein said first mobile cleanroom module roof includes an opening therein, and wherein said first mobile cleanroom module includes a blower mounted above said container roof and ducted to blow air through said roof opening and into said interior space.

17. A mobile, modular cleanroom facility according to claim 9 wherein the space between said second interior end wall and said openable container endwall is a service compartment housing an electrical service panel.

18. A mobile, modular cleanroom facility according to claim 9 wherein the container roof is coated on the outside with a durable water-resistant coating.

19. A mobile, modular cleanroom facility according to claim 9 wherein said first mobile cleanroom module includes one or more air filters in said ceiling, wherein at least one of said one or more air filters is effective for filtering air to at least an ISO 8 cleanroom standard.

* * * * *